US012490779B2

(12) United States Patent
Waldman et al.

(10) Patent No.: US 12,490,779 B2
(45) **Date of Patent: *Dec. 9, 2025**

(54) BRA ASSEMBLY TO PROVIDE PROPER FIT FOR MULTIPLE SIZED WEARERS

(71) Applicant: GLOBAL TRADEMARKS, INC., Nazareth, PA (US)

(72) Inventors: Mark Waldman, New Hope, PA (US); Ruth Gordon, Bernardsville, NJ (US); Lisa Mary Butler, Parsippany, NJ (US)

(73) Assignee: GLOBAL TRADEMARKS, INC., Nazareth, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/337,927

(22) Filed: Jun. 20, 2023

(65) Prior Publication Data

US 2023/0329361 A1 Oct. 19, 2023

Related U.S. Application Data

(63) Continuation of application No. 16/654,231, filed on Oct. 16, 2019, now Pat. No. 11,957,185.

(60) Provisional application No. 62/746,214, filed on Oct. 16, 2018.

(51) Int. Cl.
*A41C 3/14* (2006.01)
*A41C 3/00* (2006.01)

(52) U.S. Cl.
CPC ..... *A41C 3/144* (2013.01); *A41C 3/0028* (2013.01); *A41C 3/0035* (2013.01); *A41C 3/0092* (2013.01)

(58) Field of Classification Search
None
See application file for complete search history.

(56) References Cited

U.S. PATENT DOCUMENTS

| | | | |
|---|---|---|---|
| 1,354,684 | A | 10/1920 | Purcell |
| 1,400,056 | A | 12/1921 | Kaletae |
| 1,595,596 | A | 8/1926 | Brandt |
| 1,958,963 | A | 5/1934 | De Got |
| 2,045,401 | A | 6/1936 | Mowry |
| 2,078,099 | A | 4/1937 | Rotelli et al. |
| 2,102,801 | A | 12/1937 | Kunstadter |
| 2,112,151 | A | 3/1938 | Freedman |
| 2,156,478 | A | 5/1939 | Kemp |
| 2,372,265 | A | 3/1945 | Fletcher |
| 2,390,465 | A | 12/1945 | Russo |
| 2,432,910 | A | 12/1947 | Licht |
| 2,449,808 | A | 9/1948 | Glick |
| 2,470,847 | A | 5/1949 | Gluckin |
| 2,502,524 | A | 4/1950 | Keller |
| 2,521,373 | A | 9/1950 | Hutchison |
| 2,553,225 | A | 5/1951 | Weaver et al. |
| 2,607,038 | A | 8/1952 | Spare |
| 2,613,355 | A | 10/1952 | Coleman |
| 2,644,162 | A | 7/1953 | Schaumer |
| 2,683,879 | A | 7/1954 | Dollarhide |

(Continued)

*Primary Examiner* — Jocelyn Bravo
(74) *Attorney, Agent, or Firm* — Ruggiero McAllister & McMahon LLC

(57) ABSTRACT

The present disclosure provides a new bra assembly that allows for the fashionable fit of two or more bra sized wearers in a single bra sized garment. The present disclosure also provides for a bra assembly that enables wearers with different cup sizes, as well as many different underband sizes, to comfortable fit into the same bra sized garment.

17 Claims, 58 Drawing Sheets

(56) References Cited

U.S. PATENT DOCUMENTS 2,715,225 A 8/1955 Gould
2,753,563 A 7/1956 Blitch
2,773,261 A 12/1956 Schaumer
2,863,460 A 12/1958 Monroe
2,970,597 A 2/1961 Michel
3,008,468 A 11/1961 Williams
3,077,197 A 2/1963 Garfinkel
3,134,994 A 6/1964 Christofferson
3,164,154 A 1/1965 Simonsen
3,164,155 A 1/1965 Simonsen
3,213,462 A 10/1965 Ramsell
3,221,748 A 12/1965 Glasser
3,255,754 A * 6/1966 Brumberger ..... A41D 7/00 450/55
3,302,649 A 2/1967 Bruno
3,334,632 A 8/1967 Rashkin
3,378,013 A 4/1968 Bruno
3,459,190 A 8/1969 Frischer et al.
3,677,252 A 7/1972 Pedley
3,746,007 A * 7/1973 Hand ..... A41D 10/00 450/86
3,763,865 A 10/1973 DeFru
3,981,310 A 9/1976 Donaghy
4,000,544 A 1/1977 Fidan
4,024,876 A 5/1977 Penrock
4,091,819 A 5/1978 Huber et al.
4,187,855 A 2/1980 Paulus et al.
4,269,191 A 5/1981 Evans
4,289,137 A 9/1981 Dell et al.
4,300,568 A 11/1981 Blanckmeister
4,325,378 A 4/1982 Wilkinson
4,372,320 A 2/1983 Silber
4,398,538 A 8/1983 Johnson
4,411,269 A 10/1983 Weintraub
4,530,361 A 7/1985 Wooten
4,564,015 A 1/1986 Friedman
4,630,610 A 12/1986 Fletcher
4,632,118 A * 12/1986 Garutso ..... A41C 3/10 450/53
4,781,651 A 11/1988 Ekins
4,798,557 A 1/1989 Scott
4,909,771 A 3/1990 Bergman
4,911,677 A 3/1990 White
4,916,755 A 4/1990 Feigenbaum et al.
4,995,847 A 2/1991 Hwang
5,032,104 A 7/1991 Rainville
5,033,986 A 7/1991 Feigenbaum et al.
5,045,018 A 9/1991 Costanzo
5,123,121 A 6/1992 Broersma
5,149,293 A 9/1992 Gable
5,180,326 A 1/1993 Williams
5,221,227 A 6/1993 Michels
5,359,732 A 11/1994 Waldman et al.
5,378,192 A 1/1995 Darmante
5,385,502 A 1/1995 Moretz et al.
5,441,436 A 8/1995 Moretz et al.
5,478,278 A 12/1995 Greenblatt
5,538,502 A 7/1996 Johnstone
5,839,942 A 11/1998 Miller
D403,486 S 1/1999 Chetwynd
5,871,388 A 2/1999 Lambert
5,957,748 A 9/1999 Ichiha
6,059,633 A 5/2000 Currier
6,110,005 A * 8/2000 Stephenson ..... A41C 3/0057 450/39
6,162,111 A 12/2000 Heroff
6,280,287 B1 8/2001 Keith et al.
6,282,719 B1 9/2001 Vera et al.
6,319,091 B1 11/2001 Kilbride et al.
6,336,840 B2 1/2002 Heroff
6,431,947 B1 8/2002 Henz
6,443,805 B1 9/2002 Kirkwood
6,530,820 B1 3/2003 Katze et al.
6,811,462 B1 11/2004 Kenneally
6,839,908 B2 1/2005 Schneider et al.
6,846,217 B1 1/2005 Struble et al.
6,855,029 B2 2/2005 Rothman
6,935,921 B1 8/2005 Eudenbach et al.
7,001,240 B1 2/2006 Huffman-Jimenez
7,056,186 B1 6/2006 Weyenberg et al.
7,076,809 B2 7/2006 Rothman
7,077,720 B2 7/2006 Schneider et al.
7,081,035 B2 7/2006 Kawakami
7,115,015 B2 10/2006 Horii et al.
7,186,163 B2 3/2007 Carlucci
D550,368 S 9/2007 Hankins
D556,978 S 12/2007 Thunstedt
7,407,429 B2 8/2008 Chen
7,448,937 B2 11/2008 Weyenberg et al.
7,488,234 B2 2/2009 Rothman et al.
RE41,654 E 9/2010 Struble et al.
7,878,880 B2 2/2011 Hendrickson
D641,130 S 7/2011 Zarabi
D641,133 S 7/2011 Zarabi
8,137,155 B2 3/2012 Horii et al.
D658,353 S 5/2012 Cage et al.
8,257,138 B2 9/2012 Smith
D668,430 S 10/2012 Martin
8,317,569 B2 11/2012 Fisher-Pacheco
8,337,275 B2 12/2012 Martins-Crawbuck et al.
8,403,724 B1 3/2013 Chapin
8,506,350 B1 8/2013 Silverman et al.
8,523,631 B2 9/2013 Smith
8,574,026 B2 11/2013 Livingstone
8,574,027 B2 11/2013 Kipnes
8,585,458 B2 11/2013 Armanino
D709,669 S 7/2014 Pavlik et al.
8,827,764 B2 9/2014 Caruso et al.
8,870,624 B2 10/2014 Hopkins
8,932,103 B2 1/2015 Hansen
9,022,833 B2 5/2015 Deming
9,049,890 B2 6/2015 Starr et al.
9,084,443 B2 7/2015 Moulden et al.
9,198,467 B2 12/2015 Gordon
9,215,896 B2 12/2015 Smith
9,226,530 B1 1/2016 Silverman et al.
9,277,772 B2 3/2016 Gibbard et al.
9,320,305 B1 4/2016 Berger
9,480,287 B2 11/2016 Black et al.
D773,149 S 12/2016 Kercher, III
9,596,890 B2 3/2017 Redenius
10,231,492 B1 3/2019 Bastug
RE47,397 E 5/2019 Waldman et al.
10,905,173 B1 2/2021 Kosak et al.
10,986,880 B2 4/2021 Stephens et al.
10,986,881 B2 4/2021 Stanton et al.
11,127,210 B2 9/2021 Novak et al.
2001/0019933 A1 9/2001 Wagner
2002/0022433 A1 2/2002 Yeung et al.
2002/0102913 A1 8/2002 Courtney et al.
2003/0096557 A1* 5/2003 Waitz ..... A41C 3/00 450/1
2003/0166376 A1 9/2003 Hanson
2003/0186618 A1 10/2003 Oneyear et al.
2005/0037687 A1 2/2005 Newman
2005/0255789 A1 11/2005 Gaudet et al.
2006/0003669 A1 1/2006 Li
2006/0009124 A1 1/2006 Falla
2006/0089083 A1 4/2006 Tonsor
2006/0228988 A1 10/2006 Weyenberg et al.
2007/0128981 A1 6/2007 Saraceno et al.
2007/0161329 A1 7/2007 Torrey
2008/0003922 A1* 1/2008 Hori ..... A41C 3/0057 450/54
2008/0153389 A1 6/2008 Nobbs
2008/0194179 A1 8/2008 Leung
2009/0209172 A1 8/2009 Getz
2009/0233522 A1 9/2009 Schlatmann
2010/0130098 A1 5/2010 Kammerer
2010/0190411 A1 7/2010 Saraceno
2011/0081827 A1 4/2011 Williams
2011/0092133 A1 4/2011 Livingstone
2011/0117818 A1 5/2011 Barnard
2011/0136406 A1 6/2011 Finocchiaro

(56) References Cited

U.S. PATENT DOCUMENTS

2011/0177757 A1 7/2011 Swendseid et al.
2011/0201253 A1 8/2011 Stude
2011/0275277 A1 11/2011 Martins-Crawbuck et al.
2012/0015586 A1 1/2012 Lopez et al.
2012/0021669 A1 1/2012 Johnstone
2012/0122370 A1 5/2012 Heath et al.
2012/0135667 A1 5/2012 Chan
2012/0149277 A1* 6/2012 Moses-Jones ..... A41C 3/0028 450/75
2012/0192595 A1 8/2012 Waldman et al.
2012/0220193 A1 8/2012 Thompson
2013/0019370 A1 1/2013 Dweck et al.
2013/0065486 A1* 3/2013 Hansen ..... A41C 3/0064 450/59
2013/0205464 A1 8/2013 Gibbard et al.
2013/0217304 A1 8/2013 Bailey et al.
2014/0017977 A1 1/2014 Horii et al.
2014/0087625 A1 3/2014 Ironi
2014/0141692 A1 5/2014 Yuasa et al.
2014/0357158 A1 12/2014 Redenius
2014/0357159 A1 12/2014 Balland
2015/0007374 A1 1/2015 Larson et al.
2015/0087204 A1 3/2015 Conde
2015/0093965 A1 4/2015 Allen
2015/0099420 A1 4/2015 Reinhard
2015/0147939 A1 5/2015 Chen
2016/0044971 A1 2/2016 Randall et al.
2016/0338419 A1 11/2016 Fayad
2016/0374406 A1 12/2016 Hansen
2017/0035130 A1 2/2017 Hazzard
2018/0325185 A1 11/2018 Sakai
2019/0008214 A1 1/2019 Kaye
2019/0261698 A1 8/2019 Akerson et al.
2019/0313709 A1 10/2019 Hollins
2019/0328050 A1 10/2019 Stanton et al.
2020/0037673 A1 2/2020 Storelli et al.
2020/0138122 A1 5/2020 Stein
2020/0383390 A1 12/2020 Stein
2021/0186125 A1 6/2021 Lee
2021/0219627 A1 7/2021 Brizay
2021/0298367 A1 9/2021 Song

* cited by examiner

| Model | | | | | Garment | | | Garment | | | Garment | | | Garment | | |
|---|---|---|---|---|---|---|---|---|---|---|---|---|---|---|---|---|
| | | | | | Flat | On Body | | Flat | On Body | | Flat | On Body | | Flat | On Body | |
| figure 12 - 19 and 19AA | | | | | UnderBand movement in width | | | Apex to Apex cup movement in width | | | Cup movement in diagonal adjustable side | | | Cup movement in diagonal hook side | | |
| Measurement of the models | | | Point of Measure-ments: | Adjustable | O - P | O - P | % change | C - D | C - D | % change | C - E | C - E | % change | D - E | D - E | % change |
| Underband 32" Apex 42" | Bra Size: 34GG | Model 102 | | 3" Loop | 5" | 6.875" | 28% | 7" | 8.375" | 17% | 3.875 | 4.5 | 16% | 4.125 | 5 | 21% |
| Underband 33.75" Apex 42" | Bra Size: 36C | Model 104 | | 2nd loop | 5" | 6.75" | 26% | 7" | 9.0" | 23% | 4.5 | 5 | 11% | 4.125 | 5 | 21% |
| Underband 34.5" Apex 43.5" | Bra Size: 38DD | Model 106 | | 1" Loop | 5" | 6.625" | 25% | 7" | 9.5" | 27% | 4.875 | 5.5 | 13% | 4.125 | 5 | 21% |

1803 1805 1807 1802 1804 1806 1808 1810 1812 1814 1816 1818 1820 1822 1824 1826 1828 1830 1832

TABLE 1

FIG. 18C

| Model | | | | | Garment | | | Garment | | | Garment | | | Garment | | |
|---|---|---|---|---|---|---|---|---|---|---|---|---|---|---|---|---|
| | | | | | Flat | On Body | | Flat | On Body | | Flat | On Body | | Flat | On Body | |
| figure 12 - 19 and 19AA | | | | | Cup movement in height | | | Cup movement in height | | | Cup movement in height | | | Cup movement in height | | |
| Measurement of the models | | | Point of Measure-ments: | Adjustable | C - F | C - F | % change | D - G | D - G | % change | C - H | C - H | % change | D - E | D - E | % change |
| Underband 32" Apex 42" | Bra Size: 34GG | Model 102 | | 3" Loop | 2.3125" | 2.375" | 3% | 2.3125" | 2.1275" | -8% | 2.8125" | 2.8125" | 0 | 2.8125" | 2.9375" | 4% |
| Underband 33.75" Apex 42" | Bra Size: 36C | Model 104 | | 2nd loop | 2.3125" | 2.25" | -3% | 2.3125" | 2.3125" | 0% | 2.8125" | 2.8125" | 0 | 2.8125" | 2.9375" | 4% |
| Underband 34.5" Apex 43.5" | Bra Size: 38DD | Model 106 | | 1" Loop | 2.3125" | 2.5" | 8% | 2.3125" | 2.4375" | 5% | 2.8125" | 2.8125" | 0 | 2.8125" | 2.9375" | 4% |

1803 1805 1807 1834 1836 1838 1840 1842 1844 1846 1848 1850 1852 1854 1856

TABLE 1 (continued)

FIG. 18D

| Model | | | | | Garment | | | Garment | | | Garment | | |
|---|---|---|---|---|---|---|---|---|---|---|---|---|---|
| | | | | | Flat | On Body | | Flat | On Body | | Flat | On Body | |
| figure 12 - 19 and 19AA | | | | | Center Front movement hight | | | Center Btm of V to Apex cup movement in width | | | Center Btm of V to Apex cup movement in width | | |
| Measurement of the models | | | Point of Measure-ments: | Adjustable | L - E | L - E | % change | L - C | L - C | % change | L - D | L - D | % change |
| Underband 32" Apex 42" | Bra Size: 34GG | Model 102 | | 3" Loop | 2.375" | 2.5 | 4% | 3.875 | 5.125" | 25% | 3.875 | 5.125" | 25% |
| Underband 33.75" Apex 42" | Bra Size: 36C | Model 104 | | 2nd loop | 2.375" | 2.875 | 21% | 3.875 | 5.125" | 25% | 3.875 | 5.0625" | 24% |
| Underband 34.5" Apex 43.5" | Bra Size: 38DD | Model 106 | | 1" Loop | 2.375" | 2.875 | 21% | 3.875 | 5.25" | 20% | 2.8125" | 5.25" | 20% |

1803 1805 1807 1860 1862 1864 1868 1870 1872 1874 1876 1878

TABLE 1 (continued)

FIG. 18E

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 26" to 28" | 24" to 26" | | 22" to 24" | 20" to 22" | 18" to 20" | | |
| | 32AA | 30A | 2 | 28B | 26C | 24D | 32 - 33 | 5 |
| | 32A | 30B | 2 | 28C | 26D | 24DD | 33 - 34 | 5 |
| | 32B | 30C | 2 | 28D | 26DD | 24DDD | 34 - 35 | 5 |
| | 32C | 30D | 2 | 28DD | 26DDD | 24E | 35 - 36 | 5 |
| | 32D | 30DD | 2 | 28DDD | 26E | | 36 - 37 | 5 |
| | 32DD | 30DDD | 2 | 28E | | | 37 - 38 | 5 |
| | New improve | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 28" to 30" | 26" to 28" | | 24" to 26" | 22" to 24" | 20" to 22" | | |
| | | 32A | 4 | 30B | 28C | 26D | 33 - 34 | 5 |
| | 34A | 32B | 4 | 30C | 28D | 26DD | 34 - 35 | 5 |
| | 34B | 32C | 4 | 30D | 28DD | 26DDD | 35 - 36 | 5 |
| | 34C | 32D | 4 | 30DD | 28DDD | 26E | 36 - 37 | 5 |
| | 34D | 32DD | 4 | 30DDD | 28E | | 37 - 38 | 5 |
| | 34DD | 30DDD | 4 | 30E | | | 38.5 - 39.5 | 5 |
| | 34DDD | 32E | 4 | 30F | | | 39.75 - 40.75 | 5 |
| New improve | | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 30" to 32" | 28" to 30" | | 26" to 28" | 24" to 26" | 22" to 24" | | |
| | | | 6 | 32B | 30C | 28D | 34 - 35 | 5 |
| | | 34B | 6 | 32C | 30D | 28DD | 35 - 36 | 5 |
| | 36B | 34C | 6 | 32D | 30DD | 28DDD | 36 - 37 | 5 |
| | 36C | 34D | 6 | 32DD | 30DDD | 28E | 37 - 38 | 5 |
| | 36D | 34DD | 6 | 32DDD | 30E | | 38.5 - 39.5 | 5 |
| | 36DD | 34DDD | 6 | 32E | 30F | | 39.75 - 40.75 | 5 |
| | 36DDD | 34E | 6 | 32F | | | 40.75 - 42.75 | 5 |
| | 36E | 34F | 6 | 32G | | | 42.5 - 43.5 | 5 |
| New improve | | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 32" to 34" | 30" to 32" | | 28" to 30" | 26" to 28" | 24" to 26" | | |
| | | | 8 | 34B | 32C | 30D | 35 - 36 | 5 |
| | | 36B | 8 | 34C | 32D | 30DD | 36 - 37 | 5 |
| | 38B | 36C | 8 | 34D | 32DD | 30DDD | 37 - 38 | 5 |
| | 38C | 36D | 8 | 34DD | 32DDD | 30E | 38.5 - 39.5 | 5 |
| | 38D | 36DD | 8 | 34DDD | 32E | 30F | 39.75 - 40.75 | 5 |
| | 38DD | 36DDD | 8 | 34E | 32F | 30G | 40.75 - 42.75 | 5 |
| | | 36E | 8 | 34F | 32G | | 42.5 - 43.5 | 5 |
| | | 36F | 8 | 34G | | | 43.5 - 44.5 | 5 |
| New improve | | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 34" to 36" | 32" to 34" | | 30" to 32" | 28" to 30" | 26" to 28" | | |
| | | | 10 | 36B | 34C | 32D | 36 - 37 | 5 |
| | | 38B | 10 | 36C | 34D | 32DD | 37 - 38 | 5 |
| | 40B | 38C | 10 | 36D | 34DD | 32DDD | 38.5 - 39.5 | 5 |
| | 40C | 38D | 10 | 36DD | 34DDD | 32E | 39.75 - 40.75 | 5 |
| | 40D | 38DD | 10 | 36DDD | 34E | 32F | 40.75 - 42.75 | 5 |
| | 40DD | 38DDD | 10 | 36E | 34F | 32G | 42.5 - 43.5 | 5 |
| | | 38E | 10 | 36F | 34G | | 43.5 - 44.5 | 5 |
| | | | 10 | 36G | 34H | | 44.5 - 45.5 | 5 |
| New improve | | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 38" to 40" | 36" to 38" | | 34" to 36" | 32" to 34" | 30" to 32" | | |
| | | | 14 | 40B | 38C | 36D | 38.5 - 39.5 | 5 |
| | | 42B | 14 | 40C | 38D | 36DD | 39.75 - 40.75 | 5 |
| | 44B | 42C | 14 | 40D | 38DD | 36DDD | 40.75 - 42.75 | 5 |
| | 44C | 42D | 14 | 40DD | 38DDD | 36E | 42.5 - 43.5 | 5 |
| | 44D | 42DD | 14 | 40DDD | 38E | 36F | 43.5 - 44.5 | 5 |
| | 44DD | 42DDD | 14 | 40E | 38F | 36G | 44.5 - 45.5 | 5 |
| | 44DDD | 42E | 14 | 40F | 38G | 36H | 45.5 - 46.5 | 5 |
| | 44E | 42F | 14 | 40G | 38H | | 46.5 - 47.5 | 5 |
| New improve | | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 40" to 42" | 38" to 40" | | 36" to 38" | 34" to 36" | 32" to 34" | | |
| | | | 16 | 42B | 40C | 38D | 39.75 - 40.75 | 5 |
| | | 44B | 16 | 42C | 40D | 38DD | 40.75 - 42.75 | 5 |
| | 46B | 44C | 16 | 42D | 40DD | 38DDD | 42.5 - 43.5 | 5 |
| | 46C | 44D | 16 | 42DD | 40DDD | 38E | 43.5 - 44.5 | 5 |
| | 46D | 44DD | 16 | 42DDD | 40E | 38F | 44.5 - 45.5 | 5 |
| | 46DD | 44DDD | 16 | 42E | 40F | 38G | 45.5 - 46.5 | 5 |
| | 46DDD | 44E | 16 | 42F | 40G | 38H | 46.5 - 47.5 | 5 |
| | 46E | 44F | 16 | 42G | 40H | | 47.5 - 48.5 | 5 |
| New improve | | | | | | | | |

| | Under Band 1st adjmt | Base Size Swimsuit w/ Molded Cup Size 2nd adjmt | | Under Band 3rd adjmt | Under Band 4th adjmt | Under Band 5th adjmt | Apex Measurement on body | # of Adjustments |
|---|---|---|---|---|---|---|---|---|
| Under Bust Measurement on body | 42" to 44" | 40" to 42" | | 38" to 40" | 36" to 38" | 34" to 36" | | |
| | | | 18 | | 42C | 40D | 40.75 - 42.75 | 5 |
| | | | 18 | 44C | 42D | 40DD | 42.5 - 43.5 | 5 |
| | | 46C | 18 | 44D | 42DD | 40DDD | 43.5 - 44.5 | 5 |
| | 48C | 46D | 18 | 44DD | 42DDD | 40E | 44.5 - 45.5 | 5 |
| | 48D | 46DD | 18 | 44DDD | 42E | 40F | 45.5 - 46.5 | 5 |
| | 48DD | 46DDD | 18 | 44E | 42F | 40G | 46.5 - 47.5 | 5 |
| | 48DDD | 46E | 18 | 44F | 42G | 40H | 47.5 - 48.5 | 5 |
| | 48E | 46F | 18 | 44G | 42H | | 48.5 - 50.5 | 5 |
| New improve | | | | | | | | |

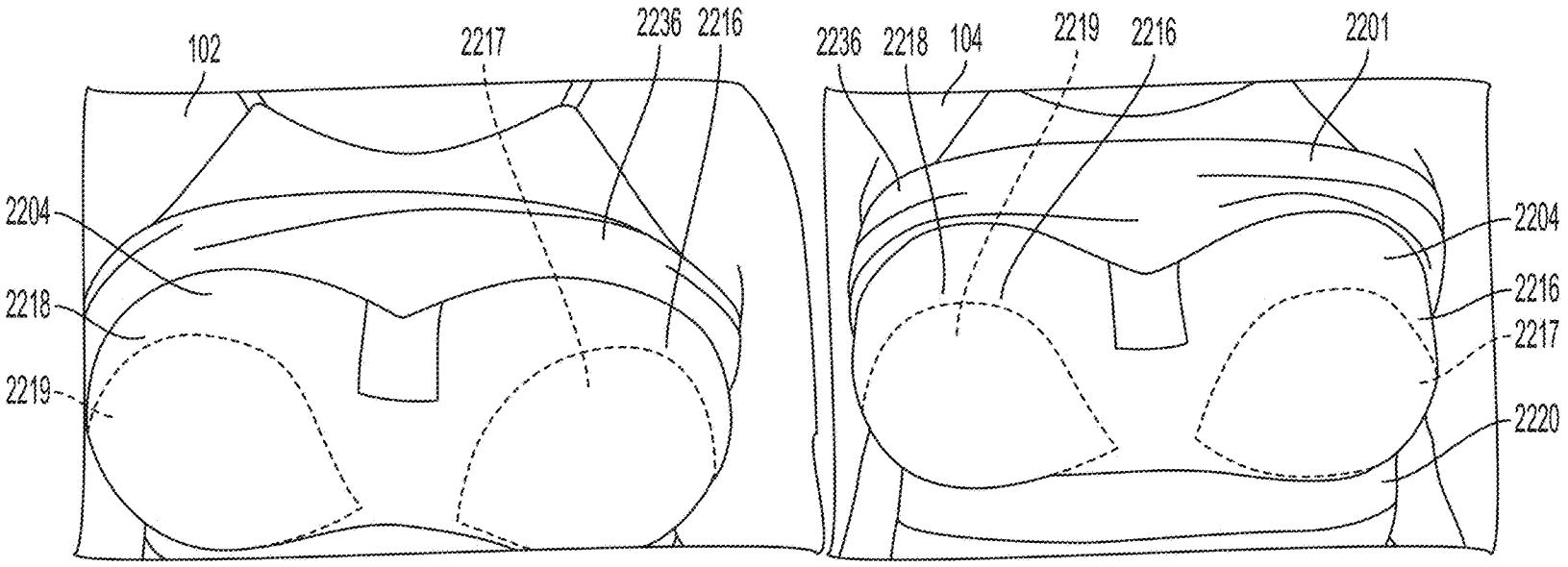
FIG. 27A
FIG. 27B
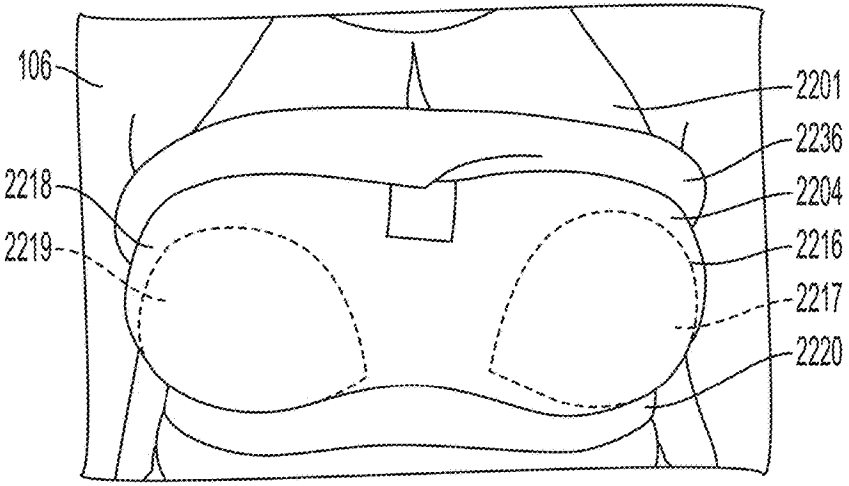
FIG. 27C

Table 2

| Model | | | | Garment | | | Garment | | | Garment | | | Garment | | | Garment | | |
|---|---|---|---|---|---|---|---|---|---|---|---|---|---|---|---|---|---|---|
| | | | | Flat | On Body | | Flat | On Body | | Flat | On Body | | Flat | On Body | | Flat | On Body | |
| 2706 | | | | UnderBand movement in width | | | Apex to Apex cup movement in width | | | Cup movement in diagonal | | | Cup movement in diagonal | | | Cup movement in height | | |
| Measurement of the models | | | Point of Measurements: | A - B | A - B | % change | C - D | C - D | % change | C - E | C - E | % change | D - E | D - E | % change | C - F | C - F | % change |
| 2704 | | | | | | | | | | | | | | | | | | |
| 2702 Underband 32" 2703 Apex 42" | Bra Size 34GG | Model 102 | | 5" | 5.375" | 7% | 9.125" | 10.25" | 11% | 5.125" | 5.625" | 10% | 5.125" | 5.4375" | 6% | 2.375" | 2.5" | 6% |
| 2705 Underband 33.75" Apex 42" | Bra Size 36C | Model 104 | | 5" | 5.5" | 10% | 9.125" | 9.75" | 7% | 5.125" | 5.5" | 7% | 5.125" | 5.5625" | 6% | 2.375" | 2.5" | 6% |
| 2707 Underband 34.5" Apex 42" | Bra Size 38DD | Model 106 | | 5" | 5.75" | 13% | 9.125" | 10.5" | 13% | 5.125" | 5.5" | 7% | 5.125" | 5.4375" | 6% | 2.375" | 2.5" | 6% |
| | | | | 2710 | 2712 | 2714 | 2716 | 2718 | 2720 | 2722 | 2724 | 2726 | 2728 | 2730 | 2732 | 2734 | 2736 | 2738 |

FIG. 27E

Table 2 (continued)

| Model | | | Garment | | | Garment | | | Garment | | | Garment | | |
|---|---|---|---|---|---|---|---|---|---|---|---|---|---|---|
| | | | Flat | On Body | | Flat | On Body | | Flat | On Body | | Flat | On Body | |
| | | | UnderBand movement in width | | | Apex to Apex cup movement in width | | | Cup movement in diagonal | | | Cup movement in diagonal | | |
| Measurement of the models | | | D - G | D - G | % change | C - H | C - H | % change | D - I | D - I | % change | J - E | J - E | % change |
| 2703 Underband 32" Apex 42" | Bra Size 34GG | Model 102 | 2.375" | 2.625" | 10% | 3.5" | 3.625" | 4% | 3.5" | 3.375" | 4% | 4.75" | 4.75" | 0% |
| 2705 Underband 33.75" Apex 42" | Bra Size 36C | Model 104 | 2.375" | 2.5" | 6% | 3.5" | 3.625" | 4% | 3.5" | 3.625" | 4% | 4.75" | 4.875" | 3% |
| 2707 Underband 34.5" Apex 42" | Bra Size 38DD | Model 106 | 2.375" | 2.75" | 16% | 3.5" | 3.5" | 0% | 3.5" | 3.625" | 4% | 4.75" | 4.75" | 0% |
| | | | 2740 | 2742 | 2744 | 2746 | 2748 | 2750 | 2752 | 2754 | 2756 | 2758 | 2760 | 2762 |

FIG. 27F

Table 2 (continued)

| Model | | | | Garment | | | Garment | | |
|---|---|---|---|---|---|---|---|---|---|
| | | | | Flat | On Body | | Flat | On Body | |
| | | | | Apex to Center movement in width | | | Apex to Center movement in width | | |
| Measurment of the models | | | Point of Measurements: | C - K | C - K | % change | D - K | D - K | % change |
| Underband 32" Apex 42" | Bra Size: 34GG | Model 102 | | 4.625" | 5.375" | 14% | 4.625" | 5..3125" | 13% |
| Underband 33.75" Apex 42" | Bra Size: 36C | Model 104 | | 4.625" | 5.25" | 12% | 4.625" | 5.25" | 12% |
| Underband 34.5" Apex 43.5" | Bra Size: 38DD | Model 106 | | 4.625" | 5.375" | 14% | 4.625" | 5.375" | 14% |
| 2703 | | | | 2764 | 2766 | 2768 | 2770 | 2772 | 2774 |
| 2705 | | | | | | | | | |
| 2707 | | | | | | | | | |

FIG. 27G

Table 2

| Model | | | | Garment | | | Garment | | | Garment | | | Garment | | |
|---|---|---|---|---|---|---|---|---|---|---|---|---|---|---|---|
| | | | | Flat | On Body | | Flat | On Body | | Flat | On Body | | Flat | On Body | |
| 3006 | | | | UnderBand movement in width | | | Apex to Apex cup movement in width | | | Cup movement in diagonal | | | Cup movement in diagonal | | |
| Measurement of the models | | | Point of Measure-ments: | A - B | A - B | % change | C - D | C - D | % change | C - E | C - E | % change | D - E | D - E | % change |
| 3004 | | | | | | | | | | | | | | | |
| 3002 Underband 32" 3003 Apex 42" | Bra Size 34GG | Model 102 | | 5" | 5.7" | 14% | 8" | 8.5" | 6% | 4.5625" | 4.6875" | 3% | 4.5625" | 4.6875" | 3% |
| 3005 Underband 33.75" Apex 42" | Bra Size 36C | Model 104 | | 5" | 5.8" | 16% | 8" | 8.375" | 5% | 4.5625" | 4.5625 | 0% | 4.5625" | 4.6875" | 3% |
| 3007 Underband 34.5" Apex 42" | Bra Size 38DD | Model 106 | | 5" | 6.125" | 19% | 8" | 8.625" | 7% | 4.5625" | 4.6875" | 3% | 4.5625" | 4.8125" | 5% |
| | | | | 3010 | 3012 | 3014 | 3016 | 3018 | 3020 | 3022 | 3024 | 3026 | 3028 | 3030 | 3032 |

FIG. 27H

Table 3 (continued)

| Model | | | | Garment | | | Garment | | | Garment | | | Garment | | |
|---|---|---|---|---|---|---|---|---|---|---|---|---|---|---|---|
| | | | | Flat | On Body | | Flat | On Body | | Flat | On Body | | Flat | On Body | |
| | | | | UnderBand movement in width | | | Apex to Apex cup movement in width | | | Cup movement in diagonal | | | Cup movement in diagonal | | |
| Measurement of the models | | | Point of Measure-ments: | C - F | C - F | % change | D - G | D - G | % change | C - H | C - H | % change | D - I | D - I | % change |
| 3003 Underband 32" Apex 42" | Bra Size 34GG | Model 102 | | 2.25" | 2.5" | 10% | 2.25" | 2.5" | 10% | 3.0625" | 3.3125" | 8% | 3.0625" | 3.1875" | 4% |
| 3005 Underband 33.75" Apex 42" | Bra Size 36C | Model 104 | | 2.25" | 2.375" | 6% | 2.25" | 2.25" | 0% | 3.0625" | 3.25" | 6% | 3.0625" | 3.125" | 2% |
| 3007 Underband 34.5" Apex 42" | Bra Size 38DD | Model 106 | | 2.25" | 2.25" | 0% | 2.25" | 2.5" | 10% | 3.0625" | 3.0625" | 0% | 3.0625" | 3.3125" | 8% |
| | | | | 3034 | 3036 | 3038 | 3040 | 3042 | 3044 | 3046 | 3048 | 3050 | 3052 | 3054 | 3056 |

FIG. 27I

Table 3 (continued)

| Model | | | Garment | | | Garment | | | Garment | | |
|---|---|---|---|---|---|---|---|---|---|---|---|
| | | | Flat | On Body | | Flat | On Body | | Flat | On Body | |
| | | | UnderBand movement in width | | | Apex to Apex cup movement in width | | | Cup movement in diagonal | | |
| Measurement of the models | | | J - E | J - E | % change | C - K | C - H | % change | D - K | D - K | % change |
| 3003 Underband 32" Apex 42" | Bra Size 34GG | Model 102 | 4.625" | 4.75" | 3% | 4" | 4.5" | 12% | 4" | 4.5" | 12% |
| 3005 Underband 33.75" Apex 42" | Bra Size 36C | Model 104 | 4.625" | 4.625" | 0% | 4" | 4.375" | 9% | 4" | 4.375" | 9% |
| 3007 Underband 34.5" Apex 42" | Bra Size 38DD | Model 106 | 4.625" | 4.75" | 3% | 4" | 4.5" | 12% | 4" | 4.5" | 12% |
| | | | 3058 | 3060 | 3062 | 3064 | 3066 | 3068 | 3070 | 3072 | 3074 |

FIG. 27J

Multi Bra Cup Size Garment/SPECS

| Wearers' Bra Cup Sizes | | | | | | | | | | | Wearers' Under Bust Circumference range | 1st & 2nd Cup Insert Size range | 1st & 2nd Cup Insert Spec range | Spec: Bubble Molding and Shaped Bubble Molding Fabric ranges | | Finished Under Bra Elastic (Band) Measurement range | Width of Elastic(Band) range |
|---|---|---|---|---|---|---|---|---|---|---|---|---|---|---|---|---|---|
| AA | A | B | C | D | DD | DDD | E | F | **G | **H | inch | Size to Size | Depth cm | Circumference cm +/- 17% | Depth cm | inch | mm |
| x | x | x | x | x | x | x | x | | | | 18 to 28 | 00 to 6 | 0.5 to 25 | 7.5 to 13.5 | 0.5 to 17 | 16 to 28 | 12 to 62 |
| | x | x | x | x | x | x | x | x | | | 20 to30 | 2 to 10 | 0.5 to 25 | 8 to 14 | 0.5 to 17 | 18 to 30 | 12 to 62 |
| | | x | x | x | x | x | x | x | x | | 22 to 32 | 4 to 12 | 0.5 to 25 | 8.5 to 14.5 | 0.5 to 17 | 20 to 32 | 12 to 62 |
| | | x | x | x | x | x | x | x | x | | 24 to 34 | 6 to 14 | 0.5 to 25 | 9 to 15 | 0.5 to 17 | 22 to 34 | 12 to 62 |
| | | x | x | x | x | x | x | x | x | x | 26 to 36 | 8 to 16 | 0.5 to 25 | 9.5 to 16.5 | 0.5 to 17 | 24 to 36 | 12 to 62 |
| | | x | x | x | x | x | x | x | x | x | 28 to 38 | 10 to 18 | 0.5 to 25 | 10 to 17 | 0.5 to 17 | 26 to 38 | 12 to 62 |
| | | x | x | x | x | x | x | x | x | x | 30 to 40 | 12 to 20 | 0.5 to 25 | 10.5 to 18.5 | 0.5 to 17 | 28 to 40 | 12 to 62 |
| | | | x | x | x | x | x | x | x | x | 32 to 42 | 14 to 22 | 0.5 to 25 | 11 to 19 | 0.5 to 17 | 30 to 42 | 12 to 62 |
| | | | x | x | x | x | x | x | x | x | 34 to 44 | 16 to 24 | 0.5 to 25 | 11.5 to 19.5 | 0.5 to 17 | 32 to 44 | 12 to 62 |
| | | | x | x | x | x | x | x | x | x | 36 to 46 | 18 to 26 | 0.5 to 25 | 12 to 20 | 0.5 to 17 | 34 to 46 | 12 to 62 |
| | | | | | | | | | | | | | | | | | |
| | | | | | | | | | | | | | | | | | |
| | | | | | | | | | | | | | | | | | |
| Plus Size | | x | x | x | x | x | x | x | x | x | 38 to 44 | 14 to 22 | 0.5 to 25 | 11 to 19 | 0.5 to 17 | 32 to 44 | 12 to 62 |
| | | x | x | x | x | x | x | x | x | x | 40 to 46 | 16 to 24 | 0.5 to 25 | 11.5 to 19.5 | 0.5 to 17 | 34 to 46 | 12 to 62 |
| | | x | x | x | x | x | x | x | x | x | 42 to 48 | 18 to 26 | 0.5 to 25 | 12 to 20 | 0.5 to 17 | 36 to 48 | 12 to 62 |
| | | x | x | x | x | x | x | x | x | x | 44 to 50 | 20 to 28 | 0.5 to 25 | 12.5 to 20.5 | 0.5 to 17 | 38 to 50 | 12 to 62 |
| | | x | x | x | x | x | x | x | x | x | 46 to52 | 22 to 30 | 0.5 to 25 | 13 to 21 | 0.5 to 17 | 40 to 52 | 12 to 62 |
| | | x | x | x | x | x | x | x | x | x | 48 to 54 | 24 to 32 | 0.5 to 25 | 13.5 to 21.5 | 0.5 to 17 | 42 to 54 | 12 to 62 |
| | | | x | x | x | x | x | x | x | x | 50 to 56 | 26 to 34 | 0.5 to 25 | 14 to 22 | 0.5 to 17 | 44 to 56 | 12 to 62 |
| | | | | x | x | x | x | x | x | x | 52 to 58 | 28 to 36 | 0.5 to 25 | 14.5 to 22.5 | 0.5 to 17 | 46 to 58 | 12 to 62 |
| | | | | | x | x | x | x | x | x | 54 to 60 | 30 to 38 | 0.5 to 25 | 15 to 23 | 0.5 to 17 | 48 to 60 | 12 to 62 |

FIG.28

ASTM 4964 Loop Test - lbs

Number of conditioning cycles : 2
Speed in the conditioning cycle : 30 in/min
Test Cycle Speed : 20 in/min
Elongation : 20 lbf
Mod Values : 1:30, 2:50, 3:70

Test results:

| Legend | No. | 20 lbf | Direction | Stretch % | F (30%)$_{Fapply}$ lbf | F (50%)$_{Fapply}$ lbf | F (70%)$_{Fapply}$ lbf | Recovery % |
|---|---|---|---|---|---|---|---|---|
| | 1 | 20.2 | Length | 97.82 | 5.37 | 7.72 | 10.81 | 94.3 |
| | ⇒ 2 | 20.2 | Length | 171.93 | 1.97 | 2.76 | 3.42 | 91.3 |

Series graph:

ASTM 4964 Loop Test - lbs

Number of conditioning cycles : 2
Speed in the conditioning cycle : 30 in/min
Test Cycle Speed : 20 in/min
Elongation : 20 lbf
Mod Values : 1:30, 2:50, 3:70

Test results:

| Legend | No. | 20 lbf | Direction | Stretch % | F (30%)$_{Fapply}$ lbf | F (50%)$_{Fapply}$ lbf | F (70%)$_{Fapply}$ lbf | Recovery % |
|---|---|---|---|---|---|---|---|---|
| | 1 | 20.2 | Length | 90.00 | 6.43 | 9.30 | 13.12 | 94.3 |
| | ⇒ 2 | 20.2 | Length | 149.96 | 2.58 | 3.58 | 4.49 | 90.5 |

Series graph:

BRA ASSEMBLY TO PROVIDE PROPER FIT FOR MULTIPLE SIZED WEARERS

This application is a continuation of U.S. application Ser. No. 16/654,231 filed Oct. 16, 2019, which claims the benefit of U.S. Provisional Application No. 62/746,214, filed Oct. 16, 2018. The contents of U.S. application Ser. No. 16/654,231 filed Oct. 16, 2019 and U.S. Provisional Application No. 62/746,214, filed Oct. 16, 2018, are hereby incorporated by reference herein in their entirety.

BACKGROUND OF THE DISCLOSURE

1. Field of the Disclosure

The present disclosure relates to a brassiere ("bra") assembly. More particularly, the present disclosure relates to a bra assembly that enables wearers of different bra sizes to comfortably fit into the same sized bra assembly.

2. Description of Related Art

Referring to FIGS. 1 and 2, there is shown three different women having three different cup sizes and three different underband sizes, all wearing the same size 8 swim top 100 incorporating a conventional bra 300 (FIGS. 3A-C4) on an inside of swim top 100. As shown in FIGS. 1A-2C, different sized women cannot adequately fit into the same size 8 swim top 100 using the conventional bra. A first wearer 102, shown in FIGS. 1A-8C, is a size 12, 34GG cup, 34 underband. A second wearer 104 is a size 8, 36C cup, 36 underband. A third wearer 106 is a size 14, 38DD cup, 38 underband. The breast tissue of first wearer 102 and third wearer 106 is uncovered and protrudes out of the front and sides of an exterior fabric layer 108 of swim top 100 improperly fitting first wearer 102 and third wearer 106. However, the swim top 100 properly fits second wearer 104.

Referring to FIGS. 3A-4C, the interior of swim top 100 shows a conventional bra 300 (once exterior fabric layer 108 of swim top 100 is lifted up). More breast tissue of first wearer 102 and third wearer 106 is uncovered and protrudes from the front and sides of conventional bra 300, than the properly fitted second wearer 104. Thus, the more exposed breast tissue of first wearer 102 and third wearer 106 clearly results in improper fitting.

Referring to FIGS. 5A-5C and 6A-6C, first wearer 102, second wearer 104 and third wearer 106 are all wearing the same swim top 500 that is a size 8. Swim top 500 is a different style than swim top 100 shown in FIGS. 1A-4C. Swim top 500 has a conventional bra 700 (FIGS. 7A-8C). As shown in FIGS. 5A-6C, different sized women cannot fit into this same size 8 swim top 500 of this style using the conventional bra. The breast tissue of first wearer 102 and third wearer 106 is uncovered and protrudes from the sides of exterior fabric layer 508 of swim top 500, again improperly fitting first wearer 102 and third wearer 106. Again, the swim top 500 properly fits second wearer 104.

Referring to FIGS. 7A-8C, exterior fabric layer 508 of swim top 500 of FIGS. 5A-6C is lifted to uncover conventional bra 700. Much more breast tissue of first wearer 102 and third wearer 106 is uncovered and protrudes out of the sides of conventional bra 700 thereby also providing an improper fit for first wearer 102 and third wearer 106. Whereas, this conventional bra 700 properly fits second wearer 104.

As shown in the representative prior art discussed above, when an attempt has been made to fit three different breast sized wearers into one bra size, clearly the bra size works for, at best, one wearer and not the other two wearers since more than desired breast tissue is exposed in a manner that is unsupportive, uncomfortable, ill fitting, and/or unattractive.

Accordingly, it has been determined by the present disclosure, there is a need for a bra assembly that enables many different bra sizes to comfortable fit into the same bra sized garment.

SUMMARY

The present disclosure provides a new bra assembly that allows for a supportive and comfortable fit of two or more bra sized, preferably three or more sized, wearers in a single bra or bra incorporated into a garment.

The present disclosure also provides a new bra assembly that allows for fashionable, as well as a supportive and comfortable, fit of two or more bra sized wearers in a single bra or bra incorporated into the garment that is, for example, a dress, a swim top, a one-piece swimsuit, a tank top, a t-shirt, an athletic-wear top, a long-sleeve shirt, a sleep top, lingerie, camisole, or any other garment that can incorporate a bra.

The present disclosure further provides for a bra assembly that enables two or more different bra sized wearers to comfortably wear the same single bra or bra garment due to the coordination amongst and the configuration of cup assemblies or structure therein, which the configuration allows separation between cup assemblies, and an underband of the bra assembly or garment incorporated into the bra assembly.

The above-described and other advantages and features of the present disclosure will be appreciated and understood by those skilled in the art from the following detailed description, drawings, and appended claims.

BRIEF DESCRIPTION OF THE DRAWINGS

FIGS. 18C-E are Table 1 that includes measurements taken for the bra assembly of FIG. 10 referencing the points of measurement of FIGS. 18A-B.

FIG. 27A is an enlarged front view of the first wearer wearing the swim top shown with the exterior fabric layer lifted to uncover the second embodiment of the bra assembly of FIG. 22.

FIG. 27B is an enlarged front view of the second wearer wearing the swim top shown with the exterior fabric layer lifted to uncover the second embodiment of the bra assembly of FIG. 22.

FIG. 27C is an enlarged front view of the third wearer wearing the swim top shown with the exterior fabric layer lifted to uncover the second embodiment of the bra assembly of FIG. 22.

FIGS. 27E-G are Table 2 that includes measurements taken for the bra assembly of FIG. 22 having a band of material that is stretchable referencing the points of measurement of FIG. 27D.

FIGS. 27H-J are Table 3 that includes measurements taken for the bra assembly of FIG. 22 with a band that has a first modulus of elasticity at the first size and a second modulus of elasticity at the second size that are approximately, but not exactly, the same referencing the points of measurement of FIG. 27D.

FIG. 28 is a table including a wearer cup size, a wearer under bust size, a first cup insert and a second cup insert size, the first cup insert and the second cup insert depth, bubble molding and shaped bubble molding fabric, band measurement and width of band of the bra assembly of the first and second embodiments the present disclosure.

DETAILED DESCRIPTION OF THE DISCLOSURE

Figure 1C:
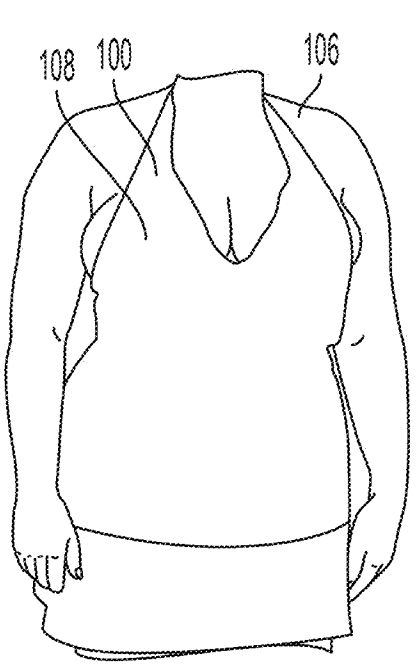
FIG. 1C PRIOR ART
FIGS. 1A-1C are front views of three different women having three different cup sizes and three different underband sizes all wearing the same size 8 swim top having a conventional bra.
Figure 1B:
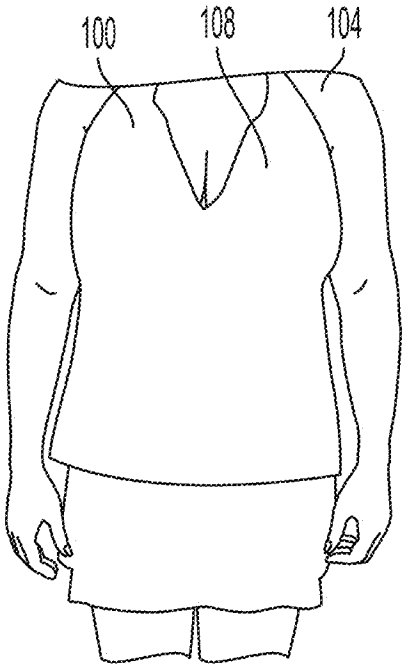
FIG. 1B PRIOR ART
Figure 1A:
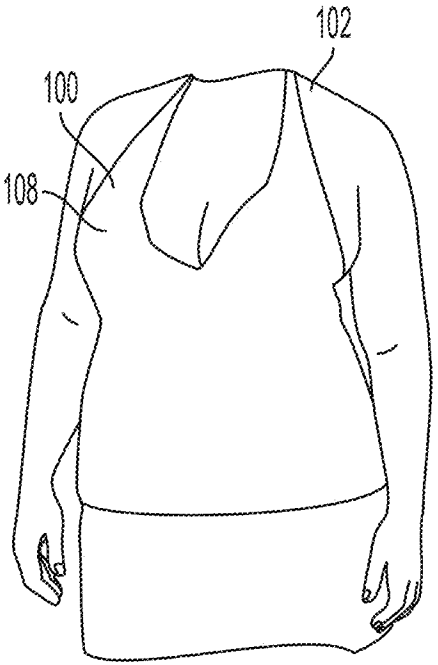
FIG. 1A PRIOR ART
Figure 2C:
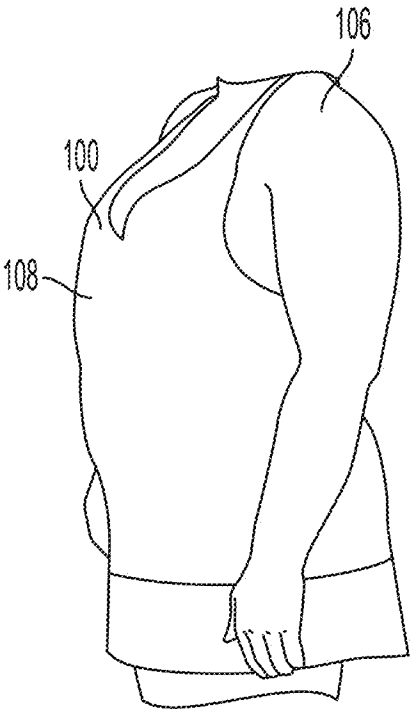
FIG. 2C PRIOR ART
FIGS. 2A-2C are front views of the three women that have turned to the side wearing the swim top of FIGS. 1A-1C.
Figure 2B:
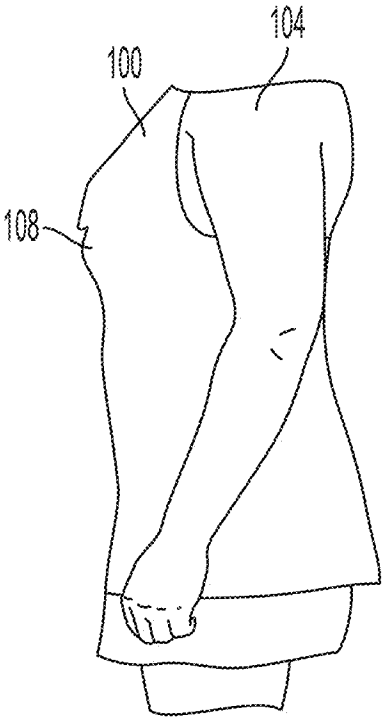
FIG. 2B PRIOR ART
Figure 2A:
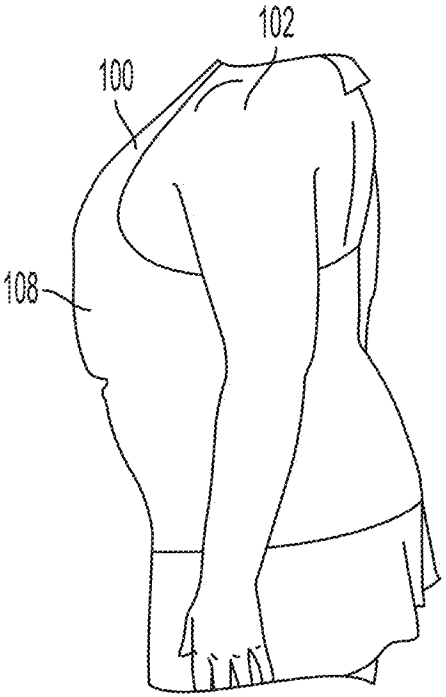
FIG. 2A PRIOR ART
Figure 3A:
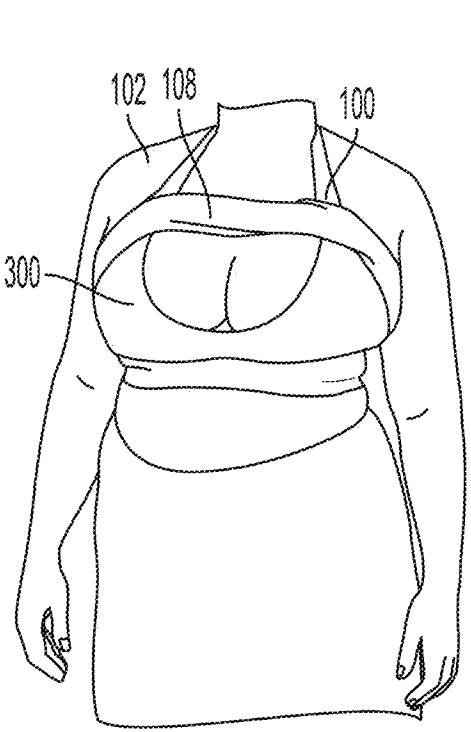
FIG. 3A PRIOR ART
FIGS. 3A-3C are front views of the three women each wearing the swim top of FIGS. 1A-1C shown with an exterior fabric layer lifted uncovering the conventional bra.
Figure 3B:
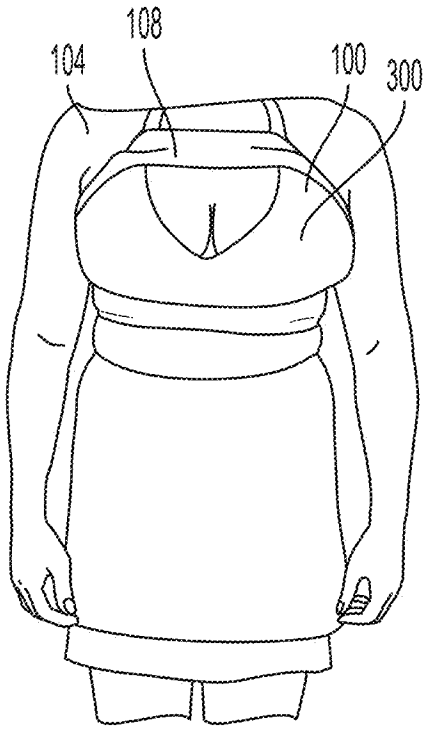
FIG. 3B PRIOR ART
Figure 3C:
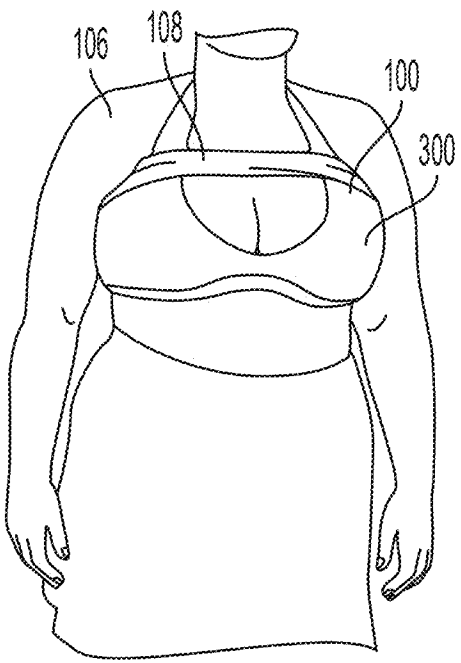
FIG. 3C PRIOR ART
Figure 4A:
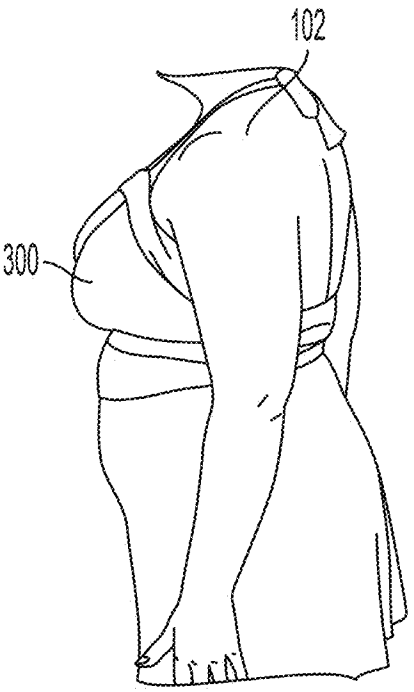
FIG. 4A PRIOR ART
FIGS. 4A-4C are front views of the three women that have turned to the side wearing the swim top of FIGS. 1A-1C shown with the exterior fabric layer lifted uncovering the conventional bra.
Figure 4B:
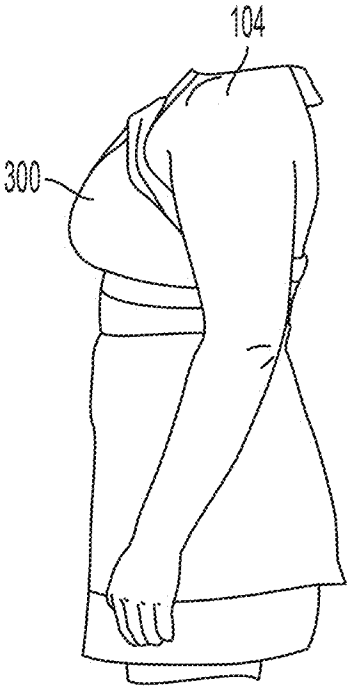
FIG. 4B PRIOR ART
Figure 4C:
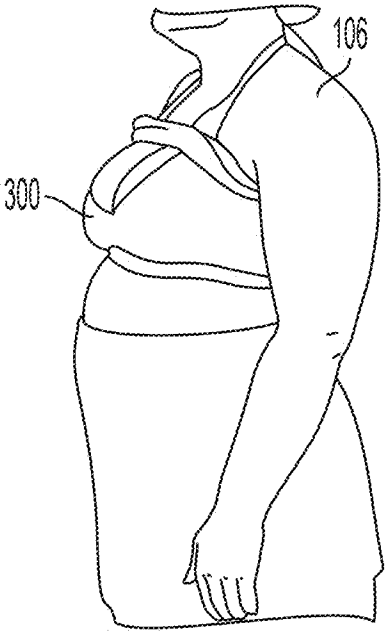
FIG. 4C PRIOR ART
Figures 5A, 5B, 5C:
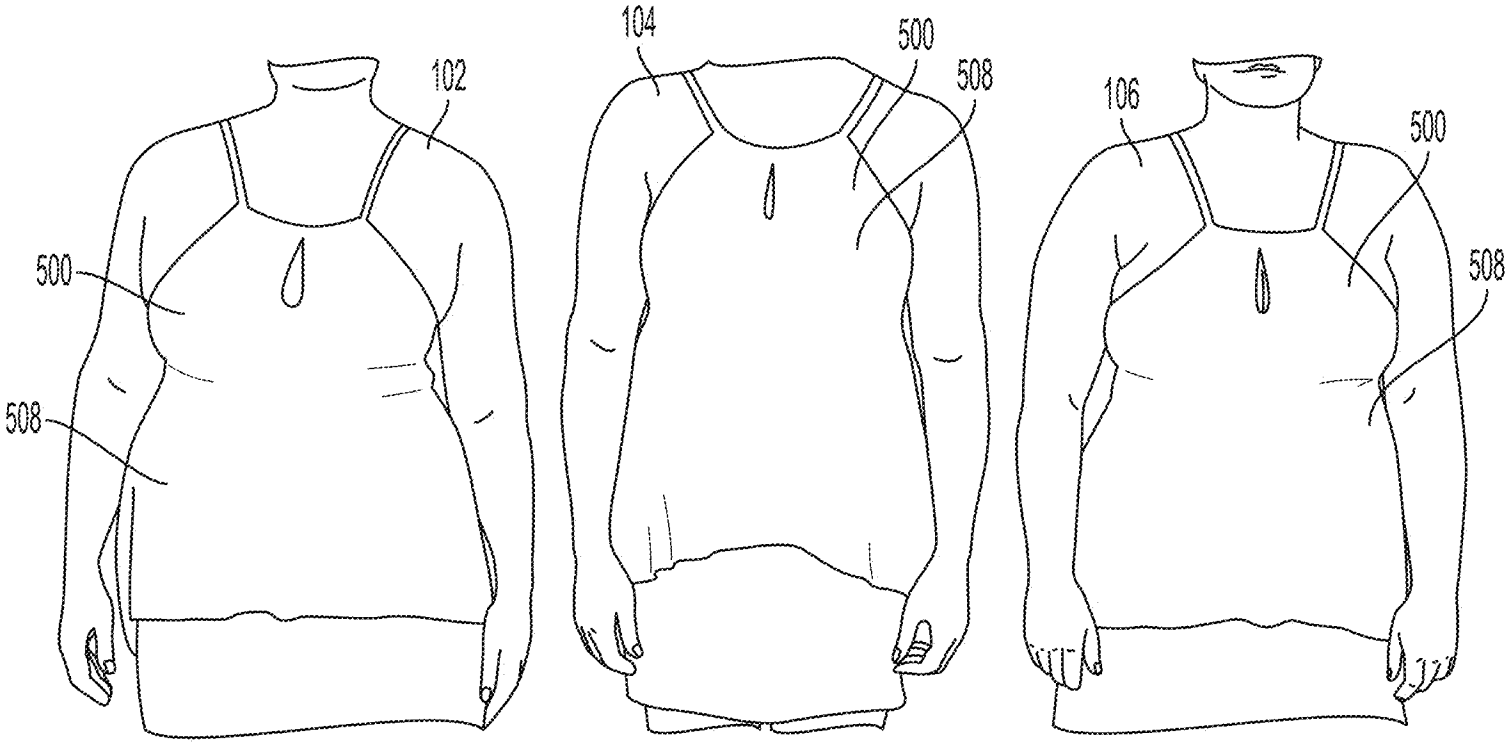
FIG. 5A PRIOR ART
FIG. 5B PRIOR ART
FIG. 5C PRIOR ART
FIGS. 5A-5C are front views of the three women all wearing the same swim top that has a conventional bra and that is different than the swim top of FIGS. 1A-1C.
Figure 6A:
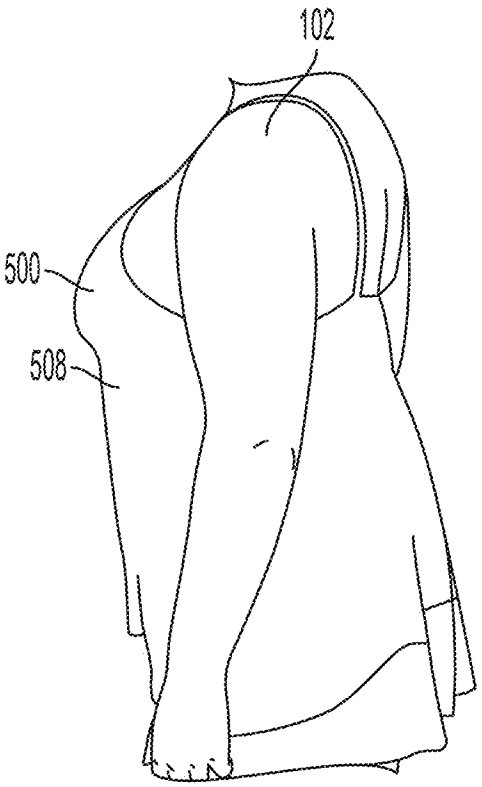
FIG. 6A PRIOR ART
FIGS. 6A-6C are front views of the three women that have turned to the side wearing the swim top of FIGS. 5A-5C.
Figure 6B:
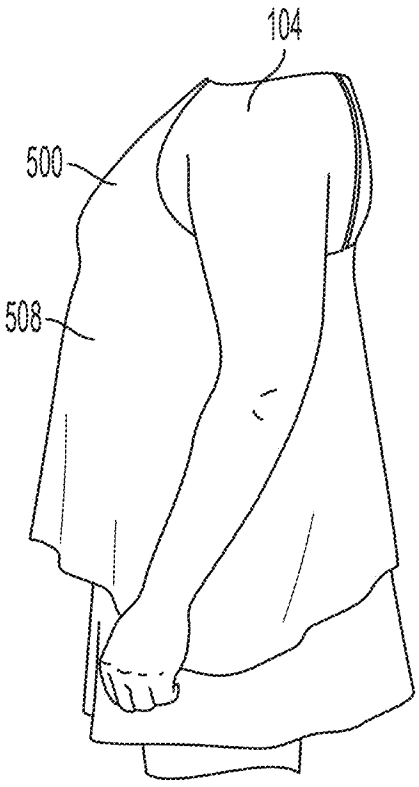
FIG. 6B PRIOR ART
Figure 6C:
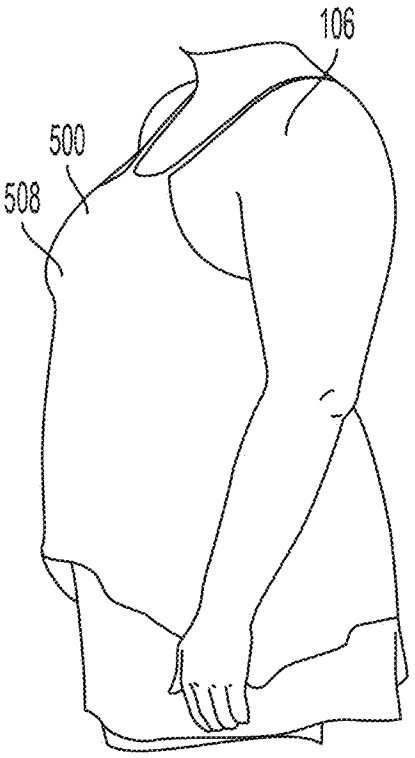
FIG. 6C PRIOR ART
Figures 7A, 7B, 7C:
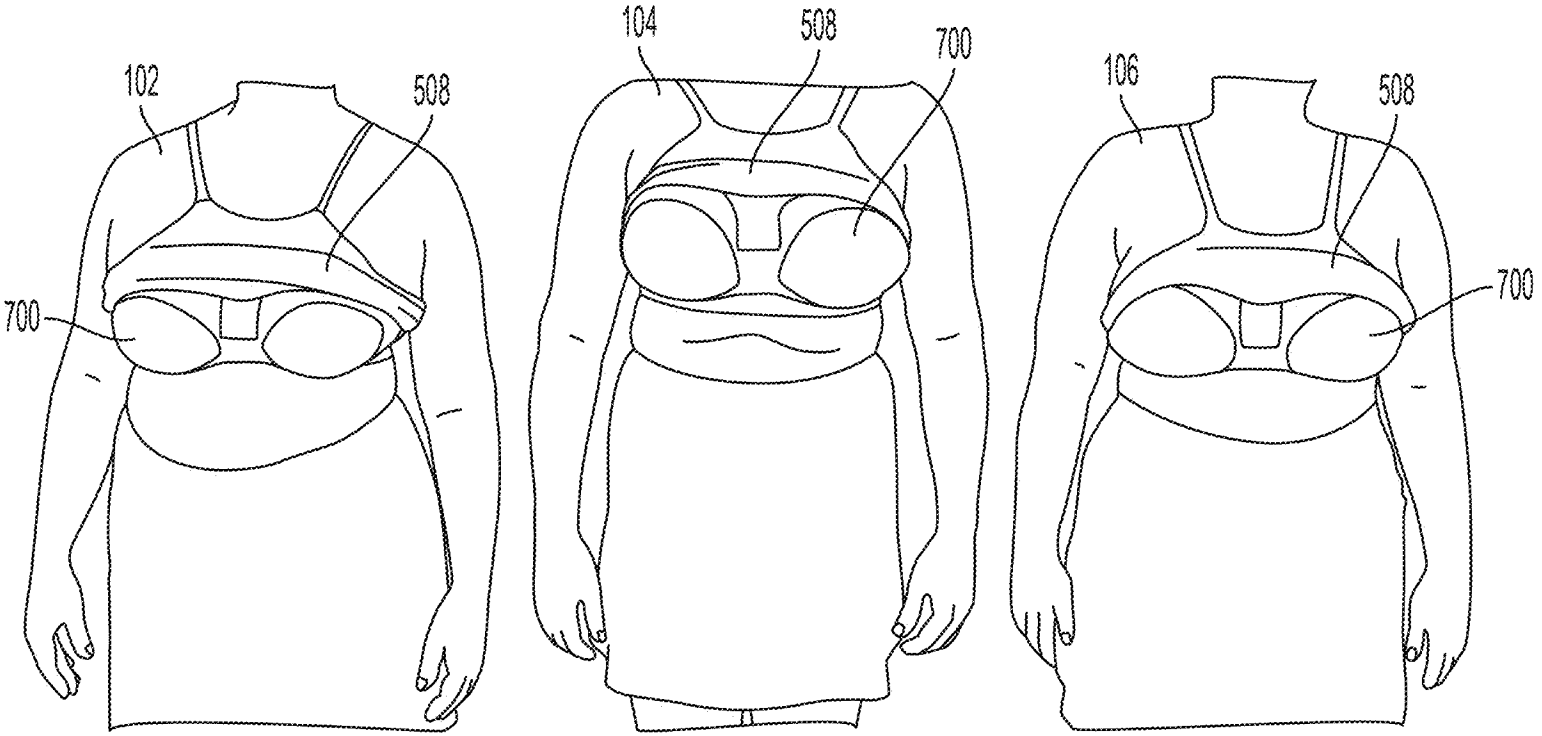
FIG. 7C PRIOR ART
FIG. 7B PRIOR ART
FIG. 7A PRIOR ART
FIGS. 7A-7C are front views of the swim top of FIGS. 5A-5C shown with an exterior fabric layer lifted uncovering the conventional bra.
Figure 8C:
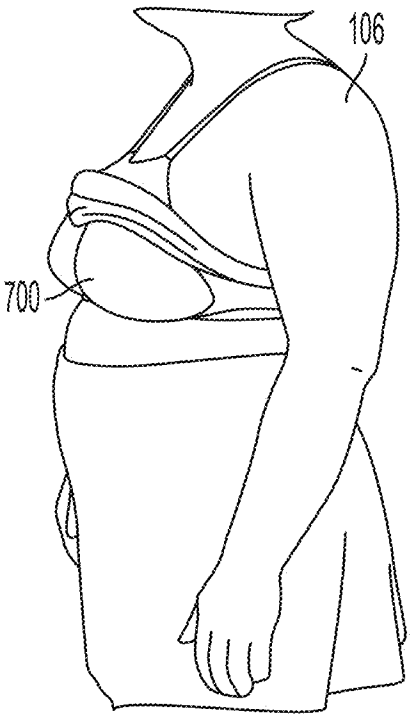
FIG. 8C PRIOR ART
FIGS. 8A-8C are front views of the three women that have turned to the side wearing the swim top of FIGS. 5A-5C shown with the exterior fabric layer lifted uncovering the conventional bra.
Figure 8B:
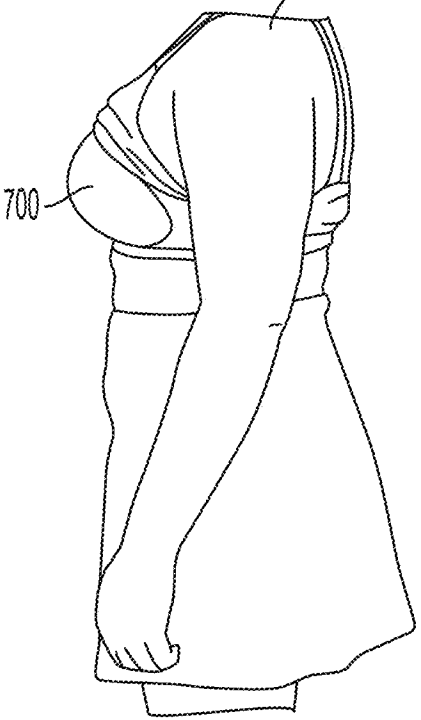
FIG. 8B PRIOR ART
Figure 8A:
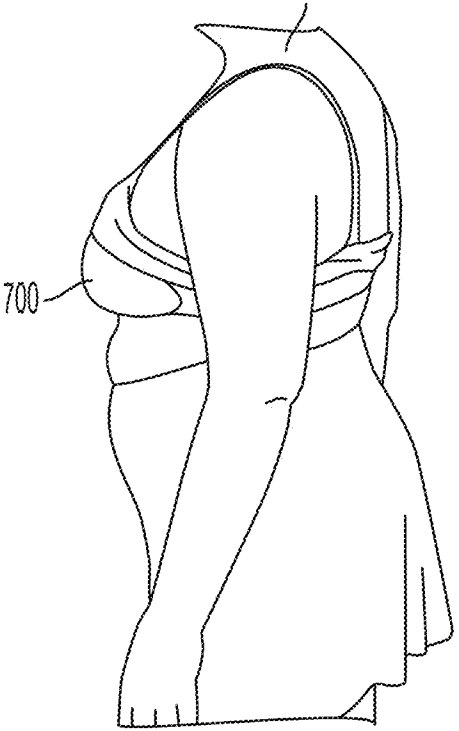
FIG. 8A PRIOR ART
Figure 9:
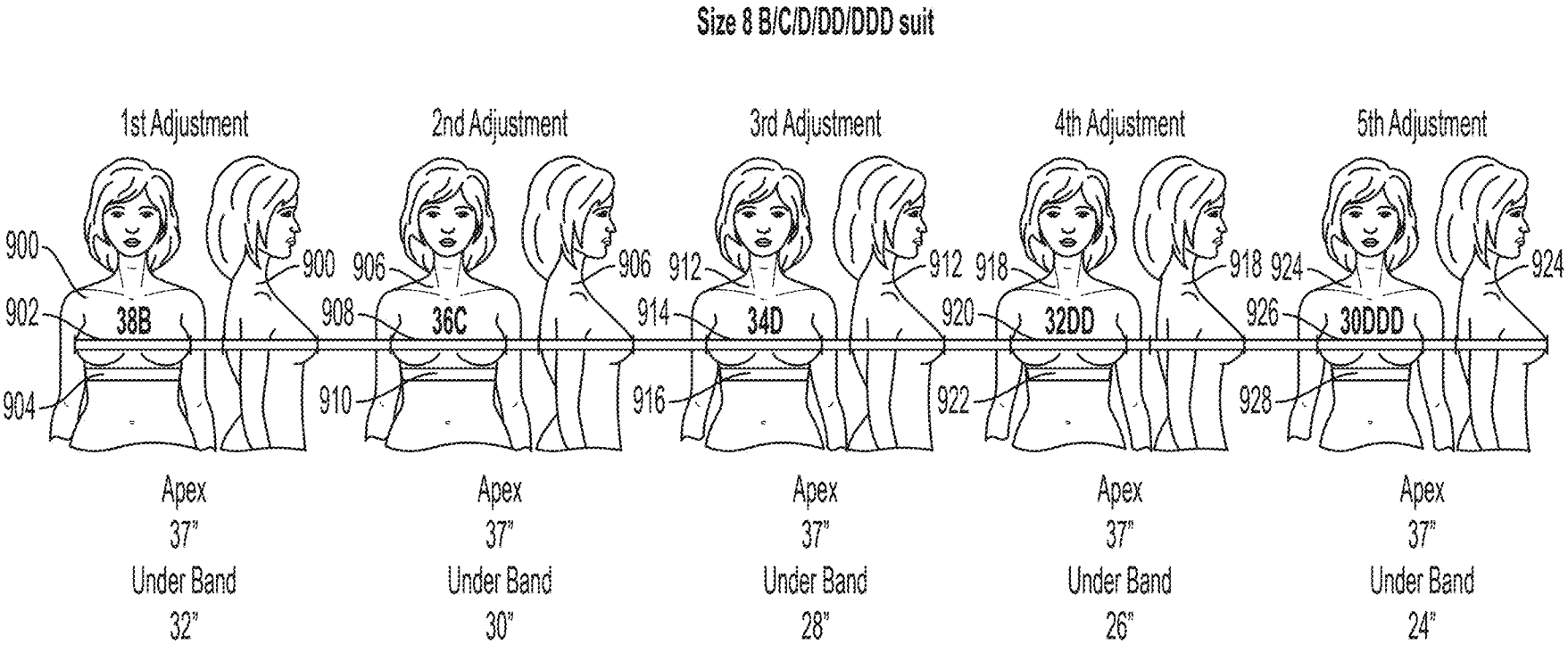
FIG. 9 is a schematic representation of women having different cup sizes and different under band sizes that each fit a single bra assembly of the present disclosure.

Referring to the drawings and in particular to FIG. 9, a schematic representation of women is shown each having different cup sizes and different under band sizes that fit a bra assembly of the present disclosure. The bra assembly of the present disclosure enables women 900, 906, 912, 918 and 924, each having different bust sizes, as well as different underband sizes, to comfortable fit into the same sized garment. Woman 900 is a 38B cup and has a measurement 902 from an apex of the breasts around the body of 37 inches and an underband measurement 904 of 32 inches. Woman 906 is a 36C cup and has a measurement 908 from an apex of the breasts around the body of 37 inches and an underband measurement 910 of 30 inches. Woman 912 is a 34D cup and has a measurement 914 from an apex of the breasts around the body of 37 inches and an underband measurement 916 of 28 inches. Woman 918 is a 32DD cup and has a measurement 920 from an apex of the breasts around the body of 37 inches and an underband measurement 922 of 26 inches. Woman 924 is a 30DDD cup and has a measurement 926 from an apex of the breasts around the body of 37 inches and an underband measurement 928 of 24 inches.

As used herein, comfortable fit means pleasing to the wearer and clearly not an ill-fitting fit. A comfortable fit can include a supportive fit and can also denote an attractive appearance. An attractive appearance means that exposure of the wearer is considered appropriately modest to the wearer and clearly means no side bulges.

Figure 10:
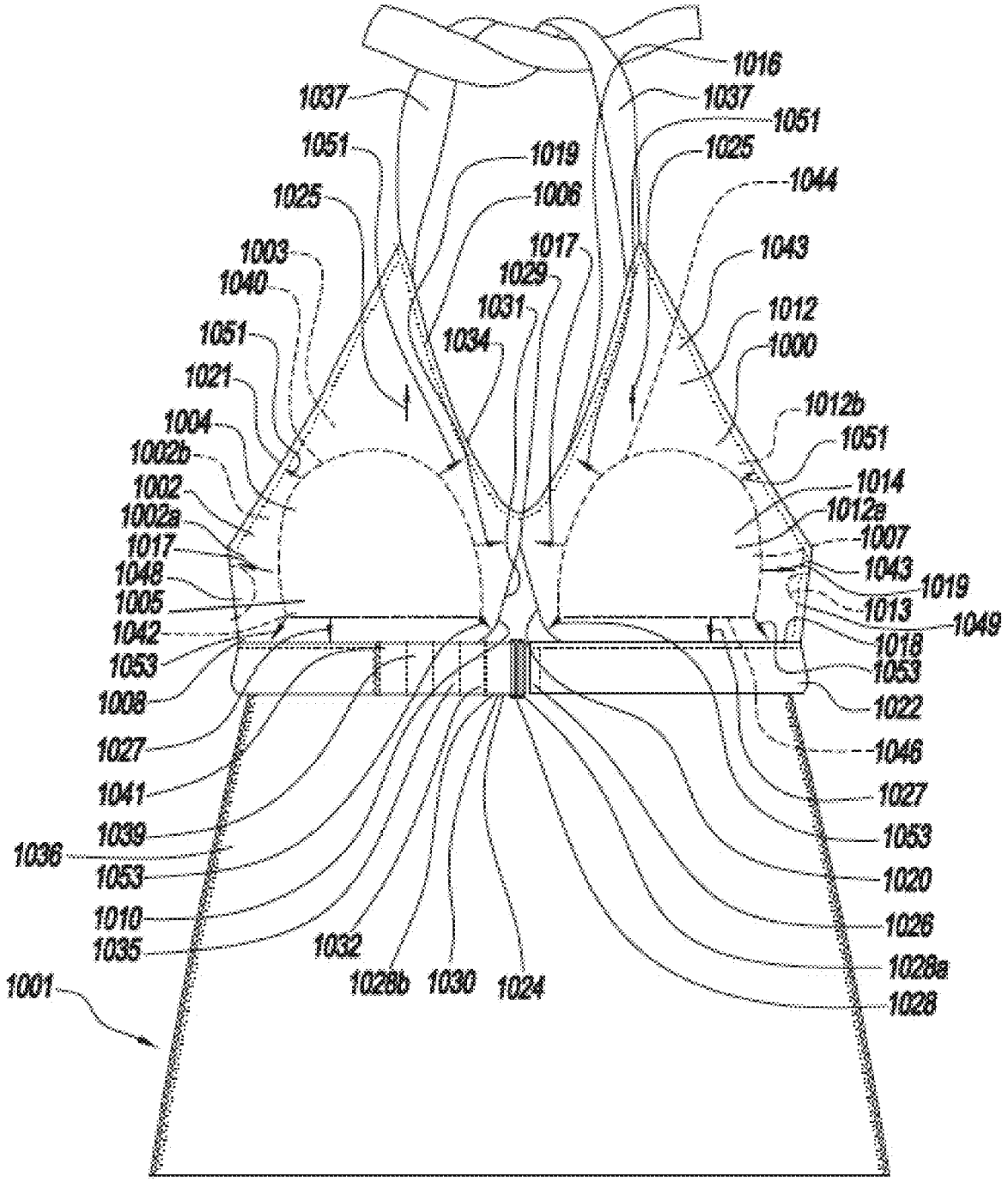
FIG. 10 is a front view of a first embodiment of a bra assembly of the present disclosure with a swim top that is inside out.
Figure 11:
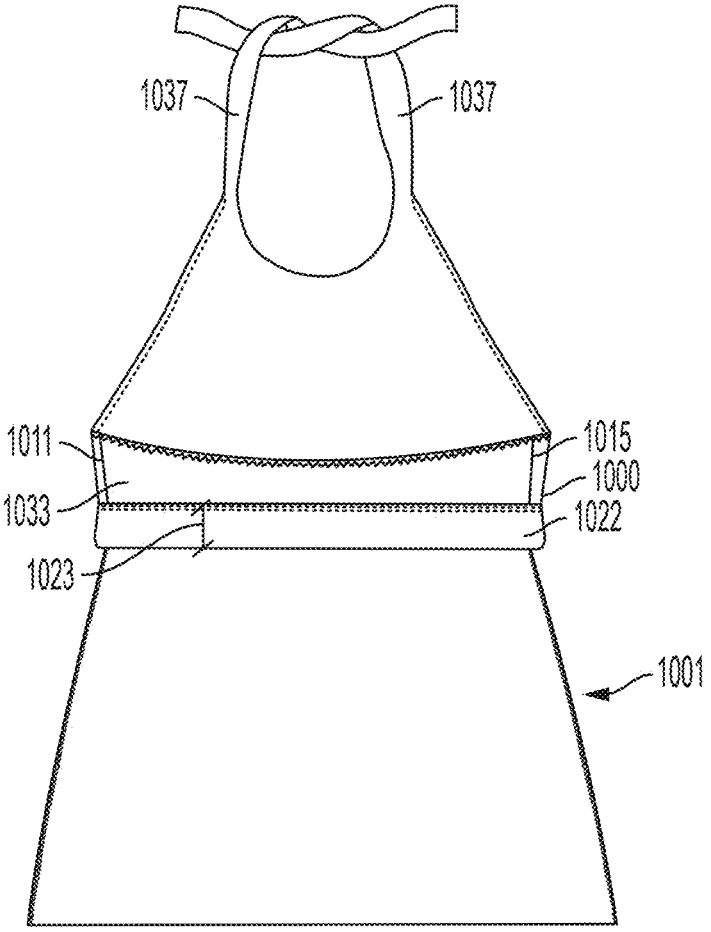
FIG. 11 is a rear view of the swim top of FIG. 10 that is inside out.
Figure 12:
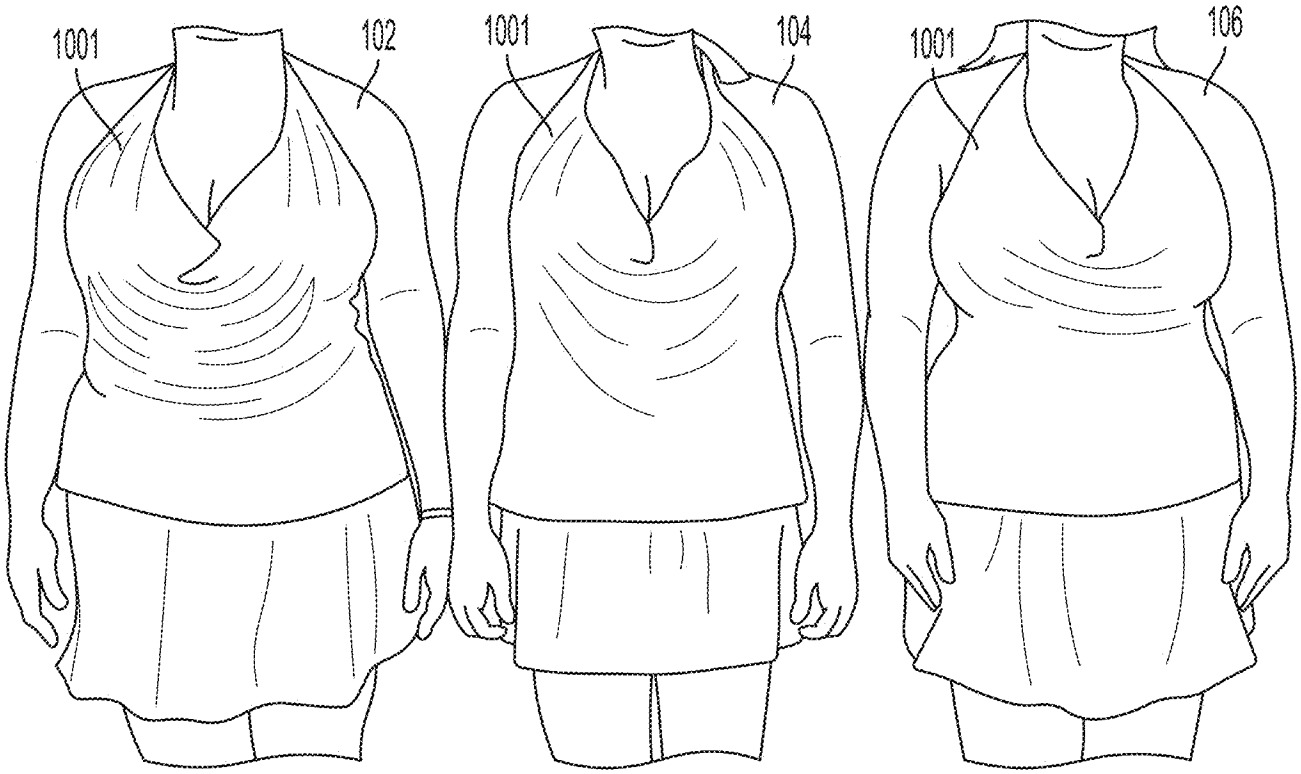
FIG. 12 is a front view of a first wearer, a second wearer and a third wearer each having three different cup sizes and three different underband sizes and all wearing the same size 8 swim top having the first embodiment of the bra assembly of FIG. 10.
Figure 13A:
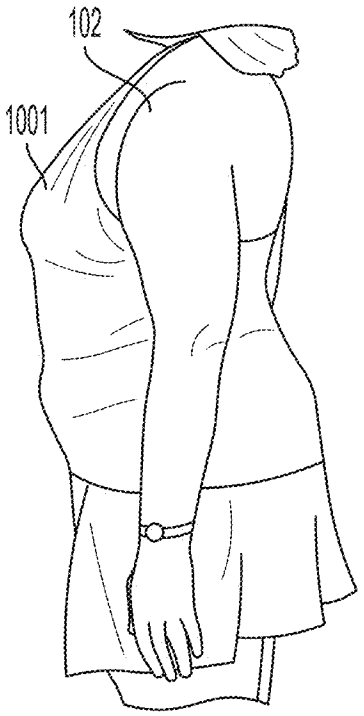
FIGS. 13A-13C are front views of the first wearer, the second wearer and the third wearer that have turned to the side wearing the swim top having the first embodiment of the bra assembly of FIG. 10.
Figure 13B:
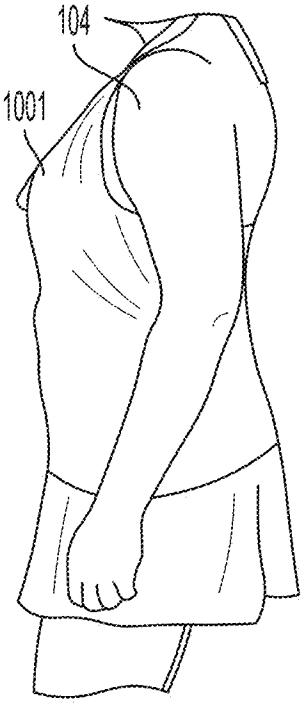
Figure 13C:
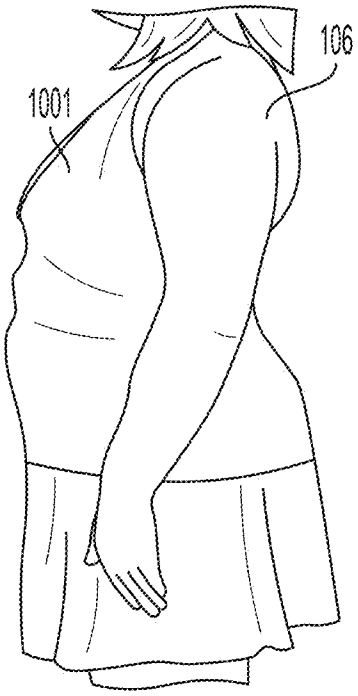

Referring to FIGS. 10 and 11, a first embodiment of a bra assembly (hereinafter collectively referred to as "bra") of the present disclosure is generally referred to by 1000. Bra 1000 is incorporated into a swim top 1001 sometimes referred to as a tankini. However, bra 1000 can be a single bra or incorporated into a garment, for example, a dress, a swim top, a one-piece swimsuit, a tank top, a t-shirt, an athletic-wear top, a long-sleeve shirt, a sleep top, lingerie, camisole, or any other garment that can incorporate a bra.

Bra 1000 has a first fabric portion 1002. First fabric portion 1002 has a first top edge 1006, a first bottom edge 1008 and a first side edge 1010 between first top edge 1006 first bottom edge 1008. First fabric portion 1002 has a first ply of fabric 1021 that is folded upon itself to form an inner first ply 1002*a* and an outer first ply 1002*b*. A folded portion of first ply of fabric 1021 of first fabric portion 1002 forms first side edge 1010. Inner first ply 1002*a* and outer first ply 1002*b* are connected at a seam 1011 on sides of inner first ply 1002*a* and outer first ply 1002*b* opposite first side edge 1010. First fabric portion 1002 has a first interior volume 1003 between inner first ply 1002*a* and outer first ply 1002*b*.

First fabric portion 1002 has a first cup assembly 1004. First cup assembly 1004 has a first cup insert 1005 that is in first interior volume 1003 and a portion of first ply of fabric 1021 covering first cup insert 1005. First fabric portion 1002 is stretchable so that first cup insert 1005 is movable in a horizontal direction, which is about the width of the wearer, as shown by arrows 1017, 1019, a vertical direction that is in the direction of the height of the wearer as shown by arrows 1025, 1027, and a diagonal direction as shown by arrows 1051 and 1053. First fabric portion 1002 has, for example, first ply of fabric 1021 having fiber content of: nylon/spandex, polyester/spandex, or 100% stretch polyester. First ply of fabric 1021, for example, has a spandex content of 5-40% and a Nylon or polyester content: 60-95%. Fabric constructions of first ply of fabric 1021 can be: warp knit or circular knit. First ply of fabric 1021, for example, has a fabric weight of 2.4-8 oz/yd$^2$. First ply of fabric 1021 may or may not have equal stretch in the vertical and horizontal directions. For example, first ply of fabric 1021 can have a Fabric Length Elongation range: 60-220% and Fabric Width Elongation range: 70-240%. Alternatively, first fabric portion 1002 is not folded upon itself and has an aperture that connects to a perimeter of first cup insert 1005, similar to single layer of fabric 1902 and first cup insert 1906 of FIG. 19, so that first cup insert 1005 is exposed and not covered by layers of fabric inside an interior volume.

Bra 1000 has a second fabric portion 1012. Second fabric portion 1012 has a second top edge 1016, a second bottom edge 1018 and a second side edge 1020 between second top edge 1016 and second bottom edge 1018. Second fabric portion 1012 has a second ply of fabric 1043 that is folded upon itself to form an inner second ply 1012*a* and an outer second ply 1012*b*. Folded portion of second ply of fabric

1043 of second fabric portion 1012 forms second side edge 1020. Inner second ply 1012*a* and outer second ply 1012*b* are connected at a seam 1015 on sides of inner second layer 1012*a* and outer second layer 1012*b*, respectively, opposite second side edge 1020. Second fabric portion 1012 has a second interior volume 1013 between inner second ply 1012*a* and outer second ply 1012*b*.

Second fabric portion 1012 has a second cup assembly 1014. Second cup assembly 1014 has a second cup insert 1007 that is in second interior volume 1013 and a portion of second ply of fabric 1043 covering second cup insert 1007. Second fabric portion 1012 is stretchable so that second cup insert 1007 is movable in the horizontal direction, which is about the width of the wearer, as shown by arrows 1017, 1019, the vertical direction, which is in the direction of the height of the wearer, as shown by arrows 1025, 1027, and the diagonal direction, as shown by arrows 1051 and 1053 upon stretch of second fabric portion 1012. Second fabric portion 1012 has, for example, second ply of fabric 1043 having fiber content of: nylon/spandex, polyester/spandex, or 100% stretch polyester. Second ply of fabric 1043, for example, has a spandex content of 5-40% and a Nylon or polyester content: 60-95%. Fabric constructions of second ply of fabric 1043 can be: warp knit or circular knit. Second ply of fabric 1043, for example, has a fabric weight of 2.4-8 oz/yd$^2$. Second ply of fabric 1043 may or may not have equal stretch in the vertical and horizontal directions. Second ply of fabric 1043, for example, has a Fabric Length Elongation range: 60-220% and Fabric Width Elongation range: 70-240%. Alternatively, second fabric portion 1012 is not folded upon itself and has an aperture that connects to a perimeter of second cup insert 1007, similar to single layer of fabric 1908 and first cup insert 1912 of FIG. 19, so that second cup insert 1007 is exposed and not covered by layers of fabric inside an interior volume. Inner first ply 1002*a*, outer first ply 1002*b*, inner second ply 1012*a* and an outer second ply 1012*b* can be independent of each other and in terms of fabrication can be the same fabric or different fabrics, for example, such fabrics include lace, jacquards and other fabrics.

The portion of first ply of fabric 1021 of first cup assembly 1004 and the portion of second ply of fabric 1043 of second cup assembly 1014 are molded at the location of first cup insert 1005 and second cup insert 1007, respectively. The portion of first ply of fabric 1021 of first cup assembly 1004 and the portion of second ply of fabric 1043 of second cup assembly 1014 are bubble molded to form a convex shape when in a relaxed non-stretch state. The convex shape facilitates the horizontal, vertical and diagonal movement of first cup insert 1005 and second cup insert 1007 on the breast of the wearer during stretch of first fabric portion 1002 and second fabric portion 1012, respectively, to accommodate different sized breasts. Referring to FIG. 28, the portion of first ply of fabric 1021 of first cup assembly 1004 and the portion of second ply of fabric 1043 of second cup assembly 1014 that are bubble molded to form a convex shape have a circumference from 7.5 cm to 23 cm and a depth of 0.5 cm to 17 cm.

Figure 29:
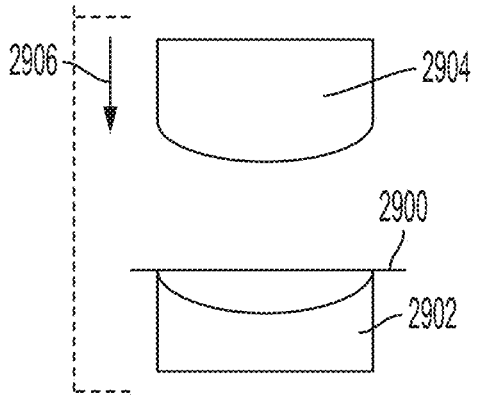
FIG. 29 is a schematic diagram of bubble molding of a fabric with molds being separated.
Figure 30:
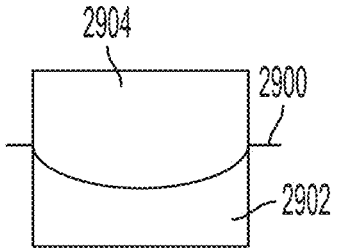
FIG. 30 is a schematic diagram of bubble molding of a fabric with the molds mating together.

Referring to FIG. 29, a fabric 2900, for example, the portion of first ply of fabric 1021 of first cup assembly 1004 or the portion of second ply of fabric 1043 of second cup assembly 1014, is placed on a lower half 2902 of a mold. An upper half 2904 of the mold moves toward lower half 2902 as shown by arrow 2906. Referring to FIG. 30, fabric 2900 is between upper half 2904 and lower half 2902 and with the application of pressure, heat and any combination thereof, form a convex shape in fabric 2900 in a relaxed non-stretch state.

First cup insert 1005 and second cup insert 1007 are made of materials that can be, for example, the material of first ply of fabric 1021 of first fabric portion 1002 and the material of second ply of fabric 1043 of second fabric portion 1012 or fabric top covers. Such materials can be fabrics that use fibers of nylon, polyester, cotton, spandex and any combinations thereof, that can handle the high heat of lamination. The fabrics can be laminated with many different types of foam recipes, such as open cell or closed cell, and including memory foam. First cup insert 1005 and second cup insert 1007 are made of materials that, for example, also can be spacer fabrics. First cup insert 1005 and second cup insert 1007 preferably are a convex shape. First cup insert 1005 and second cup insert 1007 can be molded or cut and sewn. First cup insert 1005 and second cup insert 1007 can be with enhancement.

The portion of first ply of fabric 1021 of first cup assembly 1004, the portion of second ply of fabric 1043 of second cup assembly 1014, first cup insert 1005 and second cup insert 1007 provide support to the breast of the wearer. First cup insert 1005 and second cup insert 1007 also cover each nipple of the wearer to reduce or eliminate the visibility of the shape of the nipples through bra 1000 to provide modesty to the wearer. This modesty is considered an attractive aspect.

First top edge 1006 of first fabric portion 1002 is connected to second top edge 1016 of second fabric portion 1012 so that first top edge 1006 and second top edge 1016 are in fixed positions relative to each other. First top edge 1006 of first fabric portion 1002 is connected to second top edge 1016 of second fabric portion 1012. A back panel 1033 connects first fabric portion 1002 to second fabric portion 1012 between seams 1013 and 1015.

A band 1022 has a first end 1024 and a second end 1026. First end 1024 and second end 1026 have a closure 1028 to removably connect them together. Closure 1028 has a first closure connector 1028*a* and a second closure connector 1028*b* that removable connect to one another. Closure 1028 has a first adjustment 1030 to connect first end 1024 to second end 1026 so that band 1022 has a first size, and a second adjustment 1032 to connect first end 1024 to second end 1026 so that band 1022 has a second size that is different than the first size. First bottom edge 1008 and second bottom edge 1018 are connected to band 1022 aligning first side edge 1010 with first end 1024 and second side edge 1020 with second end 1026 so that first cup assembly 1004 and second cup assembly 1014 are movable relative to one another upon movement of closure 1028 between first adjustment 1030 and second adjustment 1032.

Band 1022 and closure 1028 form a continuous loop when closure 1028 connects first end 1024 and second end 1026. Closure 1028 also has a third adjustment 1035 to connect first end 1024 to second end 1026 so that band 1022 has a third size. Also, closure 1028 has a fourth adjustment 1039 to connect first end 1024 to second end 1026 so that band 1022 has a fourth size, and a fifth adjustment 1041 to connect first end 1024 to second end 1026 so that band 1022 has a fifth size. The continuous loop that is formed when first end 1024 is connected to second end 1026 decreases in size from the first size at first adjustment 1030 to the second size at second adjustment 1033 to the third size at third adjustment 1035 to the fourth size at fourth adjustment 1039 and to the fifth size at fifth adjustment 1041. Closure 1028, alternatively, has more or less fixed adjustments, namely less than first adjustment 1030, second adjustment 1032, third adjustment 1035, fourth adjustment 1039, and fifth adjustment 1041. Referring to FIG. 28, band 1022 has a width 1023 from 12 millimeters ("mm") to 62 mm and a length from 16 inches ("in") to 60 in.

First top edge 1006 of first fabric portion 1002 and second top edge 1016 of second fabric portion 1012 are connected to an exterior top edge 1034 of an exterior layer of fabric 1036, except between shoulder straps 1037. Between shoulder straps 1037, portions of second top edge 1018 and first top edge 1008 that are connected to one another are free and not connected to exterior top edge 1034 of exterior layer of fabric 1036, to form a "floating neckline" between pair shoulder straps 1037 in the front of swim top 1001.

First top edge 1006 is connected to second top edge 1016 at connection point 1029 to form a separation 1031 between first side edge 1010 and second side edge 1020. Band 1022, first bottom edge 1008 and second bottom edge 1018 are each free from exterior layer 1036.

First cup insert 1005 has a top portion 1040 and a bottom portion 1042. Bottom portion 1042 is adjacent band 1022. Second cup insert 1007 has a top portion 1044 and a bottom portion 1046. Bottom portion 1046 is adjacent band 1022. First cup insert 1005 only has bottom portion 1042 connected to first ply of fabric 1021 of first fabric portion 1002. Second cup insert 1007 only has bottom portion 1046 connected to second ply of fabric 1043 of second fabric portion 1012. Outer first ply 1002*b* of first fabric portion 1002 has an opening 1048 adjacent first cup insert 1005 to access first interior volume 1003. Outer second ply 1012*b* of second fabric portion 1012 has an opening 1049 adjacent second cup insert 1007 to access second interior volume 1013. Openings 1048 and 1049 allow access interior volumes 1003 and 1013, respectively, to adjust first cup insert 1005 and second cup insert 1007, for example, to unfold first cup insert 1005 and second cup insert 1007 if they become folded. Openings 1048 and 1049 of bra 1000 can have the shape of openings 1048 and 1049 of bra 3100 of FIG. 35. Alternatively, first cup insert 1005 can have bottom portion 1042 connected to only inner first ply 1002*a* or outer first ply 1002*b*. Similarly, second cup insert 1007 can have bottom portion 1046 connected to only inner second ply 1012*a* or outer second ply 1012*b*. Again referring to FIG. 28, first cup insert 2216 and second cup insert 2218 have a depth of 0.5 cm to 25 cm. First cup insert 1005 that only has bottom portion 1042 connected to first ply of fabric 1021 of first fabric portion 1002, and second cup insert 1007 that only has bottom portion 1046 connected to second ply of fabric 1043 of second fabric portion 1012, also facilitates the horizontal and vertical movement of first cup insert 1005 and second cup insert 1007 on the breast of the wearer to allow stretch of first ply of fabric 1021 of first layer of fabric 1002 around top portion 1040 and second ply of fabric 1043 of second layer of fabric 1014 around top portion 1044, respectively, to accommodate different sized breasts.

Referring to FIGS. 1213C, first wearer 102, second wearer 104 and third wearer 106 are each wearing swim top 1001 that is a size 8 having bra 1000. First wearer 102 is a size 12, 34GG cup and 34 underband, second wearer 104 is a size 8, 36C cup and 36 underband, and third wearer 106 is a size 14, 38DD cup and 38 underband.

Figure 14:
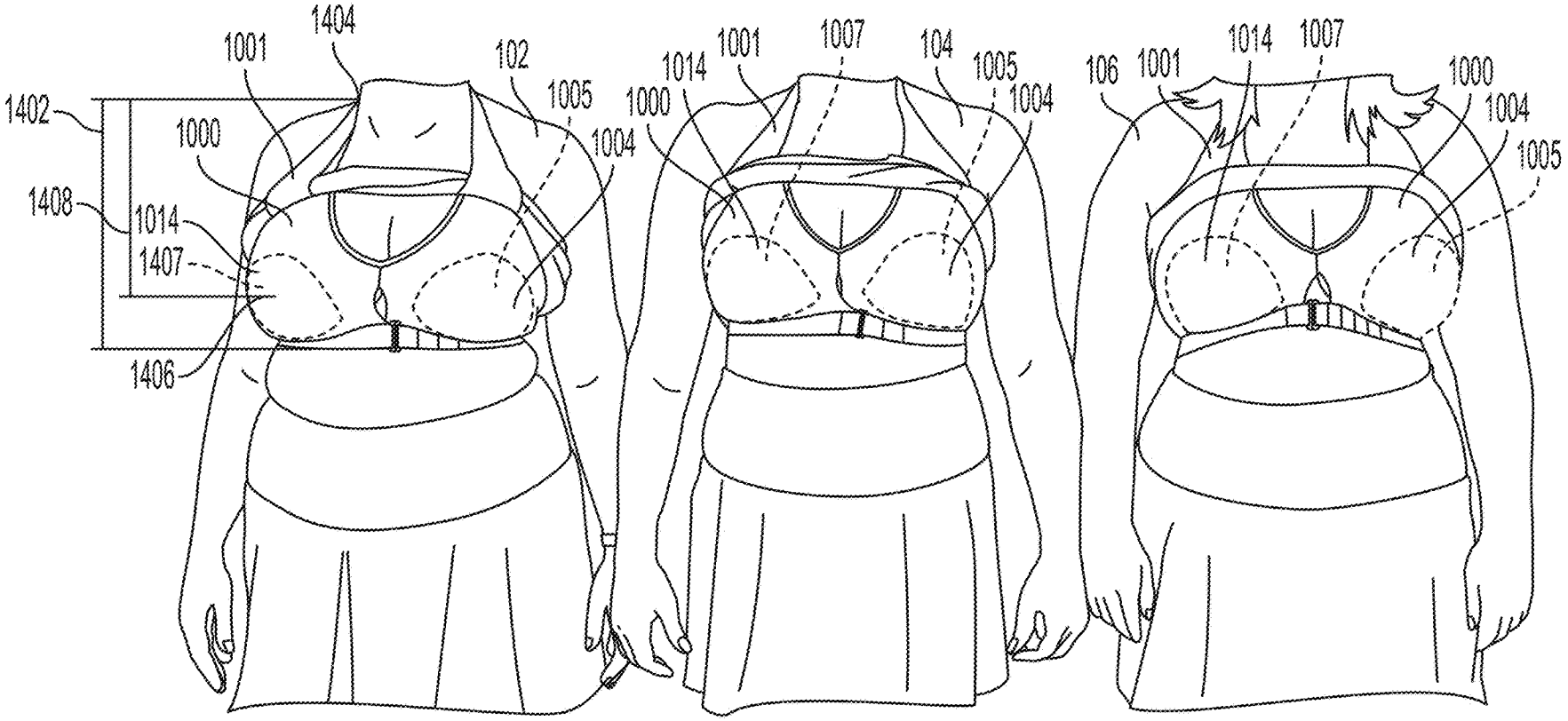
FIG. 14 is a front view of the first wearer, the second wearer and the third wearer each wearing the swim top shown with an exterior fabric layer lifted to uncover or show the first embodiment of the bra assembly of FIG. 10.
Figure 15C:
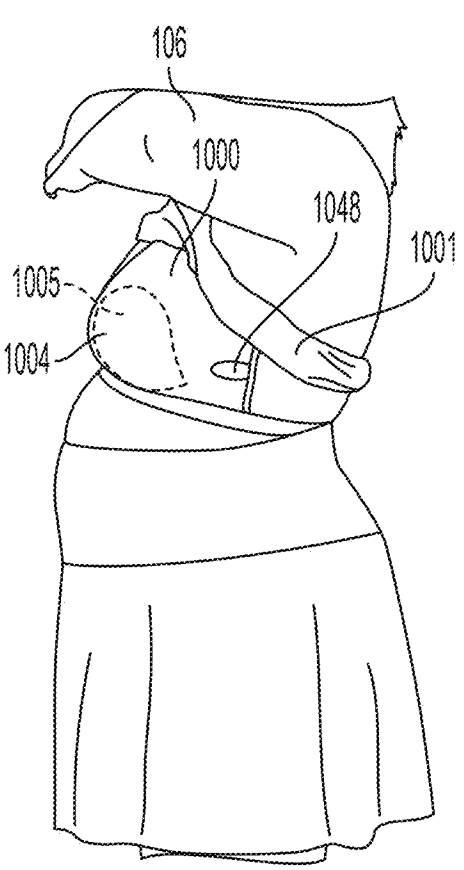
FIGS. 15A-15C are front views of the first wearer, the second wearer and the third wearer that have turned to the side and each wearing the swim top shown with the exterior fabric layer lifted to uncover the first embodiment of the bra assembly of FIG. 10.
Figure 15B:
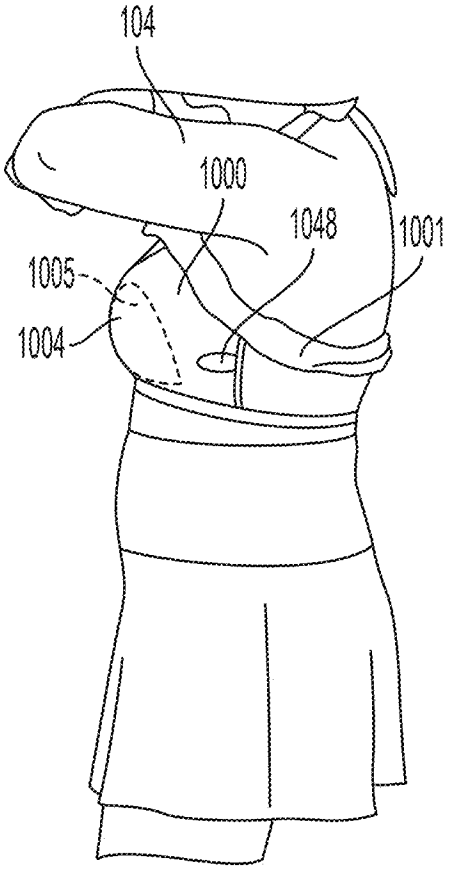
Figure 15A:
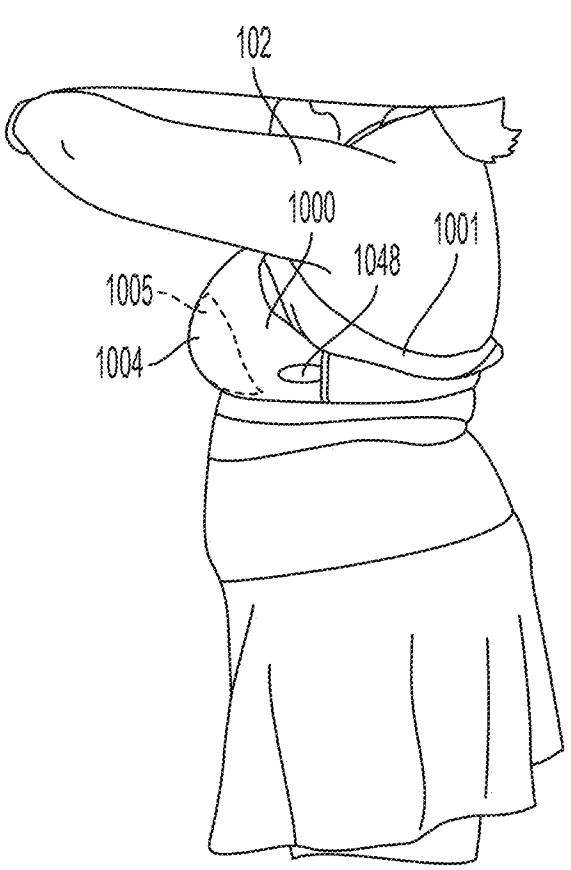

Referring to FIGS. 14-15C, exterior layer of fabric 1036 of swim top 1001 is lifted on first wearer 102, second wearer 104 and third wearer 106 revealing or uncovering bra 1000.

Referring to FIGS. 16, 17, 18 and 20, closure 1028 is adjustable to connect first end 1024 and second end 1026 at different positions to vary a size of the continuous loop of band 1022 and closure 1028. While any closure assembly that permits adjustment can be used, it is preferable that first closure connector 1028*a* is a hook. First adjustment 1030, second adjustment 1032, third adjustment 1035, fourth adjustment 1039, and fifth adjustment 1041 of second closure connector 1028*b* are five loops 1050, 1052, 1054, 1056 and 1058, respectively, formed along a length of band 1022 so that positioning the hook of first closure connector 1028*a* in each different loop of second closure connector 1028*b* makes the size of the continuous loop of band 1022 and closure 1028 smaller or larger. Alternatively, closure 1022 can be hardware, such as, hooks, snaps, Velcro, magnets, hooks/eyes, button holes and any other closure alternative. The continuous loop that is formed when first end 1024 is connected to second end 1026 decreases in size, each time, from loop 1050 to loop 1052, from loop 1052 to loop 1054, from loop 1054 to loop 1056, and from loop 1056 to loop 1058.

Each of first wearer 102, second wearer 104 and third wearer 106 prefers a different position of closure 1028 allowing a customized comfort and fit of bra 1000 for each of first wearer 102, second wearer 104 and third wearer 106. Closure 1028 accommodates for each preference.

Figure 17:
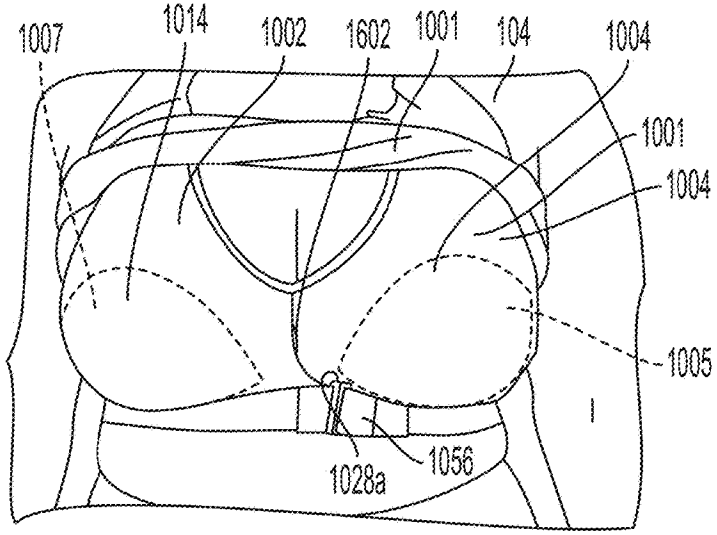
FIG. 17 is an enlarged front view of the second wearer wearing the swim top shown with the exterior fabric layer lifted to uncover the first embodiment of the bra assembly of FIG. 10 and having the closure in a fourth connected position.
Figure 16:
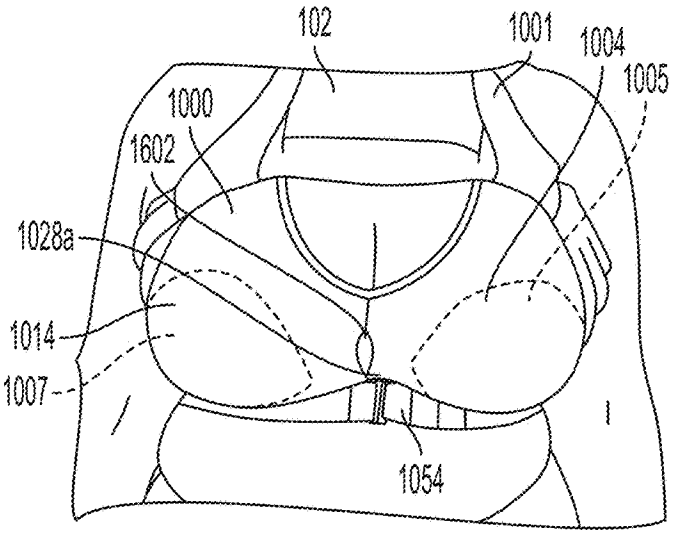
FIG. 16 is an enlarged front view of the first wearer wearing the swim top shown with the exterior fabric layer lifted to uncover the first embodiment of the bra assembly of FIG. 10 and having a closure in a third connected position.
Figure 18:
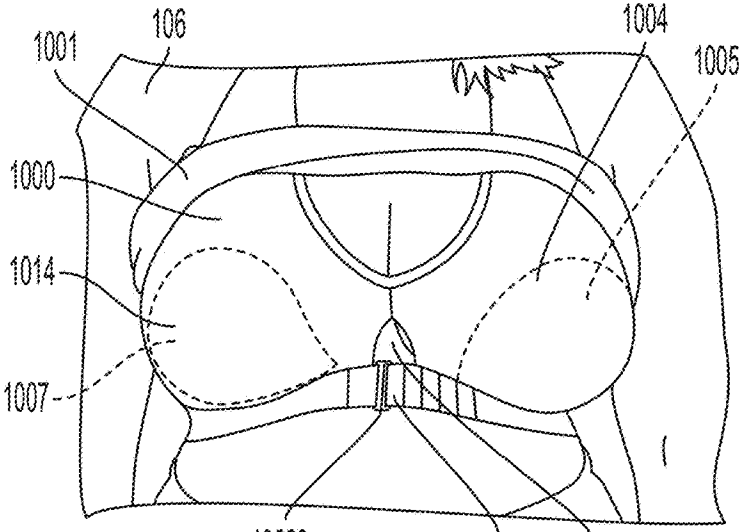
FIG. 18 is an enlarged front view of the third wearer wearing the swim top shown with the exterior fabric layer lifted to uncover the first embodiment of the bra assembly of FIG. 10 and having the closure in a first connected position.

Referring to FIG. 16, first wearer 102 has the hook of first closure connector 1028*a* in a loop 1054 that is the third loop. Referring to FIG. 17, second wearer 104 has the hook of first closure connector 1028*a* in a loop 1056 that is the fourth loop which forms a smaller size of band 1028 than loop 1054. Referring to FIG. 18, third wearer 106 has the hook of first closure connector 1028*a* in a loop 1050 that is the first loop which forms a larger size of band 1028 than loop 1054 and loop 1052. The hook of first closure connector 1028*a* can be inserted into each of loops 1050, 1052, 1054, 1056 and 1058.

Figure 19:
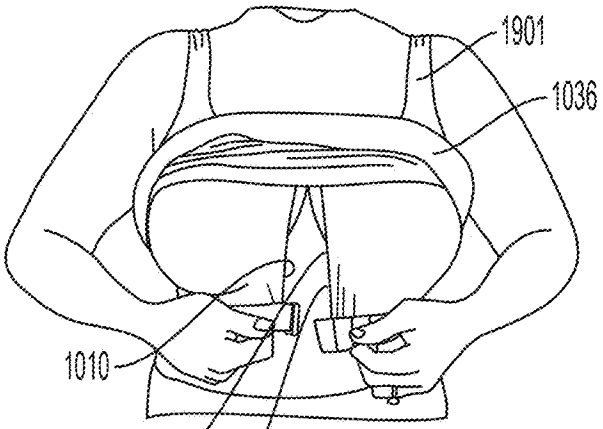
FIG. 19 is an enlarged front view of a wearer wearing a swim top shown with an exterior fabric layer lifted to uncover a modified bra of the first embodiment of the bra assembly of FIG. 10 and having the closure in an open position.
Figure 19A:
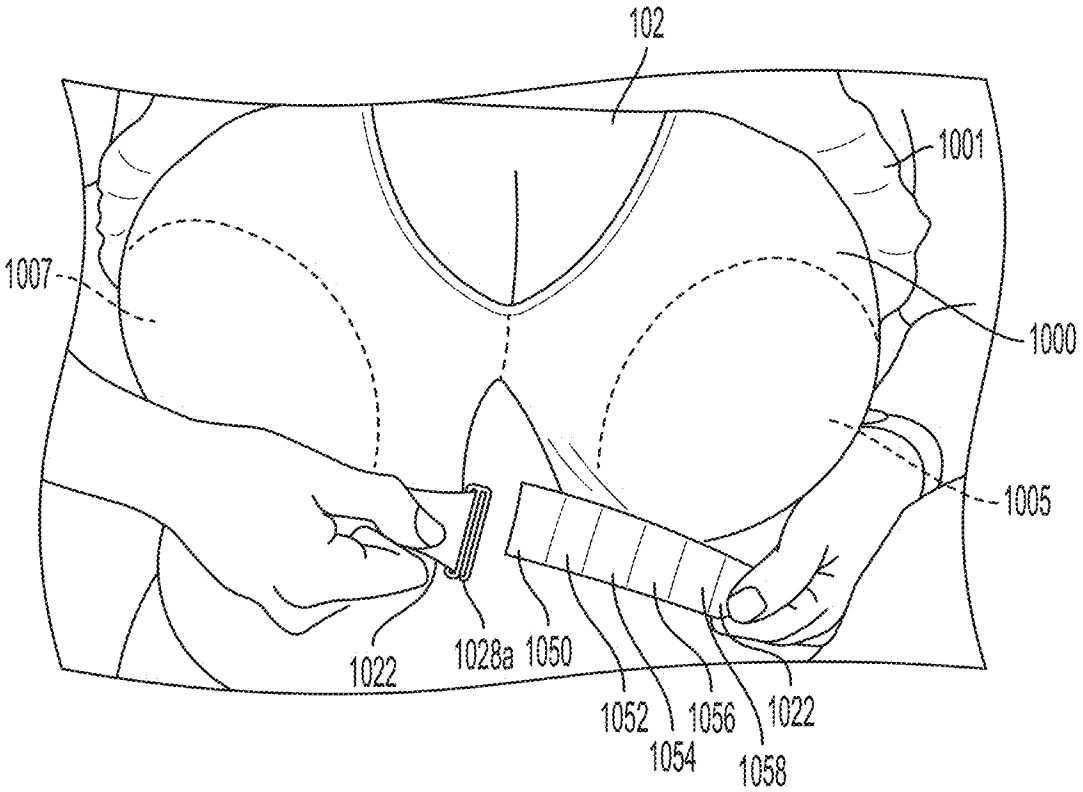
FIG. 19A is an enlarged front view of the first wearer wearing the swim top shown with the exterior fabric layer lifted to uncover the first embodiment of the bra assembly of FIG. 10 and having the closure in the open position.

Referring to FIG. 19A, after the hook of first closure connector 1028*a* is inserted each of loops 1050, 1052, 1054, 1056 and 1058, then, the hook of first closure connector 1028*a* is removable from each of loops 1050, 1052, 1054, 1056 and 1058. Clearly, the size of band 1022 can be changed by movement of the hook of first closure connector 1028*a* to different ones of loops 1050, 1052, 1054, 1056 and 1058.

First cup insert 1005 and second cup insert 1007 are in different locations on each of first wearer 102, second wearer 104, and third wearer 106, first due to horizontal, vertical and diagonal movement of first cup insert 1005 and second cup insert 1007 on the breast by stretch of first fabric portion 1002 and second fabric portion 1012 and second due to the adjustable size of band 1028 by closure 1028 accommodating the different sized breasts of first wearer 102, second wearer 104 and third wearer 106. For example, it is noted in FIG. 14 that first cup insert 1005 and second cup insert 1007 are closer together on second wearer 104, that has the smallest underband size, than on first wearer 102 and third wearer 106. Also, first cup insert 1005 and second cup insert 1007 appear lower on the breasts of first wearer 102 that has the largest cup size than on second wearer 104 and third wearer 106.

The portion of first ply of fabric 1021 of first cup assembly 1004 and the portion of second ply of fabric 1043 of second cup assembly 1014 that are molded allow for shaping and support of breasts of a wearer in a generally convex shape. The portion of first ply of fabric 1021 of first cup assembly 1004 and the portion of second ply of fabric 1043 of second cup assembly 1014 that are molded also allow for expansion and retraction of surface area to cover different sized breasts and different shaped breasts, and further allow for expansion and retraction for movement of first cup insert 1005 and second cup insert 1007 in variable horizontal, vertical and diagonal distances for different positions of first cup insert 1005 and second cup insert 1007 on the breasts for different shaped breasts as well as different sized breasts.

Closure 1028 moves first cup insert 1005 and second cup insert 1007 closer and further apart for different body sizes, in particular, different underband sizes. Closure 1028 can move the portion of first ply of fabric 1021 of first cup assembly 1004 and the portion of second ply of fabric 1043 of second cup assembly 1014 that are molded closer and further apart for different body sizes, in particular, different underband sizes. Bottom portion 1042 being only connected to first ply of fabric 1021 of first fabric portion 1002 and bottom portion 1046 being only connected to second ply of fabric 1043 of second fabric portion 1012, allow for stretch of the fabric overlapping the cup insert in the relaxed state to stretch beyond the cup insert to maintain the cup insert in a desirable position, e.g., adjacent the band.

The breast tissue of first wearer 102, second wearer 104 and third wearer 106 is tucked and covered by bra 1000 so that the swim top 1001 properly fits first wearer 102, second wearer 104 and third wearer 106. This tucked and covered look is considered fashionable. Accordingly, three different sized women, first wearer 102, second wearer 104 and third wearer 106, having three different cup sizes and three different underband sizes, can all comfortably wear the same size eight swim top 1001.

Figure 18A:
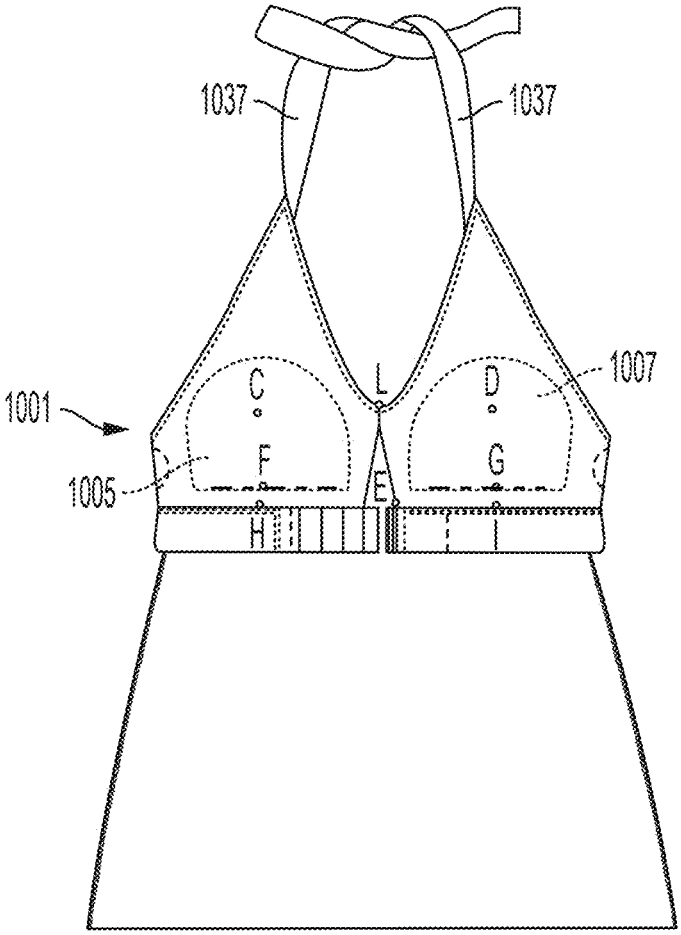
FIG. 18A is the front view of the first embodiment of the bra assembly of FIG. 10 including points of measurement.
Figure 18B:
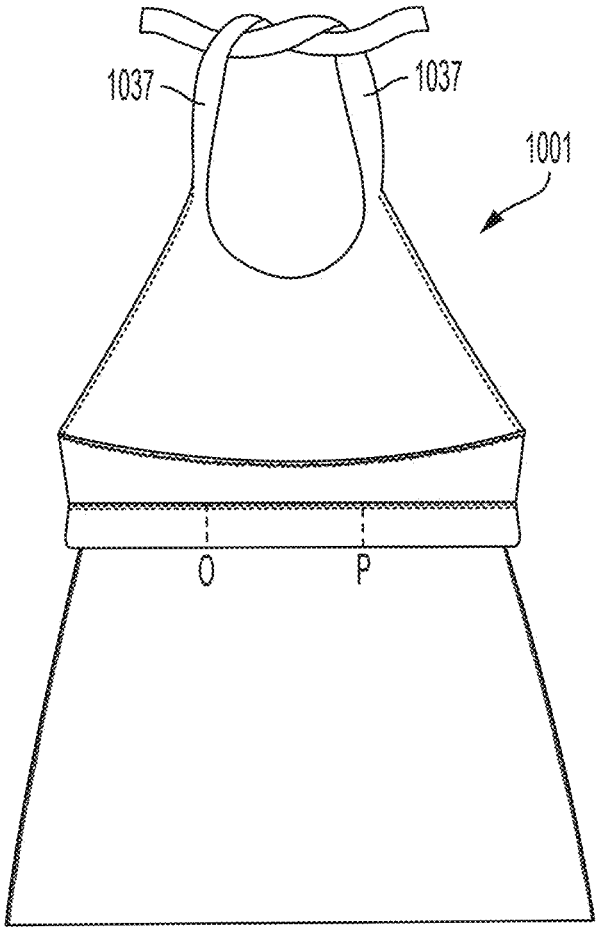
FIG. 18B is the rear view of the first embodiment of the bra assembly of FIG. 10 including points of measurement.

Measurements were taken of swim top 1001 when swim top 1001 was off of a wearer and laid flat as shown in FIG. 18A. The measurements were taken at from a point C to a point D, a measurement was taken from point C to a point E, a measurement was taken from point D to point E, a measurement was taken from point C to a point F, a measurement was taken from point D to a point G, a measurement was taken from point C to a point H, a measurement was taken from point D to a point I, a measurement was taken from a point L to point E, a measurement was taken from point L to point C and a measurement was taken from point L to point D. Referring to FIG. 18B, a measurement was taken from a point O to a point P. The same measurements were taken when swim top 1001 was on each of first wearer 102, second wearer 104 and third wearer 106, as shown in FIGS. 12-18. Swim top 1001 is a size 8. Referring to FIGS. 18B-18D, the results of these measurements are shown in Table 1. It is noted that all single letters, C, D, E, F, G, H, I, O and P, in Point of Measurements row in Table 1 are not referring to cup sizes.

Referring to FIG. 14, it is noted that third wearer 106 has a breast tissue size greater on her left breast that her right breast and second wearer 104 has breast implants and a breast tissue size is greater on her right breast. It is additionally noted that the measurements were taken over several non-consecutive days. It is also noted that measurements are/will be affected by production cutting and sewing, therefore the measurements (and therefore the percentages) may not be equal on the body, from one side to the other side and/or from the top to the bottom of swim top 1001. It is further noted that the adjustability of the neck ties of shoulder straps 1037 can affect a front interior bra height, for example, bra height 1402 of wearer 102 is shown in FIG. 14. A measurement from a shoulder 1404 to an apex point 1406, for example, measurement from the shoulder to the apex point 1408 of wearer 102 is shown, can be different from person to person and therefore the movement of a height, for example, a height being the measurement that was taken from point C to a point H, of each of first cup insert 1005 and second cup insert 1007 can be different from person to person. For this particular style tankini, as discussed above, between shoulder straps 1037, portions of second top edge 1018 and first top edge 1008 that are connected to one another are free and not connected to exterior top edge 1034 of exterior layer of fabric 1036, to form a "floating neckline" between pair shoulder straps 1037 in the front of swim top 1001, so there is less resistance on the movement of the interior bra frame, as shown in the measurement that was taken from point C to a point H and the measurement was taken from point D to a point G.

Referring to Table 1 in FIGS. 18C-18E, the columns under the title "Measurement of the models" includes a first column 1802 that indicates an underband measurement and apex measurement for each of first wearer 102, second wearer 104 and third wearer 106. The apex measurement is a measurement from an apex of the breasts around the body, for example, as shown in FIG. 9 as measurement 902. The underband measurement is a measurement around the body, for example, as shown in FIG. 9 as measurement 904. First wearer 102 has an underband measurement of 32 inches and an apex measurement of 42 inches. Second wearer 104 has an underband measurement of 33.75 inches and an apex measurement of 42 inches. Third wearer 106 has an underband measurement of 34.5 inches and an apex measurement of 43.5 inches. The second column 1804 includes the cup size of each of first wearer 102, second wearer 104 and third wearer 106. As discussed above, first wearer 102 is a size 12, 34GG cup and size 34 underband, second wearer 102 is a size 8, 36C cup and size 36 underband, and third wearer 104 is a size 14, 38DD cup and size 38 underband. The third column 1806 identifies each of first wearer 102, second wearer 104 and third wearer 106, and, thus, measurements for first wearer 102 are in row 1803, measurements for second wearer 104 are in row 1805 and measurements for third wearer 106 are in row 1807. The column 1808 under the title "Adjustable" includes the loop for each wearer. First wearer 102 has the hook of first closure connector 1028*a* in loop 1054 that is the third loop, second wearer 104 has the hook of first closure connector 1028*a* in loop 1052 that is the second loop, and third wearer 106 has the hook of first closure connector 1028*a* in loop 1050 that is the first loop. It is noted that second wearer 104 has the hook of first closure connector 1028*a* in loop 1052 that is the second loop for the measurements of Table 1 instead of loop 1056 that is the fourth loop as shown in FIGS. 12-15C and 17.

The columns under the title "UnderBand movement in width" are column 1810 that includes the measurement from point O to point P when swim top 1001 is off of the wearer and laid flat (5 inches), column 1812 that includes the measurement from point O to point P when swim top 1001 is on first wearer 102 in row 1803 (6.875 inches), second wearer 104 in row 1805 (6.75 inches) and third wearer 106 in row 1807 (6.625 inches), and column 1814 that indicates a percentage of change from a value in column 1810 compared with a value in column 1812 for first wearer 102 in row 1803 (28 percent), second wearer 104 in row 1805 (26 percent) and third wearer 106 in row 1807 (25 percent). Accordingly, point O and point P move away from one another on each of first wearer 102, second wearer 104 and third wearer 106. Further, point O and point P move away from one another a different distance on each of first wearer 102, second wearer 104 and third wearer 106 indicating different amounts of stretch of band 1022.

The columns under the title "Apex to Apex cup movement in width" are column 1816 that includes the measurement from point C to point D when swim top 1001 is off of the wearer and laid flat (7 inches), column 1818 that includes the measurement from point C to point D when swim top 1001 is on first wearer 102 in row 1803 (8.375 inches), second wearer 104 in row 1805 (9.0 inches) and third wearer 106 in row 1807 (9.5 inches), and column 1820 that indicates a percentage of change from a value in column 1816 compared with a value in column 1818 for first wearer 102 in row 1803 (17 percent), second wearer 104 in row 1805 (23 percent) and third wearer 106 in row 1807 (27 percent). Accordingly, point C and point D move away from one another on each of first wearer 102, second wearer 104 and third wearer 106. Further, point C and point D move away from one another a different distance on each of first wearer 102, second wearer 104 and third wearer 106 indicating first cup insert 1005 and second cup insert 1007 can move different distances away from one another to fit different sized wearers.

One of the columns under the title "Cup movement in diagonal adjustable side" is column 1822 that includes the measurement from point C to point E when swim top 1001 is off of the wearer and laid flat with the hook of first closure connector 1028*a* in loop 1054 that is the third loop in row 1803 (3.875 inches), when swim top 1001 is off of the wearer and laid flat with the hook of first closure connector 1028*a* in loop 1052 that is the second loop in row 1805 (4.5 inches), and when swim top 1001 is off of the wearer and laid flat with the hook of first closure connector 1028*a* in loop 1050 that is the first loop (4.875 inches). Column 1824 includes the measurement from point C to point E when swim top 1001 is on first wearer 102 in row 1803 (4.5 inches), second wearer 104 in row 1805 (5 inches) and third wearer 106 in row 1807 (5.5 inches). Column 1826 indicates a percentage of change from a value in column 1822 compared with a value in column 1824 for first wearer 102 in row 1803 (16 percent), second wearer 104 in row 1805 (11 percent) and third wearer 106 in row 1807 (13 percent). Accordingly, point C and point E move away from one another on each of first wearer 102, second wearer 104 and third wearer 106. Further, point C and point E move away from one another a different distance on each of first wearer 102, second wearer 104 and third wearer 106 indicating movement of different distances away from one another to fit different sized wearers.

The columns under the title "Cup movement in diagonal hook side" are column 1828 that includes the measurement from point D to point E when swim top 1001 is off of the wearer and laid flat (4.125 inches), column 1830 that includes the measurement from point D to point E when swim top 1001 is on first wearer 102 in row 1803 (5 inches), second wearer 104 in row 1805 (5 inches) and third wearer 106 in row 1807 (5 inches), and column 1832 that indicates a percentage of change from a value in column 1828 compared with a value in column 1830 for first wearer 102 in row 1803 (21 percent), second wearer 104 in row 1805 (21 percent) and third wearer 106 in row 1807 (21 percent). Accordingly, point D and point E move away from one another on each of first wearer 102, second wearer 104 and third wearer 106. The value from point D to point E is the same for first wearer 102, second wearer 104 and third wearer 106 for these two reasons: (1) point E is a location of the hook of first closure connector 1028*a* and the hook of first closure connector 1028*a* has already been moved on each one of first wearer 102, second wearer 104 and third wearer 106, onto loop 1054 that is the third loop, loop 1052 that is the second loop, and loop 1050 that is the first loop, respectively, which is not recorded on the chart; and (2) there is movement that can be seen in FIGS. 16, 17 and 18 in between the breasts of first wearer 102, second wearer 104 and third wearer 106, where there is an opening 1602 that is formed when first closure connector 1028*a* is in one of the loops of second closure connector 1028*b*, as shown in FIGS. 16-18. That opening 1602 also increases or decreases in size according to the amount of breast tissue. While, the breast tissue has been quantified in terms of GG, C and DD cup sizes on the chart, measurement changes in the 'triangular' opening of opening 1602 as a result of the movement have not been recorded on the chart.

The columns under the title "Cup movement in height" are column 1834 that includes the measurement from point C to point F when swim top 1001 is off of the wearer and laid flat (2.3125 inches), column 1836 that includes the measurement from point C to point F when swim top 1001 is on first wearer 102 in row 1803 (2.375 inches), second wearer 104 in row 1805 (2.25 inches) and third wearer 106 in row 1807 (2.5 inches), and column 1838 that indicates a percentage of change from a value in column 1834 compared with a value in column 1836 for first wearer 102 in row 1803 (3 percent), second wearer 104 in row 1805 (−3 percent) and third wearer 106 in row 1807 (8 percent). Accordingly, point C and point F move toward or away from one another on each of first wearer 102, second wearer 104 and third wearer 106. Further, point C and point F move toward or away from one another a different distance on each of first wearer 102, second wearer 104 and third wearer 106 to fit different sized wearers. The value is negative in column 1838 for second wearer 104 because point C is closer to point F. Point C is closer to point F for second wearer 104 because edges of first cup insert 1005 are moved inward due to first fabric portion 1002 overlapping with second fabric portion 1012 when second wearer 104 has the hook of first closure connector 1028*a* in loop 1052 that is the second loop. While the value is negative in column 1838 for second wearer 104, in terms of numbers, it represents 1/16 of an inch, in terms of measurement. For instance, if wearer 104 raised her shoulders the measurement could change, ever so slightly, because the stretch fabric of first fabric portion 1002 is not static on the body of wearer 104.

The columns under the title "Cup movement in height" are column 1840 that includes the measurement from point D to point G when swim top 1001 is off of the wearer and laid flat (2.3125 inches), column 1842 that includes the measurement from point D to point G when swim top 1001 is on first wearer 102 in row 1803 (2.1275 inches), second wearer 104 in row 1805 (2.3125 inches) and third wearer 106 in row 1807 (2.4375 inches), and column 1842 that indicates a percentage of change from a value in column 1840 compared with a value in column 1842 for first wearer 102 in row 1803 (−8 percent), second wearer 104 in row 1805 (0 percent) and third wearer 106 in row 1807 (5 percent). Accordingly, point D and point G move toward or away from one another on each of first wearer 102, second wearer 104 and third wearer 106. Further, point D and point G move toward or away from one another a different distance on each of first wearer 102, second wearer 104 and third wearer 106 to fit different sized wearers. The value is negative in column 1844 for first wearer 102 because point D is closer to point G. Point D is closer to point G for first wearer 102 because edges of second cup insert 1007 are moved inward due to first fabric portion 1002 overlapping with second fabric portion 1012 when first wearer 102 has the hook of first closure connector 1028*a* in loop 1054 that is the third loop While the value is negative in column 1844 for first wearer 102, in terms of numbers, it only represents less than 3/16 of an inch, in terms of measurement. For instance, if wearer 102 raised her shoulders the measurement could change because the stretch fabric is not static on the body.

The columns under the title "Cup movement in height" are column 1846 that includes the measurement from point C to point H when swim top 1001 is off of the wearer and laid flat (2.8125 inches), column 1848 that includes the measurement from point C to point H when swim top 1001 is on first wearer 102 in row 1803 (2.8125 inches), second wearer 104 in row 1805 (2.8125 inches) and third wearer 106 in row 1807 (2.8125 inches), and column 1850 that indicates a percentage of change from a value in column 1846 compared with a value in column 1848 for first wearer 102 in row 1803 (0 percent), second wearer 104 in row 1805 (0 percent) and third wearer 106 in row 1807 (0 percent). Accordingly, point C and point H do not move toward or away from one another on each of first wearer 102, second wearer 104 and third wearer 106. The value is 0% for first wearer 102, second wearer 104 and third wearer 106 because there is additional adjustability, due to the pull of the tie strap behind the neck of shoulder straps 1037. The additional adjustability and movement is coming from above both apex point C and point D to above where shoulder straps 1037 attach. There can be a variance, especially on shoulder straps 1037 due to the inconsistency on a person pulling to tie each side.

The columns under the title "Cup movement in height" are column 1852 that includes the measurement from point D to point I when swim top 1001 is off of the wearer and laid flat (2.8125 inches), column 1854 that includes the measurement from point D to point I when swim top 1001 is on first wearer 102 in row 1803 (2.8125 inches), second wearer 104 in row 1805 (2.8125 inches) and third wearer 106 in row 1807 (2.8125 inches), and column 1856 that indicates a percentage of change from a value in column 1852 compared with a value in column 1854 for first wearer 102 in row 1803 (4 percent), second wearer 104 in row 1805 (4 percent) and third wearer 106 in row 1807 (4 percent). Accordingly, point D and point I move away from one another on each of first wearer 102, second wearer 104 and third wearer 106. The value is 4 percent for all first wearer 102, second wearer 104 and third wearer 106 because there is additional adjustability, due to the pull of shoulder straps 1037 behind the neck. The additional adjustability and movement is coming from above both apex point C and point D to above where shoulder straps 1037 attach. There can be a variance, especially on shoulder straps 1037 due to the inconsistency on a person pulling to tie each side.

The columns under the title "Center Front movement height" are column 1860 that includes the measurement from point L to point E when swim top 1001 is off of the wearer and laid flat (2.375 inches), column 1862 that includes the measurement from point L to point E when swim top 1001 is on first wearer 102 in row 1803 (2.5 inches), second wearer 104 in row 1805 (2.875 inches) and third wearer 106 in row 1807 (2.875 inches), and column 1864 that indicates a percentage of change from a value in column 1860 compared with a value in column 1862 for first wearer 102 in row 1803 (4 percent), second wearer 104 in row 1805 (21 percent) and third wearer 106 in row 1807 (21 percent). Accordingly, point L and point E move away from one another on each of first wearer 102, second wearer 104 and third wearer 106. Further, point L and point E move away from one another a different distance on each of first wearer 102, second wearer 104 and/or third wearer 106 indicating second cup insert 1007 can move different distances to fit different sized wearers.

The columns under the title "Center Btm of V to Apex cup movement in width" are column 1868 that includes the measurement from point L to point C when swim top 1001 is off of the wearer and laid flat (3.875 inches), column 1870 that includes the measurement from point L to point C when swim top 1001 is on first wearer 102 in row 1803 (5.125 inches), second wearer 104 in row 1805 (5.125 inches) and third wearer 106 in row 1807 (5.25 inches), and column 1872 that indicates a percentage of change from a value in column 1868 compared with a value in column 1870 for first wearer 102 in row 1803 (25 percent), second wearer 104 in row 1805 (25 percent) and third wearer 106 in row 1807 (20 percent). Accordingly, point L and point C move away from one another on each of first wearer 102, second wearer 104 and third wearer 106. Further, point L and point C move away from one another at different distances on each of first wearer 102, second wearer 104 and/or third wearer 106 indicating first cup insert 1005 can move different distances to fit different sized wearers.

The columns under the title "Center Btm of V to Apex cup movement in width" are column 1874 that includes the measurement from point L to point D when swim top 1001 is off of the wearer and laid flat (3.875 inches), column 1876 that includes the measurement from point L to point D when swim top 1001 is on first wearer 102 in row 1803 (5.125 inches), second wearer 104 in row 1805 (5.0625 inches) and third wearer 106 in row 1807 (5.25 inches), and column 1878 that indicates a percentage of change from a value in column 1874 compared with a value in column 1876 for first wearer 102 in row 1803 (25 percent), second wearer 104 in row 1805 (24 percent) and third wearer 106 in row 1807 (20 percent). Accordingly, point L and point D move away from one another on each of first wearer 102, second wearer 104 and third wearer 106. Further, point L and point D move away from one another a different distance on each of first wearer 102, second wearer 104 and third wearer 106 indicating second cup insert 1007 can move different distances to fit different sized wearers.

According to Table 1, movement of first cup insert 1005 and second cup insert 1007 and stretch of band 1022 on the same 3 models, namely, first wearer 102, second wearer 104 and third wearer 106, of differing underband and bust sizes, allow for wearing of the same bra 1000 of swim top 1001.

Referring to FIGS. 10-18, swim top 1001 is shown as having a halter neckline. Alternatively, as shown in FIG. 19, bra 1000 can be incorporated into a swim top 1901 having a neckline that is a tank top. Swim top 1901 is the same as swim top 1001 except swim top 1901 does not have a "floating neckline". Features that are the same for swim top 1001 and swim top 1901 have the same reference numerals. In particular, first top edge 1006 and second top edge 1016 are connected to one another and are also connected along their entire length to exterior top edge 1034 of an exterior layer of fabric 1036 to form a separation 1031 between first side edge 1010 and second side edge 1020. Alternatively, first side edge 1010 and second side edge 1020 can be separate and not connected at top connection point 1029 while being connected to exterior top edge 1034 of exterior layer of fabric 1036. Also alternatively, first side edge 1010 and second side edge 1020 can be connected to exterior top edge 1034 of exterior layer of fabric 1036 to form a gap between first side edge 1010 and second side edge 1020 at exterior top edge 1034 of exterior layer of fabric 1036.

Figure 19B:
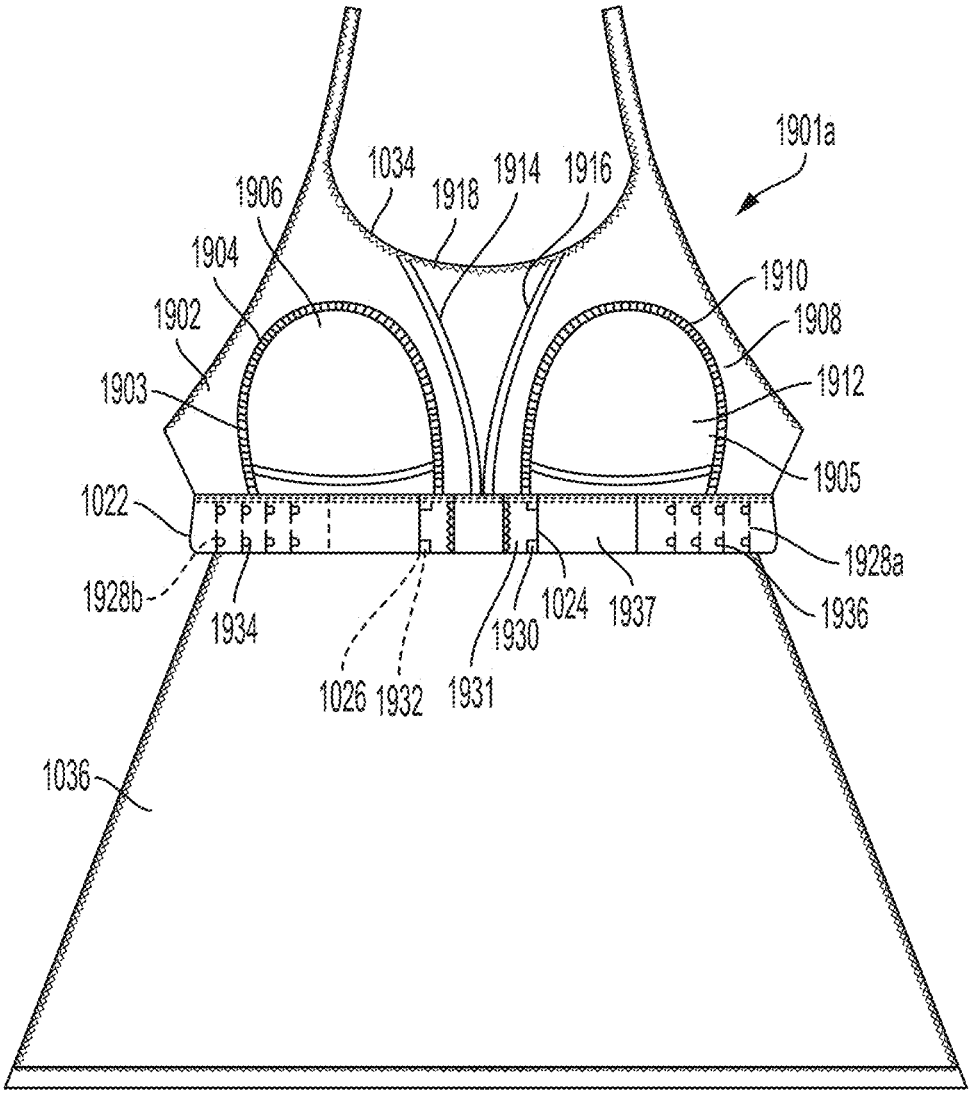
FIG. 19B is a front view of a swim top that is inside out having a modified bra assembly of FIG. 19 of the present disclosure.
Figure 20:
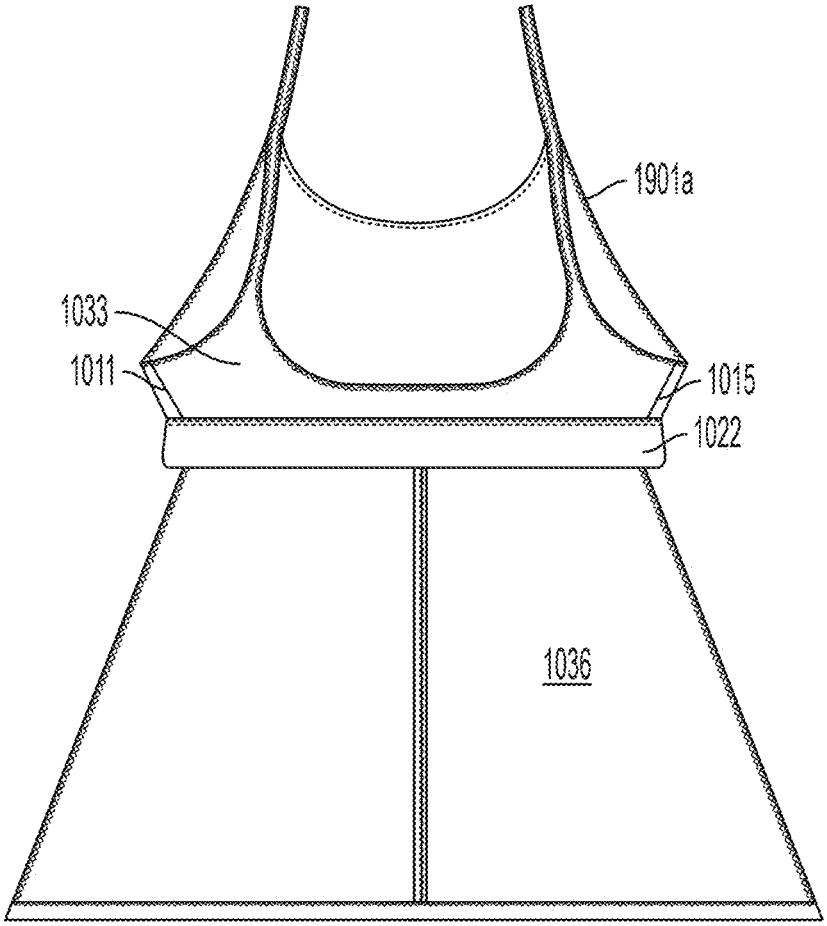
FIG. 20 is a rear view of the swim top of FIG. 19B.

Another alternative is shown in FIGS. 19B and 20. In this alternative embodiment, swim top 1901*a* is the same as swim top 1901 except (1) swim top 1901*a* has a single layer of fabric 1902, instead of being folded upon itself, with a first cup assembly 1903 having an aperture 1904 that connects to a perimeter of first cup insert 1906 and a single layer of fabric 1908, instead of being folded upon itself, with a second cup assembly 1905 having an aperture 1910 that connects to the perimeter of second cup 1912, (2) a first side edge 1914 of single layer of fabric 1902 and a second side edge 1916 of single layer of fabric 1908 are separate and not connected at top connection point 1029 but are connected to exterior top edge 1034 of exterior layer of fabric 1036 to form a gap 1918 between first side edge 1914 and second side edge 1916 at exterior top edge 1034 of exterior layer of fabric 1036, and (3) first closure 1928*a* and second closure 1928*b* are different than closure 1028. Features that are the same for swim top 1001 and swim top 1901*a* have the same reference numerals.

Single layer of fabric 1902 is not folded upon itself and has aperture 1904 that connects to the perimeter of first cup insert 1906 so that first cup insert 1906 is exposed and not covered by layers of fabric inside an interior volume. Single layer of fabric 1908 is also not folded upon itself and has aperture 1910 that connects to the perimeter of second cup insert 1912 so that second cup insert 1912 is exposed and not covered by layers of fabric inside an interior volume.

First closure 1928*a* has hooks 1930 at first end 1024 on a first side 1931 of band 1022 facing exterior layer 1036, and second closure 1928*b* has hooks 1932 at second end 1026 on a second side 1937 of band 1022 opposite first side 1931. Band 1022 has a first set of loops 1934 of second closure 1928*b* on first side 1931, and a second set of loops 1936 of first closure 1928*a* on second side 1937. Each of first set of loops 1934 and second set of loops 1936 have loops at different locations along band 1022. Accordingly, different wearers can place hooks 1930 in different of second set of loops 1936 and place hooks 1932 in different of first set of loops 1934 to vary a size of the continuous loop of band 1022, first closure 1928*a* and second closure 1928*b* to make the size of the continuous loop of band 1022 smaller or larger. Such an adjustment of the size also moves first cup insert 1906 and second cup insert 1912 closer together or further apart depending on the preference of the wearer. Single layers of fabric 1902 and 1908 overlap when each of hooks 1930 are engaged with one loop of second set of loops 1936 and each of hooks 1932 is engaged with one of first set of loops 1934. Stretch of single layers of fabric 1902 and 1908 allow horizontal, vertical, and diagonal movement of first cup insert 1906 and second cup insert 1912 to accommodate different sized breasts. Alternatively, hooks 1930, 1932, first set of loops 1934 and second set of loops 1936 can be, for example, hardware hooks, snaps, Velcro, magnets, hooks/eyes, button holes and any other closure alternative.

Figure 31:
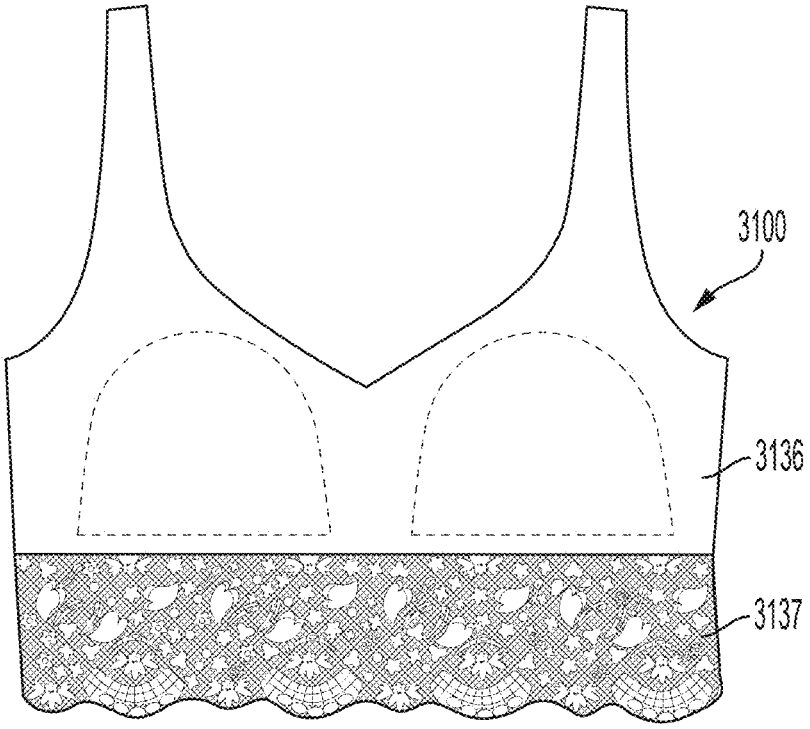
FIG. 31 is a front view of a bra assembly that is a modified bra assembly of FIG. 10 of the present disclosure.

Referring to FIG. 31, a bra assembly 3100 of the present disclosure ("bra 3100") is shown. Bra 3100 is a single bra and not incorporated into a swim top. However, bra 3100 can be incorporated into a garment, for example, a dress, a swim top, a one-piece swimsuit, a tank top, a t-shirt, an athletic-wear top, a long-sleeve shirt, a sleep top, lingerie, camisole, or any other garment that can incorporate a bra.

Bra 3100 is the same as bra 1000 except bra 3100 is incorporated into a single bra, first cup insert 1005 has bottom portion 1042 connected to only inner first ply 1002*a* and second cup insert 1007 has bottom portion 1046 connected to only inner second ply 1012*a*, and opening 1048 is through inner first ply 1002*a* and opening 1049 is through inner second ply 1012*a* and openings 1048 and 1049 are a different shape. Accordingly, the same reference numerals are used for bra 3100 as bra 1000 for like features.

Figure 32:
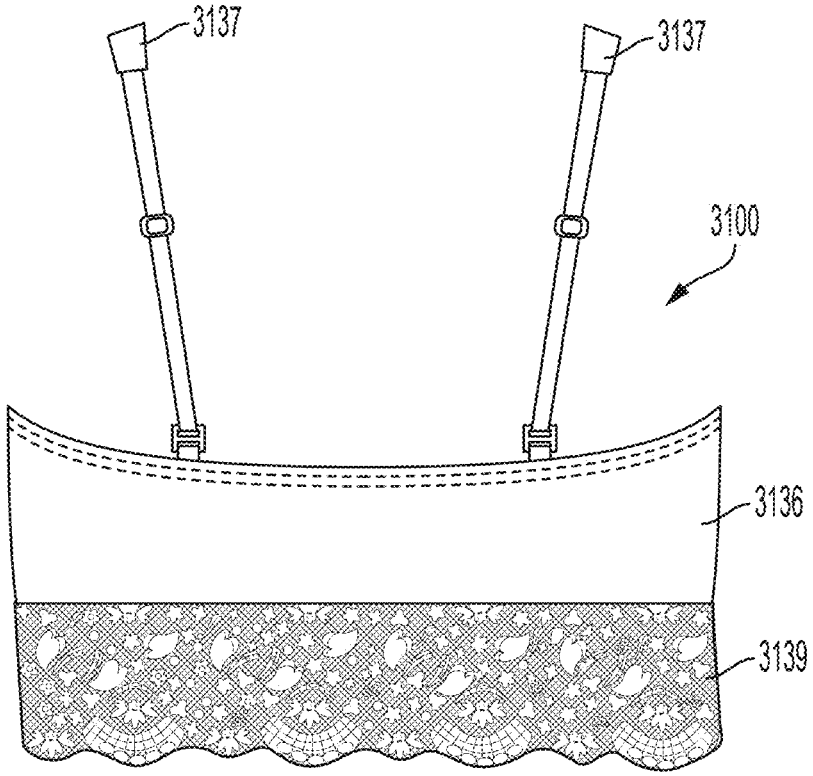
FIG. 32 is a rear view of the bra assembly of FIG. 31.
Figure 33:
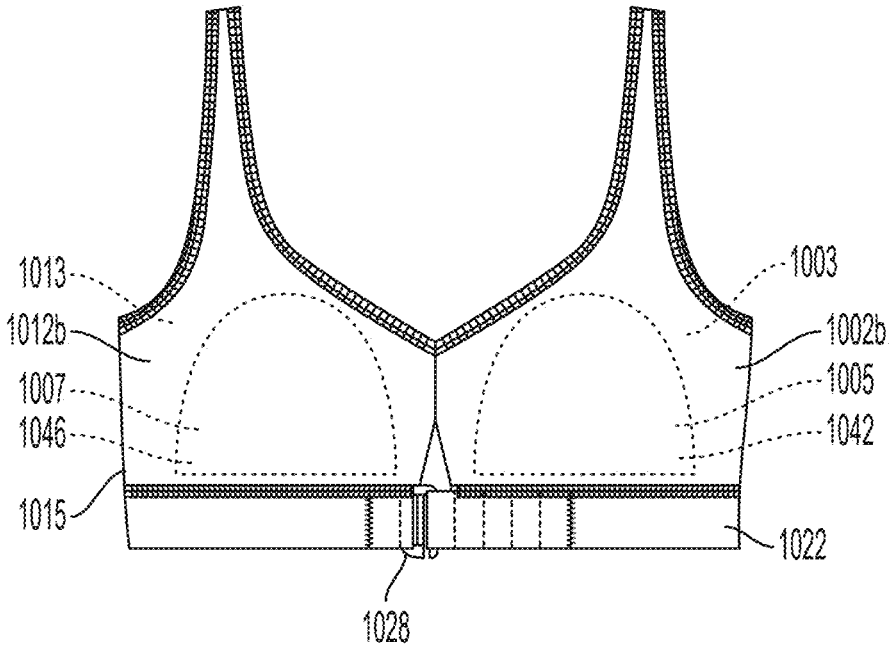
FIG. 33 is a front view of the bra assembly of FIG. 31 having an exterior layer of fabric removed.
Figure 34:
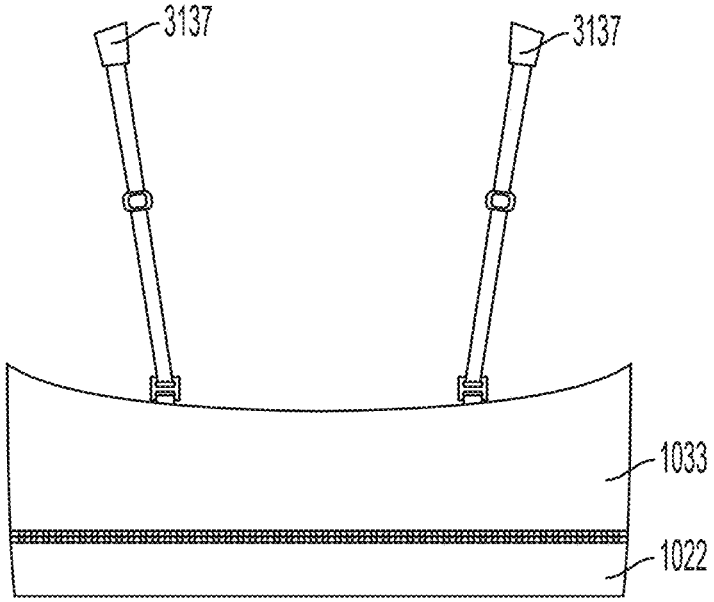
FIG. 34 is a rear view of FIG. 33.

Referring to FIG. 31, bra 3100 can be incorporated into a single bra having a neckline that is a tank top that is the same as swim top 1901 except bra 3100 is a V neckline and has an exterior layer of fabric 3136 that is a length that is shorter than exterior layer of fabric 1036 of swim top 1901 and exterior layer of fabric 3136 is molded. Exterior layer of fabric 3136 can have a decorative border 3139 made of a lace material or can be embroidery, other types of trim, solids or printed fabrics. Exterior layer of fabric 3136 can be a different material than the rest of bra 3100. Referring to FIG. 32, bra 3100 can have straps 3137 that are adjustable. Exterior layer of fabric 3136 allows the presence of closure 1028, shown in FIGS. 33 and 35, while at the same time appearing very feminine and "hiding" closure 1028 without losing the multi fitting function of closure 1028. Exterior layer of fabric 3136 can be a longer length to form a camisole, dress and/or top.

Exterior layer of fabric 3136 is molded at the location of first cup insert 1005 and second cup insert 1007, respectively. Exterior layer of fabric 3136 is bubble molded to form a convex shape when in a relaxed non-stretch state. The convex shape facilitates the horizontal, vertical and diagonal movement of first cup insert 1005 and second cup insert 1007 on the breast of the wearer during stretch of first fabric portion 1002 and second fabric portion 1012, respectively, to accommodate different sized breasts. Exterior layer of fabric 3136 can be molded similarly to the portion of first ply of fabric 1021 of first cup assembly 1004 and the portion of second ply of fabric 1043 of second cup assembly 1014 that are bubble molded to form a convex shape have a circumference from 7.5 cm to 23 cm and a depth of 0.5 cm to 17 cm having a tolerance of +/−17 percent.

Figure 35:
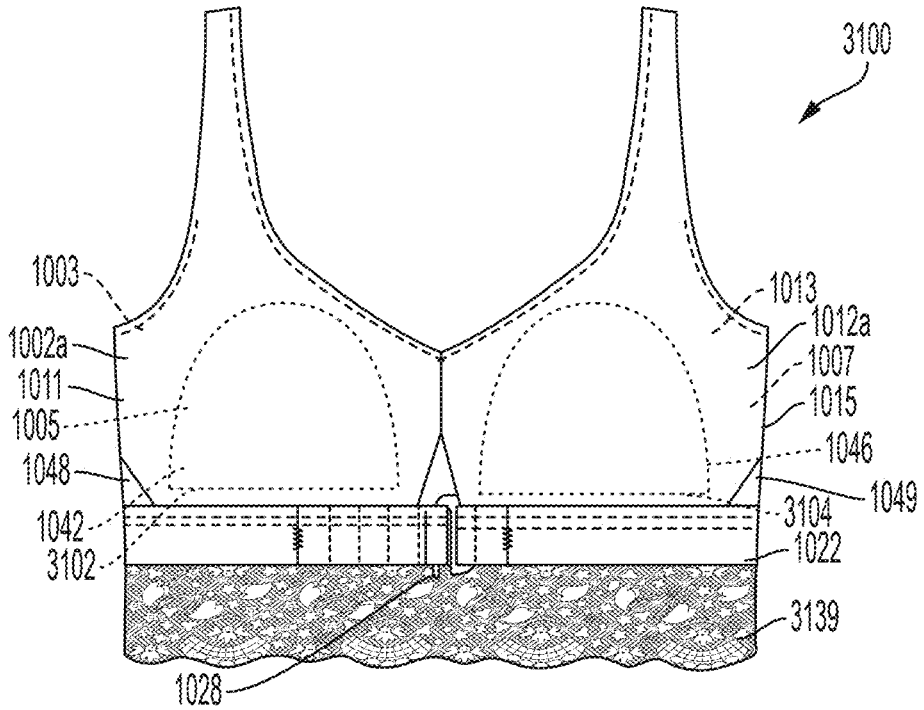
FIG. 35 is a front view of the bra assembly of FIG. 31 that is inside out.
Figure 36:
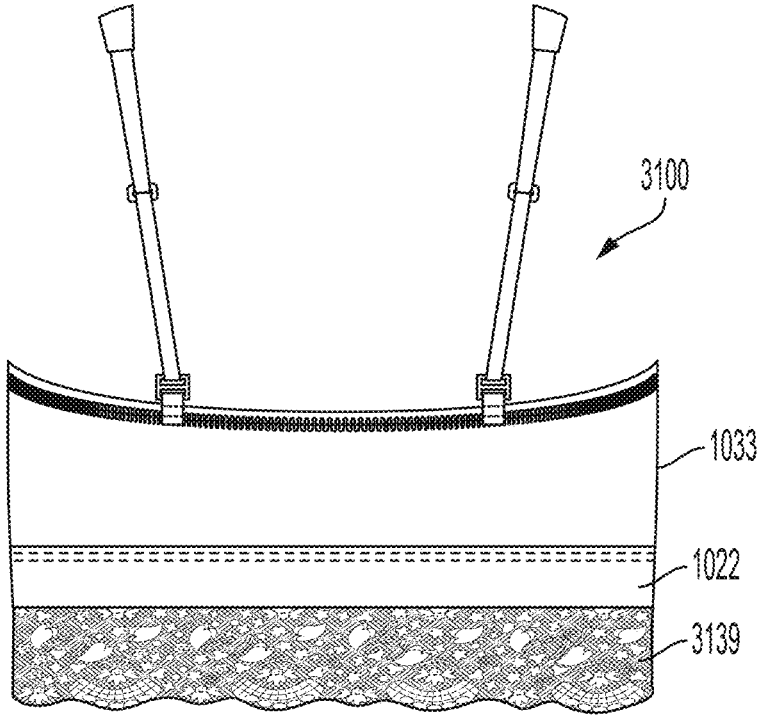
FIG. 36 is a rear view of FIG. 35.

Referring to FIG. 35, first cup insert 1005 has bottom portion 1042 connected to only inner first ply 1002*a* by stitching 3102. Bottom portion 1042 of first cup insert 1005 is not connected to outer first ply 1002*b* so that outer first ply 1002*b* can move relative to bottom portion 1042 of first cup insert 1005. Second cup insert 1007 has bottom portion 1046 connected to only inner second ply 1012*a* by stitching 3104. Bottom portion 1046 of second cup insert 1007 is not connected to outer second ply 1012*b* so that outer second ply 1012*b* can move relative to bottom portion 1046 of second cup insert 1007. First cup insert 1005 having bottom portion 1042 connected to only inner first ply 1002*a* by stitching and second cup insert 1007 having bottom portion 1046 connected to only inner second ply 1012*a* by stitching 3104 avoids wrinkling on outer first ply 1002*b* and outer second ply 1012*b* to provide a desirable aesthetic effect. Alternatively, first cup insert 1005 has bottom portion 1042 connected to only outer first ply 1002*b* by stitching and second cup insert 1007 has bottom portion 1046 connected to only outer second ply 1012*b* by stitching.

Inner first ply 1002*a* of first fabric portion 1002 has opening 1048 adjacent first cup insert 1005 to access first interior volume 1003. Inner second ply 1012*a* of second fabric portion 1012 has opening 1049 adjacent second cup insert 1007 to access second interior volume 1013. Openings 1048 and 1049 allow access interior volumes 1003 and 1013, respectively, to adjust first cup insert 1005 and second cup insert 1007, for example, to unfold first cup insert 1005 and second cup insert 1007 if they become folded. Openings 1048 and 1049 are a different shape in bra 3100 than in bra 1000, in particular, opening 1048 is a diagonal access opening located from seam 1011 to above band 1022 for entrance and opening 1049 is a diagonal access opening located from seam 1015 to above band 1022 for entrance. Opening 1048 can alternatively be through outer first ply 1002*b* and opening 1049 can alternatively be through outer second ply 1012*b*. Another alternative is openings 1048 and 1049 of bra 3100 can have the shape of openings 1048 and 1049 of bra 1000. Band 1022 is shown as 32 mm but alternatively could be 38 mm or other width that is desirable for aesthetics and fit.

Figure 41:
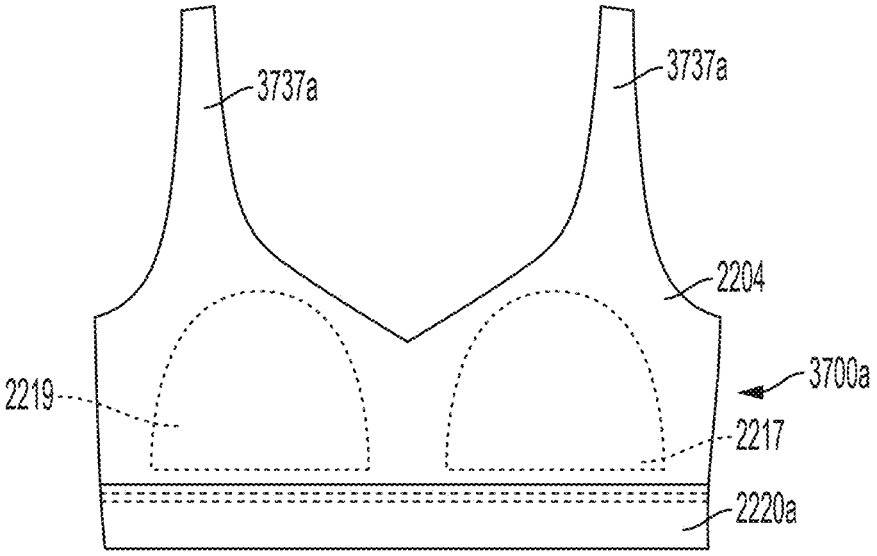
FIG. 41 is a front view of a bra assembly that is a modified bra assembly of FIG. 37 of the present disclosure.
Figure 42:
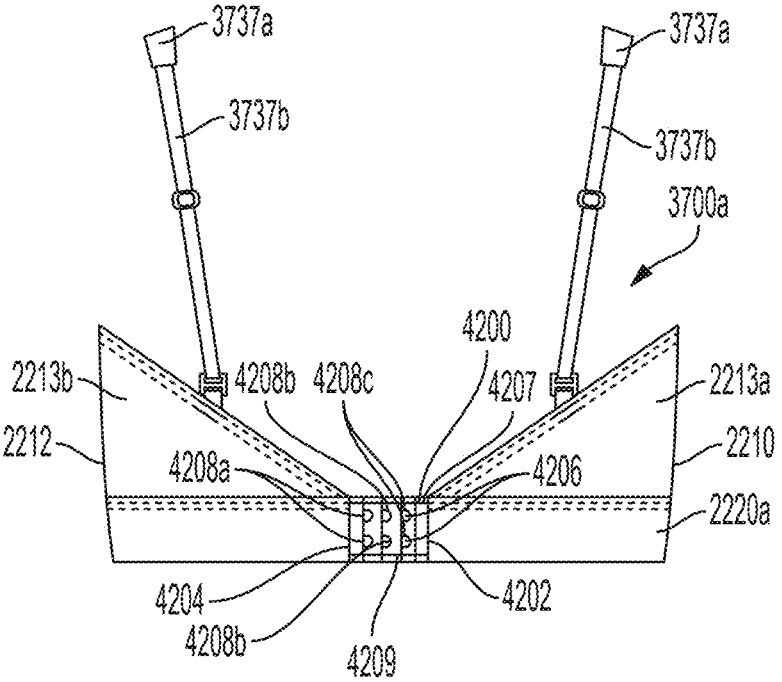
FIG. 42 is a rear view of FIG. 41.
Figure 43:
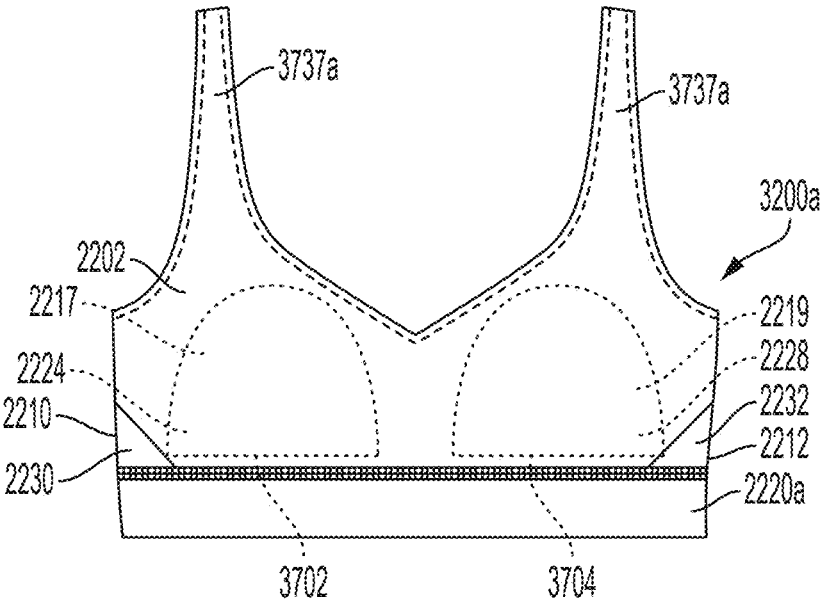
FIG. 43 is a front view of the bra assembly of FIG. 41 that is inside out.
Figure 44:
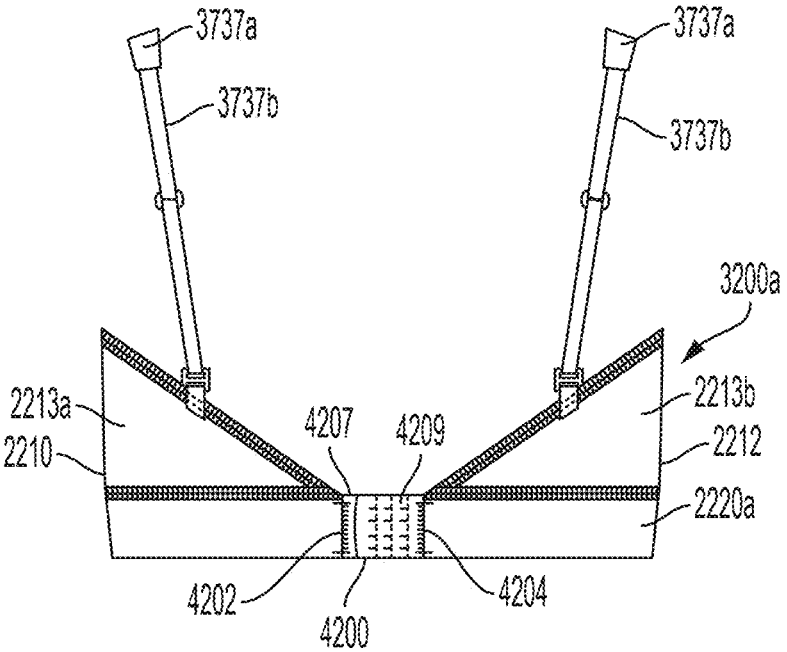
FIG. 44 is a rear view of FIG. 43.
Figure 46A:
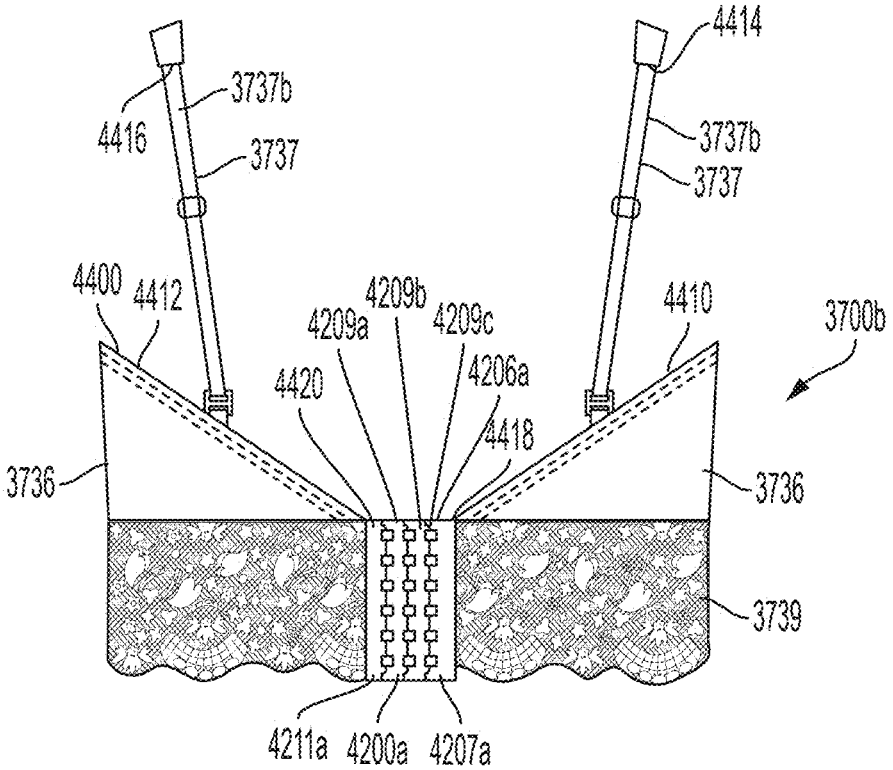
FIG. 46*a* is a rear view of FIG. 45.
Figure 46B:
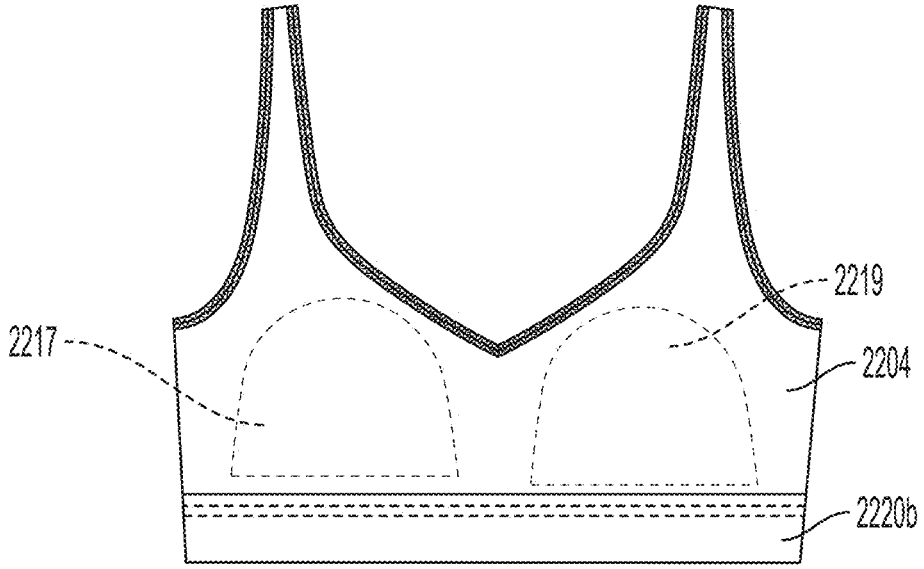
FIG. 46*b* is a front view of the bra assembly of FIG. 45 having an exterior layer of fabric removed.
Figure 47:
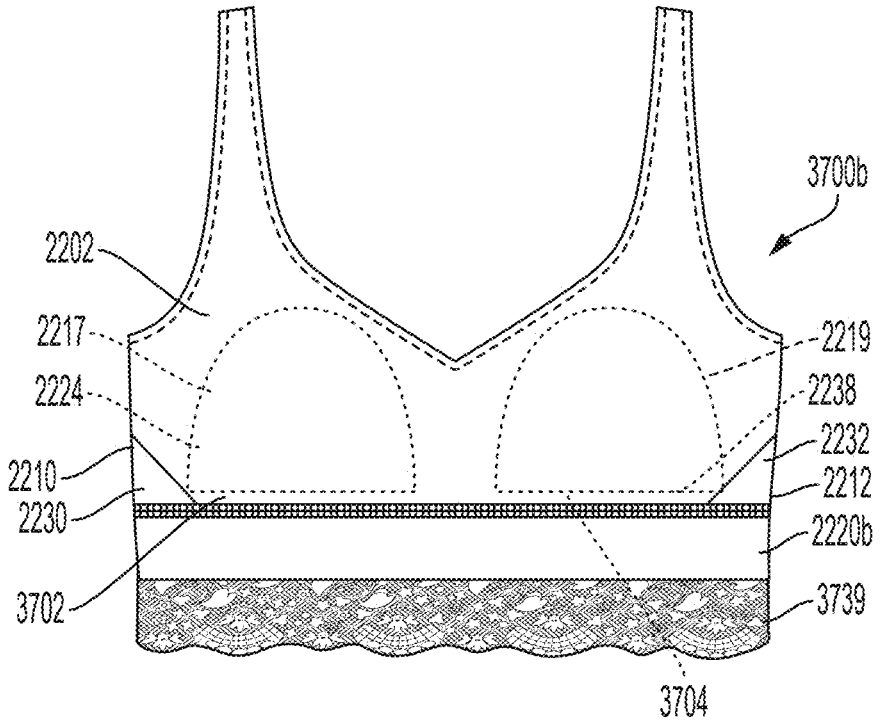
FIG. 47 is a front view of the bra assembly of FIG. 45 that is inside out.
Figure 48:
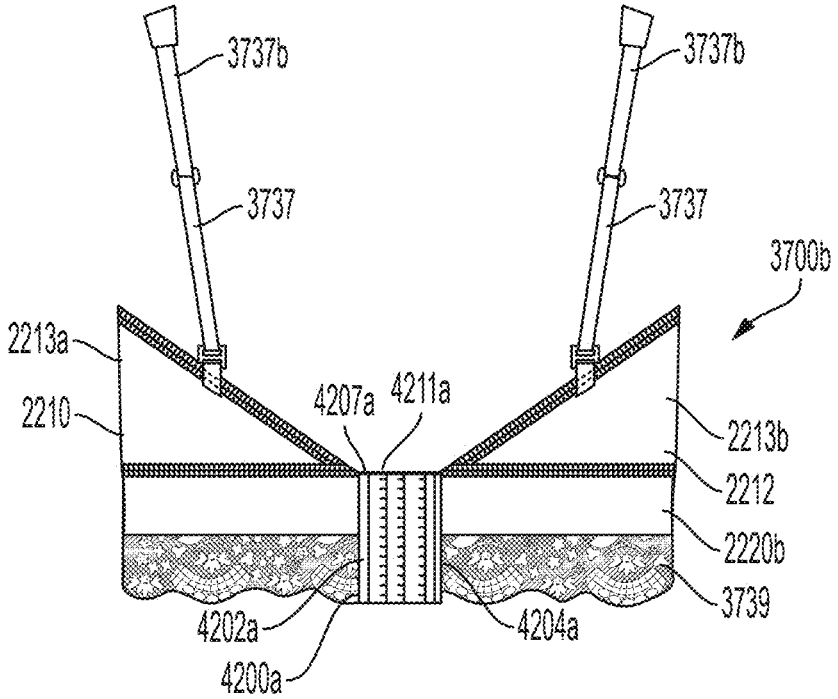
FIG. 48 is a rear view of FIG. 47.

Bra 3100 can be modified so that band 1022 is modified to band 2220*a* shown in FIG. 41 that has a separation shown in FIG. 42 forming a first end 4202 and a second end 4204 having adjustable closure assembly 4200 and back panel 2213 is modified to back panels 2213*a* and 2213*b* of FIGS. 46*a* and 48. In this alternative, exterior layer of fabric 3136 can have a separation to form ends that are each connected to first end 4202 and second end 4204, respectively, similar to exterior layer of fabric 3736, or exterior layer of fabric 3136 can omit the separation to cover first end 4202, second end 4204 and adjustable closure assembly 4200.

Bra 3100 could also be useful for maternity due to the ability for breasts to grow during the 9 months and the wearer has ability to still wear the same bra 3100 prenatal and postnatal.

Referring to the tables in FIGS. 21A-21I, these tables include each position of closure 1028 for each different size of bra 1000 and a body size that each position fits.

Figure 21A:
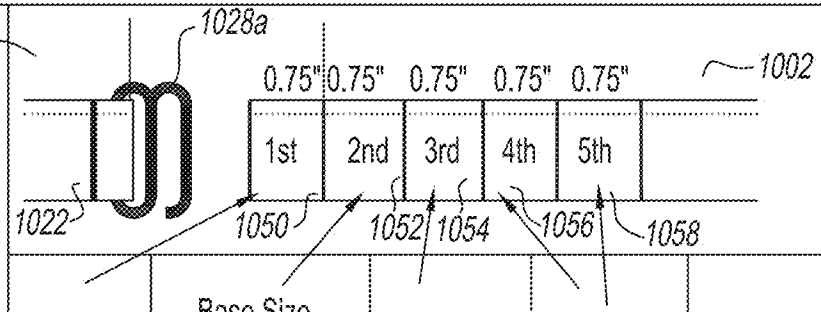
FIG. 21A is a table for an example of a size 2 swimsuit having the first embodiment of the bra assembly incorporated therein, which table lists body sizes that fit each position of the closure.

Referring to FIG. 21A, a table for an example of a size 2 swimsuit having bra assembly 1000 incorporated therein that lists body sizes that each position of closure 1028 fits is shown. When the hook of first closure connector 1028*a* is in loop 1050 in the size 2 swimsuit, bra assembly 1000 fits wearers having under bust measurements of 26 to 28 inches and cup sizes 32AA (apex measurement on the body of 32 to 33 inches), 32A (apex measurement on the body of 33 to 34 inches), 32B (apex measurement on the body of 34 to 35 inches), 32C (apex measurement on the body of 35 to 36 inches), 32D (apex measurement on the body of 36 to 37 inches) and 32DD (apex measurement on the body of 37 to 38 inches). For this table and all tables shown in FIGS. 21A-21I, the location of the apex measurement is shown in FIG. 9, for example, measurement 902. Also, the location of the under bust measurement is shown by the underband measurement of FIG. 9, for example, measurement 904. Also, the term "apex measurement" used herein means apex measurement on the body.

When the hook of first closure connector 1028*a* is in loop 1052 in the size 2 swimsuit, bra assembly 1000 fits wearers having under bust measurements of 24 to 26 inches and cup sizes 30A (apex measurement of 32 to 33 inches), 30B (apex measurement of 33 to 34 inches), 30C (apex measurement of 34 to 35 inches), 30D (apex measurement of 35 to 36 inches), 30DD (apex measurement of 36 to 37 inches) and 30DDD (apex measurement of 37 to 38 inches). When the hook of first closure connector 1028*a* is in loop 1054 in the size 2 swimsuit, bra assembly 1000 fits wearers having under bust measurements of 22 to 24 inches and cup sizes 28B (apex measurement of 32 to 33 inches), 28C (apex measurement on the body of 33 to 34 inches), 28D (apex measurement of 34 to 35 inches), 28DD (apex measurement of 35 to 36 inches), 28DDD (apex measurement of 36 to 37 inches) and 28E (apex measurement of 37 to 38 inches). When the hook of first closure connector 1028*a* is in loop 1056 in the size 2 swimsuit, bra assembly 1000 fits wearers having under bust measurements of 20 to 22 inches and cup sizes 26C (apex measurement on the body of 32 to 33 inches), 26D (apex measurement of 33 to 34 inches), 26DD (apex measurement of 34 to 35 inches), 26DDD (apex measurement y of 35 to 36 inches) and 26E (apex measurement of 36 to 37 inches). When the hook of first closure connector 1028*a* is in loop 1058 in the size 2 swimsuit, bra assembly 1000 fits wearers having under bust measurements of 18 to 20 inches and cup sizes 24D (apex measurement of 32 to 33 inches), 24DD (apex measurement on the body of 33 to 34 inches), 24DDD (apex measurement of 34 to 35 inches) and 24E (apex measurement on the body of 35 to 36 inches).

Figure 21B:
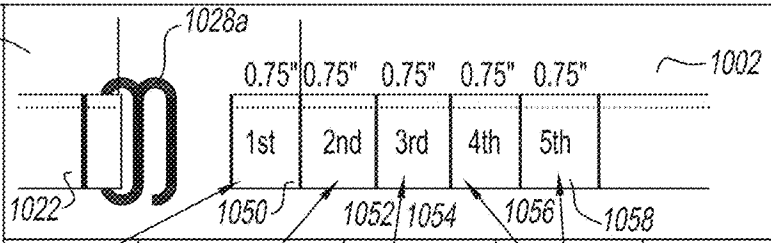
FIG. 21B is a table for an example of a size 4 swimsuit having the first embodiment of the bra assembly incorporated therein, which table lists body sizes that fit each position of the closure.

Referring to FIG. 21B, there is shown a table for an example of a size 4 swimsuit having bra assembly 1000 incorporated therein that lists body sizes that fit each position of closure 1028. When the hook of first closure connector 1028*a* is in loop 1050 in the size 4 swimsuit, bra assembly 1000 fits wearers having under bust measurements of 28 to 30 inches and cup sizes 34A (apex measurement of 34 to 35 inches), 34B (apex measurement of 35 to 36 inches), 34C (apex measurement of 36 to 37 inches), 34D (apex measurement of 37 to 38 inches), 34DD (apex measurement of 38.5 to 39.5 inches) and 34DDD (apex measurement of 39.75 to 40.75 inches). When the hook of first closure connector 1028*a* is in loop 1052 in the size 4 swimsuit, bra assembly 1000 fits wearers having under bust measurements of 26 to 28 inches and cup sizes 32A (apex measurement of 33 to 34 inches), 32B (apex measurement of 34 to 35 inches), 32C (apex measurement of 35 to 36 inches), 32D (apex measurement of 36 to 37 inches), 32DD (apex measurement of 37 to 38 inches), 32DDD (apex measurement of 38.5 to 39.5 inches) and 32E (apex measurement of 39.75 to 40.75 inches). When the hook of first closure connector 1028*a* is in loop 1054 in the size 4 swimsuit, bra assembly 1000 fits wearers having under bust measurements of 24 to 26 inches and cup sizes 30B (apex measurement of 33 to 34 inches), 30C (apex measurement of 34 to 35 inches), 30D (apex measurement of 35 to 36 inches), 30DD (apex measurement on the body of 36 to 37 inches), 30DDD (apex measurement of 37 to 38 inches), 30E (apex measurement of 38.5 to 39.5 inches) and 30F (apex measurement of 39.75 to 40.75 inches). When the hook of first closure connector 1028*a* is in loop 1056 in the size 4 swimsuit, bra assembly 1000 fits wearers having under bust measurements of 22 to 24 inches and cup sizes 28C (apex measurement of 33 to 34 inches), 28D (apex measurement of 34 to 35 inches), 28DD (apex measurement of 35 to 36 inches), 28DDD (apex measurement of 36 to 37 inches) and 28E (apex measurement of 37 to 38 inches). When the hook of first closure connector 1028*a* is in loop 1058 in the size 4 swimsuit, bra assembly 1000 fits wearers having under bust measurements of 20 to 22 inches and cup sizes 26D (apex measurement of 33 to 34 inches), 26DD (apex measurement of 34 to 35 inches), 26DDD (apex measurement of 35 to 36 inches) and 26E (apex measurement on the body of 36 to 37 inches).

Figure 21C:
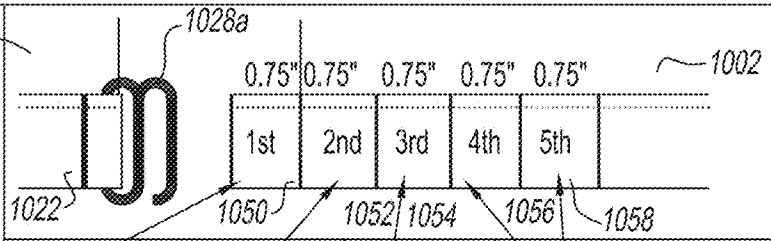
FIG. 21C is a table for an example of a size 6 swimsuit having the first embodiment of the bra assembly incorporated therein, which table lists body sizes that fit each position of the closure.

Referring to FIG. 21C, there is shown a table for an example of a size 6 swimsuit having bra assembly 1000 incorporated therein that lists body sizes that fit each position of closure 1028. When the hook of first closure connector 1028*a* is in loop 1050 in the size 6 swimsuit, bra assembly 1000 fits wearers having under bust measurements of 30 to 32 inches and cup sizes 36B (apex measurement of 36 to 37 inches), 36C (apex measurement on the body of 37 to 38 inches), 36D (apex measurement of 38.5 to 39.5 inches), 36DD (apex measurements of 39.75 to 40.75 inches), 36DDD (apex measurement of 40.75 to 42.75 inches) and 36E (apex measurement of 42.5 to 43.5 inches). When the hook of first closure connector 1028*a* is in loop 1052 in the size 6 swimsuit, bra assembly 1000 fits wearers having under bust measurements of 28 to 30 inches and cup sizes 34B (apex measurement of 35 to 36 inches), 34C (apex measurement of 36 to 37 inches), 34D (apex measurement on the body of 37 to 38 inches), 34DD (apex measurement of 38.5 to 39.5 inches), 34DDD (apex measurement 39.75 to 40.75 inches), 34E (apex measurement of 40.75 to 42.75 inches) and 34F (apex measurement of 42.5 to 43.5 inches). When the hook of first closure connector 1028*a* is in loop 1054 in the size 6 swimsuit, bra assembly 1000 fits wearers having under bust measurements of 26 to 28 inches and cup sizes 32B (apex measurement of 34 to 35 inches), 32C (apex measurement of 35 to 36 inches), 32D (apex measurement on the body of 36 to 37 inches), 32DD (apex measurement of 37 to 38 inches), 32DDD (apex measurement of 38.5 to 39.5 inches), 32E (apex measurement of 39.75 to 40.75 inches), 32F (apex measurement of 40.75 to 42.75 inches) and 32G (apex measurement of 42.5 to 43.5 inches). When the hook of first closure connector 1028*a* is in loop 1056 in the size 6 swimsuit, bra assembly 1000 fits wearers having under bust measurements of 24 to 26 inches and cup sizes 30C (apex measurement of 34 to 35 inches), 30D (apex measurement of 35 to 36 inches), 30DD (apex measurement of 36 to 37 inches), 30DDD (apex measurement of 37 to 38 inches), 30E (apex measurement of 38.5 to 39.5 inches) and 30F (apex measurement of 39.75 to 40.75 inches). When the hook of first closure connector 1028*a* is in loop 1058 in the size 6 swimsuit, bra assembly 1000 fits wearers having under bust measurements of 22 to 24 inches and cup sizes 28D (apex measurement of 34 to 35 inches), 28DD (apex measurement of 35 to 36 inches), 28DDD (apex measurement of 36 to 37 inches) and 28E (apex measurement of 37 to 38 inches).

Figure 21D:
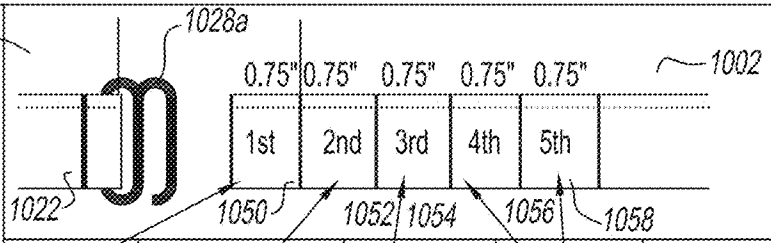
FIG. 21D is a table for an example of a size 8 swimsuit having the first embodiment of the bra assembly incorporated therein, which table lists body sizes that fit each position of the closure.

Referring to FIG. 21D, there is shown a table for an example of a size 8 swimsuit having bra assembly 1000 incorporated therein that lists body sizes that fit each position of closure 1028. When the hook of first closure connector 1028*a* is in loop 1050 in the size 8 swimsuit, bra assembly 1000 fits wearers having under bust measurements of 32 to 34 inches and cup sizes 38B (apex measurement of 37 to 38 inches), 38C (apex measurement y of 38.5 to 39.5 inches), 38D (apex measurement of 39.75 to 40.75 inches) and 38DD (apex measurement of 40.75 to 42.75 inches). When the hook of first closure connector 1028*a* is in loop 1052 in the size 8 swimsuit, bra assembly 1000 fits wearers having under bust measurements of 30 to 32 inches and cup sizes 36B (apex measurement of 36 to 37 inches), 36C (apex measurement on the body of 37 to 38 inches), 36D (apex measurement of 38.5 to 39.5 inches), 36DD (apex measurement of 39.75 to 40.75 inches), 36DDD (apex measurement of 40.75 to 42.75 inches), 36E (apex measurement of 42.5 to 43.5 inches) and 36F (apex measurement of 43.5 to 44.5 inches). When the hook of first closure connector 1028*a* is in loop 1054 in the size 8 swimsuit, bra assembly 1000 fits wearers having under bust measurements of 28 to 30 inches and cup sizes 34B (apex measurement of 35 to 36 inches), 34C (apex measurements of 36 to 37 inches), 34D (apex measurement of 37 to 38 inches), 34DD (apex measurement of 38.5 to 39.5 inches), 34DDD (apex measurement of 39.75 to 40.75 inches), 34E (apex measurement of 40.75 to 42.75 inches), 34F (apex measurement of 42.5 to 43.5 inches) and 34G (apex measurement of 43.5 to 44.5 inches). When the hook of first closure connector 1028*a* is in loop 1056 in the size 8 swimsuit, bra assembly 1000 fits wearers having under bust measurements of 26 to 28 inches and cup sizes 32C (apex measurement of 35 to 36 inches), 32D (apex measurement of 36 to 37 inches), 32DD (apex measurement of 37 to 38 inches), 32DDD (apex measurement of 38.5 to 39.5 inches), 32E (apex measurement of 39.75 to 40.75 inches), 32F (apex measurement of 40.75 to 42.75 inches) and 32G (apex measurements of 42.5 to 43.5 inches). When the hook of first closure connector 1028*a* is in loop 1058 in the size 8 swimsuit, bra assembly 1000 fits wearers having under bust measurements of 24 to 26 inches and cup sizes 30D (apex measurement of 35 to 36 inches), 30DD (apex measurement of 36 to 37 inches), 30DDD (apex measurement of 37 to 38 inches), 30E (apex measurement of 38.5 to 39.5 inches), 30F (apex measurement of 39.75 to 40.75 inches) and 30G (apex measurement of 40.75 to 42.75 inches).

Figure 21E:
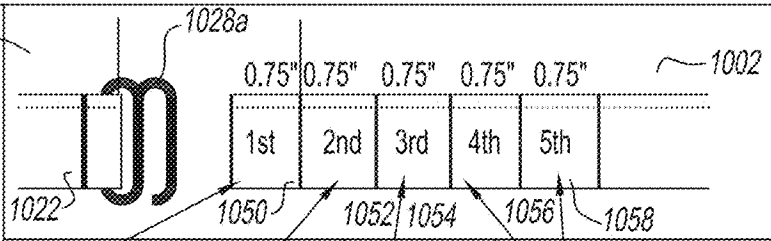
FIG. 21E is a table for an example of a size 10 swimsuit having the first embodiment of the bra assembly incorporated therein, which table lists body sizes that fit each position of the closure.

Referring to FIG. 21E, there is shown a table for an example of a size 10 swimsuit having bra assembly 1000 incorporated therein that lists body sizes that fit each position of closure 1028. When the hook of first closure connector 1028*a* is in loop 1050 in the size 10 swimsuit, bra assembly 1000 fits wearers having under bust measurements of 34 to 36 inches and cup sizes 40B (apex measurement of 38.5 to 39.5 inches), 40C (apex measurement of 39.75 to 40.75 inches), 40D (apex measurement of 40.75 to 42.75 inches) and 40DD (apex measurement of 42.5 to 43.5 inches). When the hook of first closure connector 1028*a* is in loop 1052 in the size 10 swimsuit, bra assembly 1000 fits wearers having under bust measurements of 32 to 34 inches and cup sizes 38B (apex measurement of 37 to 38 inches), 38C (apex measurement of 38.5 to 39.5 inches), 38D (apex measurement of 39.75 to 40.75 inches), 38DD (apex measurement of 40.75 to 42.75 inches), 38DDD (apex measurement of 42.5 to 43.5 inches) and 38E (apex measurement of 43.5 to 44.5 inches). When the hook of first closure connector 1028*a* is in loop 1054 in the size 10 swimsuit, bra assembly 1000 fits wearers having under bust measurements of 30 to 32 inches and cup sizes 36B (apex measurement of 36 to 37 inches), 36C (apex measurement of 37 to 38 inches), 36D (apex measurement of 38.5 to 39.5 inches), 36DD (apex measurement of 39.75 to 40.75 inches), 36DDD (apex measurement of 40.75 to 42.75 inches), 36E (apex measurement of 42.5 to 43.5 inches), 36F (apex measurement of 43.5 to 44.5 inches) and 36G (apex measurement of 44.5 to 45.5 inches). When the hook of first closure connector 1028*a* is in loop 1056 in the size 10 swimsuit, bra assembly 1000 fits wearers having under bust measurements of 28 to 30 inches and cup sizes 34C (apex measurement of 36 to 37 inches), 34D (apex measurement of 37 to 38 inches), 34DD (apex measurement of 38.5 to 39.5 inches), 34DDD (apex measurement of 39.75 to 40.75 inches), 34E (apex measurement of 40.75 to 42.75 inches), 34F (apex measurement of 42.5 to 43.5 inches), 34G (apex measurement of 43.5 to 44.5 inches) and 34H (apex measurement of 44.5 to 45.5 inches). When the hook of first closure connector 1028*a* is in loop 1058 in the size 10 swimsuit, bra assembly 1000 fits wearers having under bust measurements of 26 to 28 inches and cup sizes 32D (apex measurement of 36 to 37 inches), 32DD (apex measurement of 37 to 38 inches), 32DDD (apex measurement of 38.5 to 39.5 inches), 32E (apex measurement of 39.75 to 40.75 inches), 32F (apex measurement of 40.75 to 42.75 inches) and 32G (apex measurement of 42.5 to 43.5 inches).

Figure 21F:
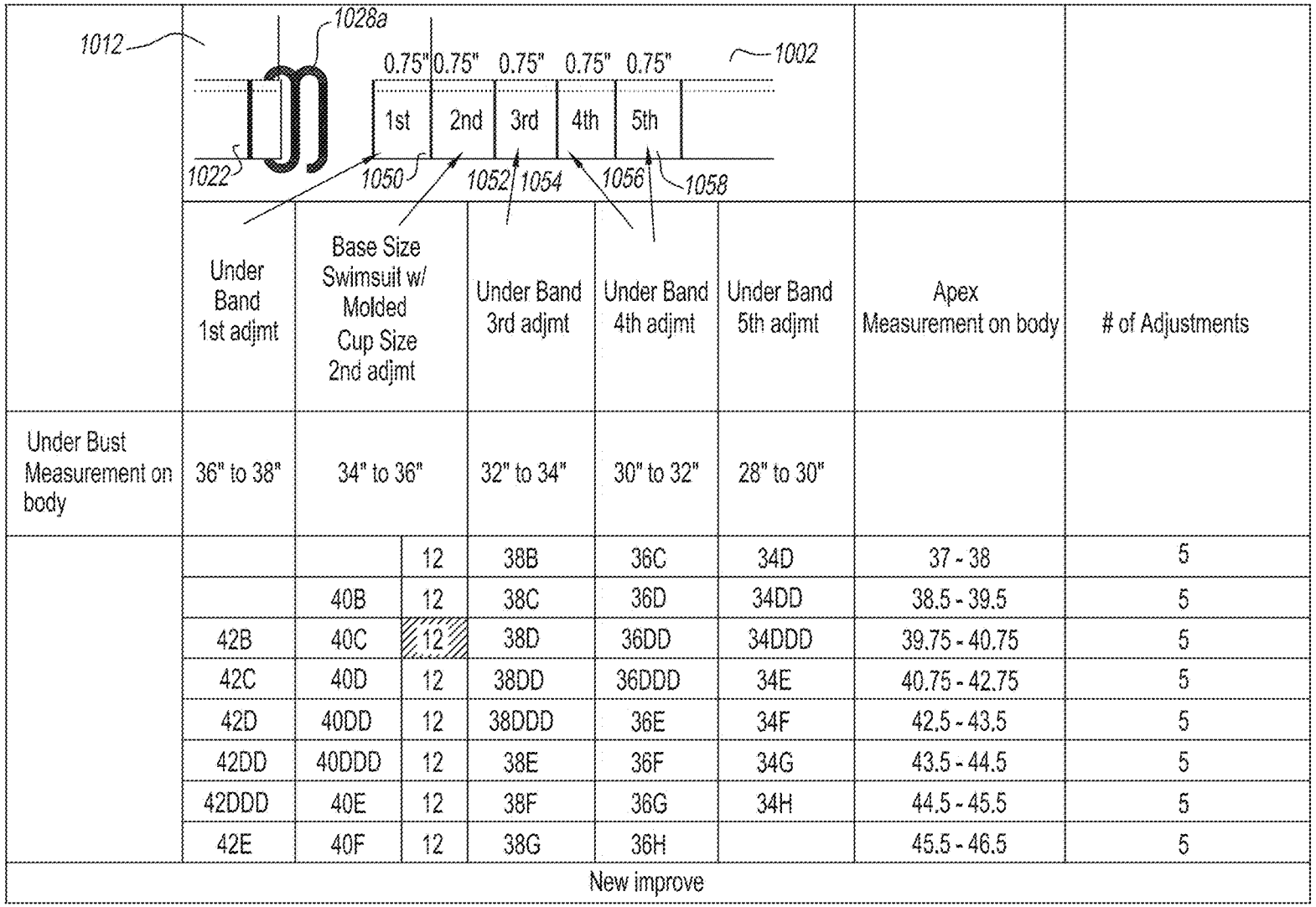
FIG. 21F is a table for an example of a size 12 swimsuit having the first embodiment of the bra assembly incorporated therein, which table lists body sizes that fit each position of the closure.

Referring to FIG. 21F, there is a table for an example of a size 12 swimsuit having bra assembly 1000 incorporated therein that lists body sizes that fit each position of closure 1028. When the hook of first closure connector 1028*a* is in loop 1050 in the size 12 swimsuit, bra assembly 1000 fits wearers having under bust measurements of 36 to 38 inches and cup sizes 42B (apex measurement of 39.75 to 40.75 inches), 42C (apex measurements on the body of 40.75 to 42.75 inches), 42D (apex measurement of 42.5 to 43.5 inches), 42DD (apex measurement of 43.5 to 44.5 inches), 42DDD (apex measurement of 44.5 to 45.5 inches) and 42E (apex measurement of 45.5 to 46.5 inches). When the hook of first closure connector 1028*a* is in loop 1052 in the size 12 swimsuit, bra assembly 1000 fits wearers having under bust measurements of 34 to 36 inches and cup sizes 40B (apex measurement of 38.5 to 39.5 inches), 40C (apex measurement of 39.75 to 40.75 inches), 40D (apex measurement of 40.75 to 42.75 inches), 40DD (apex measurement of 42.5 to 43.5 inches), 40DDD (apex measurement of 43.5 to 44.5 inches), 40E (apex measurement of 44.5 to 45.5 inches) and 40F (apex measurement of 45.5 to 46.5 inches). When the hook of first closure connector 1028*a* is in loop 1054 in the size 12 swimsuit, bra assembly 1000 fits wearers having under bust measurements of 32 to 34 inches and cup sizes 38B (apex measurement of 37 to 38 inches), 38C (apex measurement of 38.5 to 39.5 inches), 38D (apex measurement of 39.75 to 40.75 inches), 38DD (apex measurement of 40.75 to 42.75 inches), 38DDD (apex measurement of 42.5 to 43.5 inches), 38E (apex measurement of 43.5 to 44.5 inches), 38F (apex measurement of 44.5 to 45.5 inches) and 38G (apex measurement of 45.5 to 46.5 inches). When the hook of first closure connector 1028*a* is in loop 1056 in the size 12 swimsuit, bra assembly 1000 fits wearers having under bust measurements of 30 to 32 inches and cup sizes 36C (apex measurement of 37 to 38 inches), 36D (apex measurement of 38.5 to 39.5 inches), 36DD (apex measurement of 39.75 to 40.75 inches), 36DDD (apex measurement of 40.75 to 42.75 inches), 36E (apex measurement of 42.5 to 43.5 inches), 36F (apex measurement of 43.5 to 44.5 inches), 36G (apex measurement of 44.5 to 45.5 inches) and 36H (apex measurement of 45.5 to 46.5 inches). When the hook of first closure connector 1028*a* is in loop 1058 in the size 12 swimsuit, bra assembly 1000 fits wearers having under bust measurements of 28 to 30 inches and cup sizes 34D (apex measurement of 37 to 38 inches), 34DD (apex measurement of 38.5 to 39.5 inches), 34DDD (apex measurement of 39.75 to 40.75 inches), 34E (apex measurement of 40.75 to 42.75 inches), 34F (apex measurement of 42.5 to 43.5 inches), 34G (apex measurement of 43.5 to 44.5 inches) and 34H (apex measurement of 44.5 to 45.5 inches).

Figure 21G:
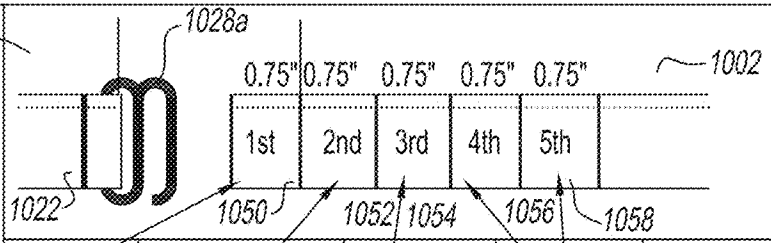
FIG. 21G is a table for an example of a size 14 swimsuit having the first embodiment of the bra assembly incorporated therein, which table lists body sizes that fit each position of the closure.

Referring to FIG. 21G, there is shown a table for an example of a size 14 swimsuit having bra assembly 1000 incorporated therein that lists body sizes that fit each position of closure 1028. When the hook of first closure connector 1028*a* is in loop 1050 in the size 14 swimsuit, bra assembly 1000 fits wearers having under bust measurements of 38 to 40 inches and cup sizes 44B (apex measurement of 40.75 to 42.75 inches), 44C (apex measurement of 42.5 to 43.5 inches), 44D (apex measurement of 43.5 to 44.5 inches), 44DD (apex measurement of 44.5 to 45.5 inches), 44DDD (apex measurement of 45.5 to 46.5 inches) and 44E (apex measurement of 46.5 to 47.5 inches). When the hook of first closure connector 1028*a* is in loop 1052 in the size 14 swimsuit, bra assembly 1000 fits wearers having under bust measurements of 36 to 38 inches and cup sizes 42B (apex measurement of 39.75 to 40.75 inches), 42C (apex measurement of 40.75 to 42.75 inches), 42D (apex measurement of 42.5 to 43.5 inches), 42DD (apex measurement of 43.5 to 44.5 inches), 42DDD (apex measurement of 44.5 to 45.5 inches), 42E (apex measurement of 45.5 to 46.5 inches) and 42F (apex measurement of 46.5 to 47.5 inches). When the hook of first closure connector 1028*a* is in loop 1054 in the size 14 swimsuit, bra assembly 1000 fits wearers having under bust measurements of 34 to 36 inches and cup sizes 40B (apex measurement of 38.5 to 39.5 inches), 40C (apex measurement of 39.75 to 40.75 inches), 40D (apex measurement of 40.75 to 42.75 inches), 40DD (apex measurement of 42.5 to 43.5 inches), 40DDD (apex measurement of 43.5 to 44.5 inches), 40E (apex measurement of 44.5 to 45.5 inches), 40F (apex measurement of 45.5 to 46.5 inches) and 40G (apex measurement of 46.5 to 47.5 inches). When the hook of first closure connector 1028*a* is in loop 1056 in the size 14 swimsuit, bra assembly 1000 fits wearers having under bust measurements of 32 to 34 inches and cup sizes 38C (apex measurement of 38.5 to 39.5 inches), 38D (apex measurement of 39.75 to 40.75 inches), 38DD (apex measurement of 40.75 to 42.75 inches), 38DDD (apex measurement of 42.5 to 43.5 inches), 38E (apex measurement of 43.5 to 44.5 inches), 38F (apex measurement of 44.5 to 45.5 inches), 38G (apex measurement of 45.5 to 46.5 inches) and 38H (apex measurement of 46.5 to 47.5 inches). When the hook of first closure connector 1028*a* is in loop 1058 in the size 14 swimsuit, bra assembly 1000 fits wearers having under bust measurements of 30 to 32 inches and cup sizes 36D (apex measurement of 38.5 to 39.5 inches), 36DD (apex measurement of 39.75 to 40.75 inches), 36DDD (apex measurement of 40.75 to 42.75 inches), 36E (apex measurement of 42.5 to 43.5 inches), 36F (apex measurement of 43.5 to 44.5 inches), 36G (apex measurement of 44.5 to 45.5 inches) and 36H (apex measurement of 45.5 to 46.5 inches).

Figure 21H:
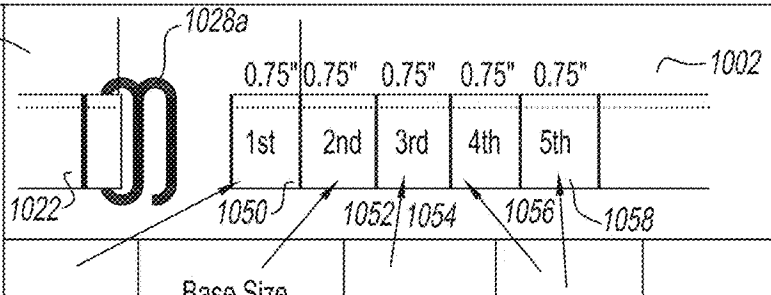
FIG. 21H is a table for an example of a size 16 swimsuit having the first embodiment of the bra assembly incorporated therein, which table lists body sizes that fit each position of the closure.

Referring to FIG. 21H, there is shown a table for an example of a size 16 swimsuit having bra assembly 1000 incorporated therein that lists body sizes that fit each position of closure 1028. When the hook of first closure connector 1028*a* is in loop 1050 in the size 16 swimsuit, bra assembly 1000 fits wearers having under bust measurements of 40 to 42 inches and cup sizes 46B (apex measurement of 42.5 to 43.5 inches), 46C (apex measurement of 43.5 to 44.5 inches), 46D (apex measurement of 44.5 to 45.5 inches), 46DD (apex measurement of 45.5 to 46.5 inches), 46DDD (apex measurement of 46.5 to 47.5 inches) and 46E (apex measurement of 47.5 to 48.5 inches). When the hook of first closure connector 1028*a* is in loop 1052 in the size 16 swimsuit, bra assembly 1000 fits wearers having under bust measurements of 38 to 40 inches and cup sizes 44B (apex measurement of 40.75 to 42.75 inches), 44C (apex measurement of 42.5 to 43.5 inches), 44D (apex measurement of 43.5 to 44.5 inches), 44DD (apex measurement of 44.5 to 45.5 inches), 44DDD (apex measurement of 45.5 to 46.5 inches), 44E (apex measurement of 46.5 to 47.5 inches) and 44F (apex measurement of 47.5 to 48.5 inches). When the hook of first closure connector 1028*a* is in loop 1054 in the size 16 swimsuit, bra assembly 1000 fits wearers having under bust measurements of 36 to 38 inches and cup sizes 42B (apex measurement of 39.75 to 40.75), 42C (apex measurement of 40.75 to 42.75 inches), 42D (apex measurement of 42.5 to 43.5 inches), 42DD (apex measurement of 43.5 to 44.5 inches), 42DDD (apex measurement of 44.5 to 45.5 inches), 42E (apex measurement of 45.5 to 46.5 inches), 42F (apex measurement of 46.5 to 47.5 inches) and 42G (apex measurements on the body of 47.5 to 48.5 inches). When the hook of first closure connector 1028*a* is in loop 1056 in the size 16 swimsuit, bra assembly 1000 fits wearers having under bust measurements of 34 to 36 inches and cup sizes 40C (apex measurement of 39.75 to 40.75), 40D (apex measurement of 40.75 to 42.75 inches), 40DD (apex measurement of 42.5 to 43.5 inches), 40DDD (apex measurement of 43.5 to 44.5 inches), 40E (apex measurement of 44.5 to 45.5 inches), 40F (apex measurement of 45.5 to 46.5 inches), 40G (apex measurement of 46.5 to 47.5 inches) and 40H (apex measurement of 47.5 to 48.5 inches). When the hook of first closure connector 1028*a* is in loop

1058 in the size 16 swimsuit, bra assembly 1000 fits wearers having under bust measurements of 32 to 34 inches and cup sizes 38D (apex measurement of 39.75 to 40.75), 38DD (apex measurement of 40.75 to 42.75 inches), 38DDD (apex measurement of 42.5 to 43.5 inches), 38E (apex measurement of 43.5 to 44.5 inches), 38F (apex measurement of 44.5 to 45.5 inches), 38G (apex measurements on the body of 45.5 to 46.5 inches) and 38H (apex measurement of 46.5 to 47.5 inches).

Figure 21I:
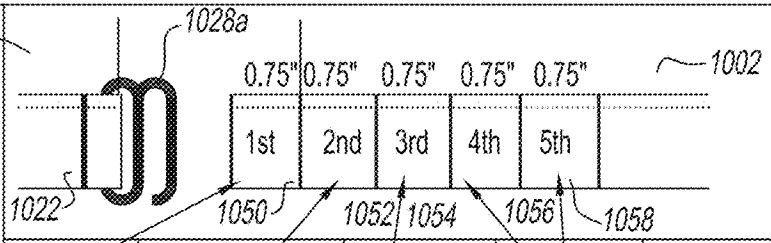
FIG. 21I is a table for an example of a size 18 swimsuit having the first embodiment of the bra assembly incorporated therein, which table lists body sizes that fit each position of the closure.

Referring to FIG. 21I, there is shown a table for an example of a size 18 swimsuit having bra assembly 1000 incorporated therein that lists body sizes that fit each position of closure 1028. When the hook of first closure connector 1028*a* is in loop 1050 in the size 18 swimsuit, bra assembly 1000 fits wearers having under bust measurements of 42 to 44 inches and cup sizes 48C (apex measurement of 44.5 to 45.5 inches), 48D (apex measurement of 45.5 to 46.5 inches), 48DD (apex measurement of 46.5 to 47.5 inches), 48DDD (apex measurement of 47.5 to 48.5 inches) and 48E (apex measurements on the body of 48.5 to 50.5 inches). When the hook of first closure connector 1028*a* is in loop 1052 in the size 18 swimsuit, bra assembly 1000 fits wearers having under bust measurements of 40 to 42 inches and cup sizes 46C (apex measurement of 43.5 to 44.5 inches), 46D (apex measurement of 44.5 to 45.5 inches), 46DD (apex measurement of 45.5 to 46.5 inches), 46DDD (apex measurement of 46.5 to 47.5 inches), 46E (apex measurement of 47.5 to 48.5 inches) and 46F (apex measurement of 48.5 to 50.5 inches). When the hook of first closure connector 1028*a* is in loop 1054 in the size 18 swimsuit, bra assembly 1000 fits wearers having under bust measurements of 38 to 40 inches and cup sizes 44C (apex measurement of 42.5 to 43.5 inches), 44D (apex measurement of 43.5 to 44.5 inches), 44DD (apex measurement of 44.5 to 45.5 inches), 44DDD (apex measurement of 45.5 to 46.5 inches), 44E (apex measurement of 46.5 to 47.5 inches), 44F (apex measurement of 47.5 to 48.5 inches) and 44G (apex measurement of 48.5 to 50.5 inches). When the hook of first closure connector 1028*a* is in loop 1056 in the size 18 swimsuit, bra assembly 1000 fits wearers having under bust measurements of 36 to 38 inches and cup sizes 42C (apex measurement of 40.75 to 42.75 inches), 42D (apex measurement of 42.5 to 43.5 inches), 42DD (apex measurement of 43.5 to 44.5 inches), 42DDD (apex measurement of 44.5 to 45.5 inches), 42E (apex measurement of 45.5 to 46.5 inches), 42F (apex measurement of 46.5 to 47.5 inches), 42G (apex measurement of 47.5 to 48.5 inches) and 42H (apex measurement of 48.5 to 50.5 inches). When the hook of first closure connector 1028*a* is in loop 1058 in the size 18 swimsuit, bra assembly 1000 fits wearers having under bust measurements of 34 to 36 inches and cup sizes 40D (apex measurement of 40.75 to 42.75 inches), 40DD (apex measurement of 42.5 to 43.5 inches), 40DDD (apex measurement of 43.5 to 44.5 inches), 40E (apex measurements on the body of 44.5 to 45.5 inches), 40F (apex measurement of 45.5 to 46.5 inches), 40G (apex measurement of 46.5 to 47.5 inches) and 40H (apex measurement of 47.5 to 48.5 inches).

Figure 22:
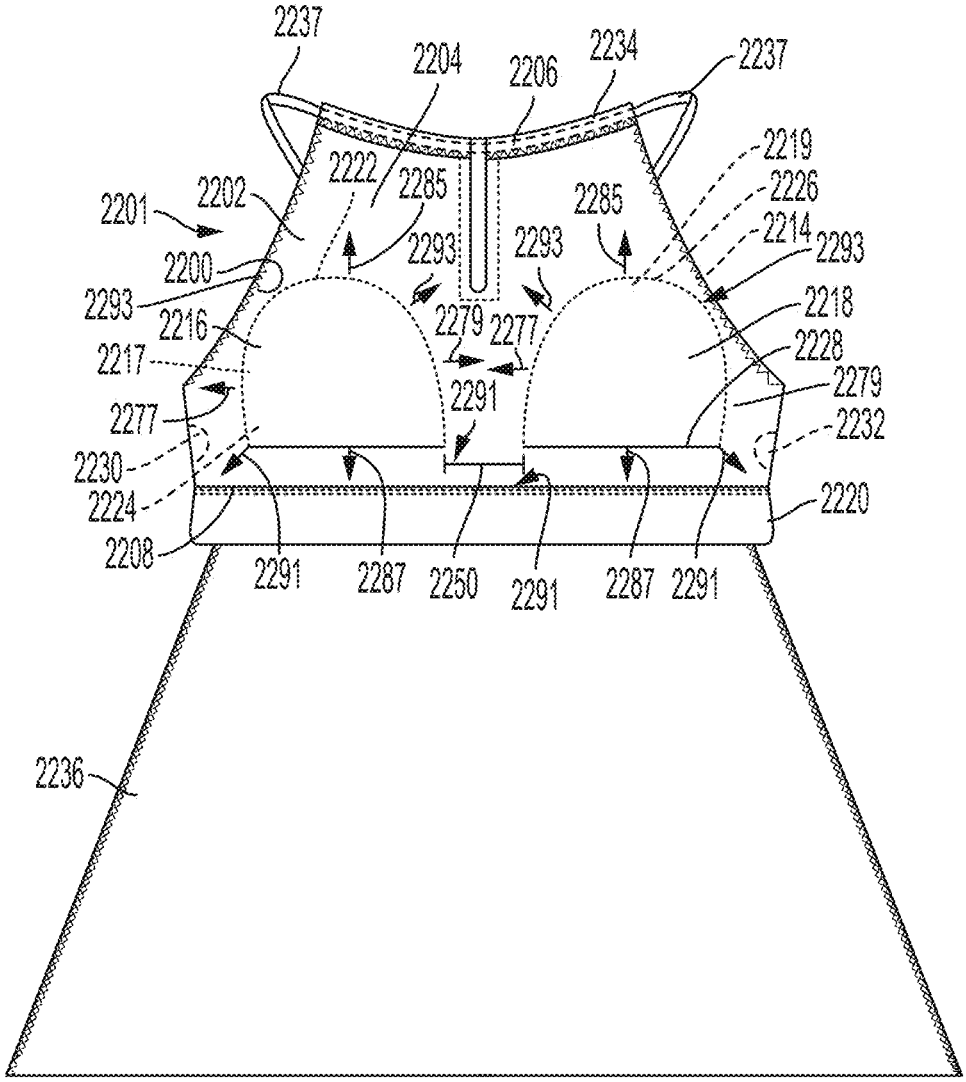
FIG. 22 is a front view of a swim top that is inside out having a second embodiment of a bra assembly of the present disclosure.
Figure 23:
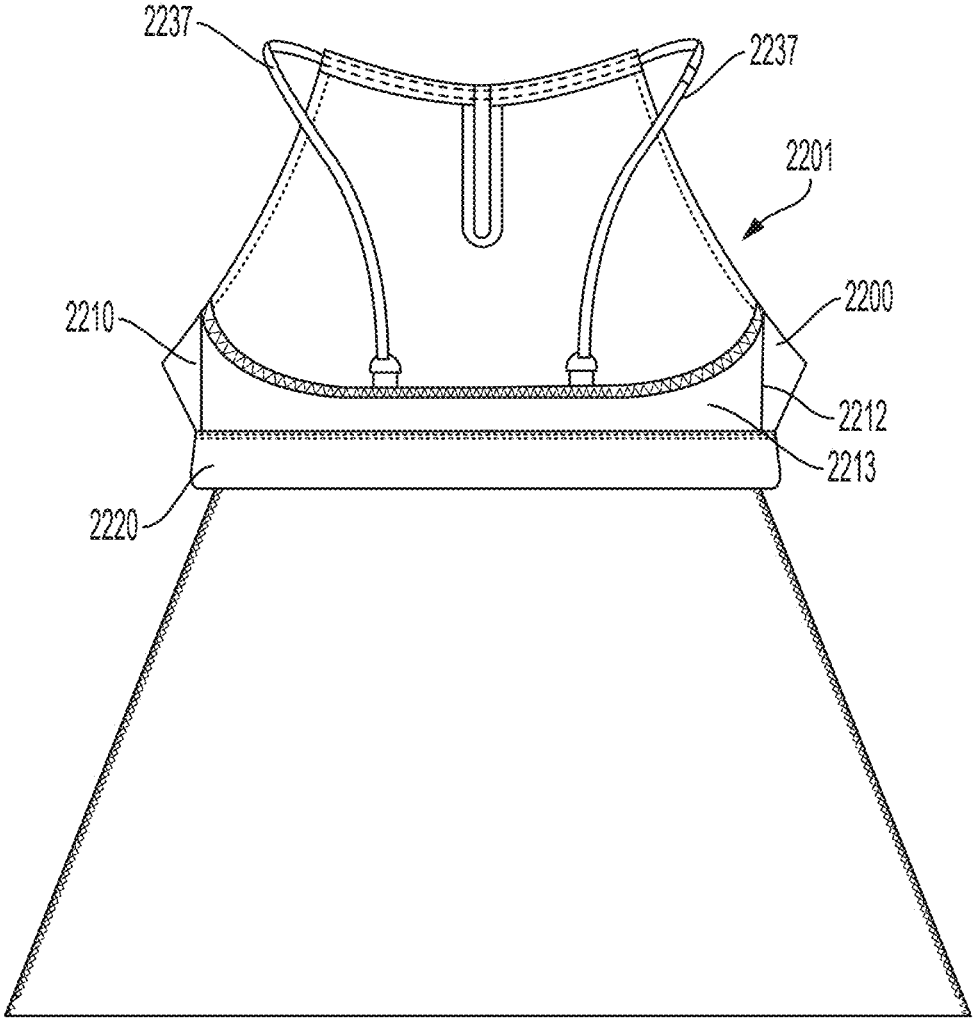
FIG. 23 is a rear view of the swim top that is inside out having the second embodiment of the bra assembly of FIG. 22.
Figures 24A, 24B, 24C:
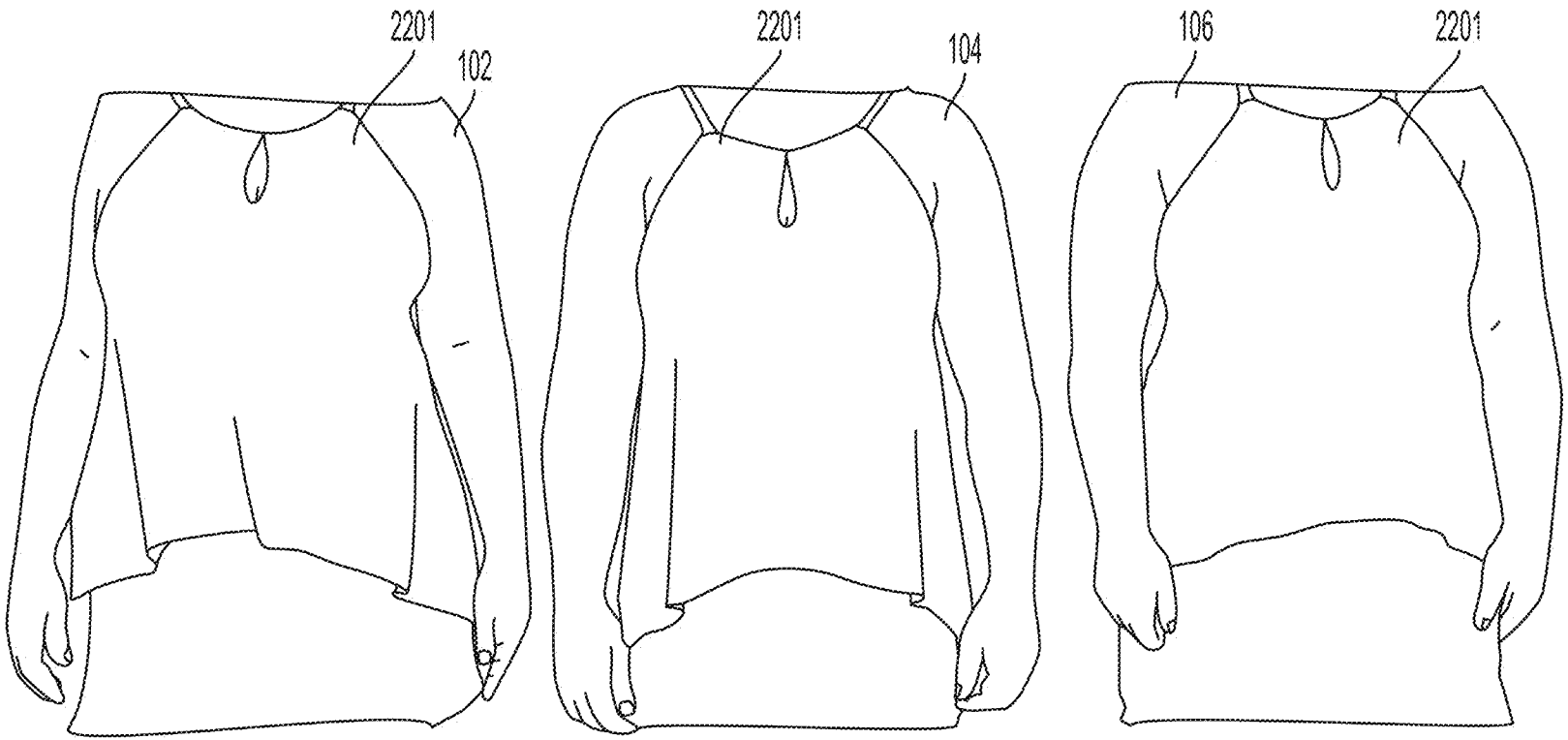
FIGS. 24A-24C are front views of the first wearer, the second wearer and the third wearer, each having three different cup sizes and three different underband sizes, all wearing the same size 8 swim top having the second embodiment of the bra assembly of FIG. 22.
Figures 25A, 25B, 25C:
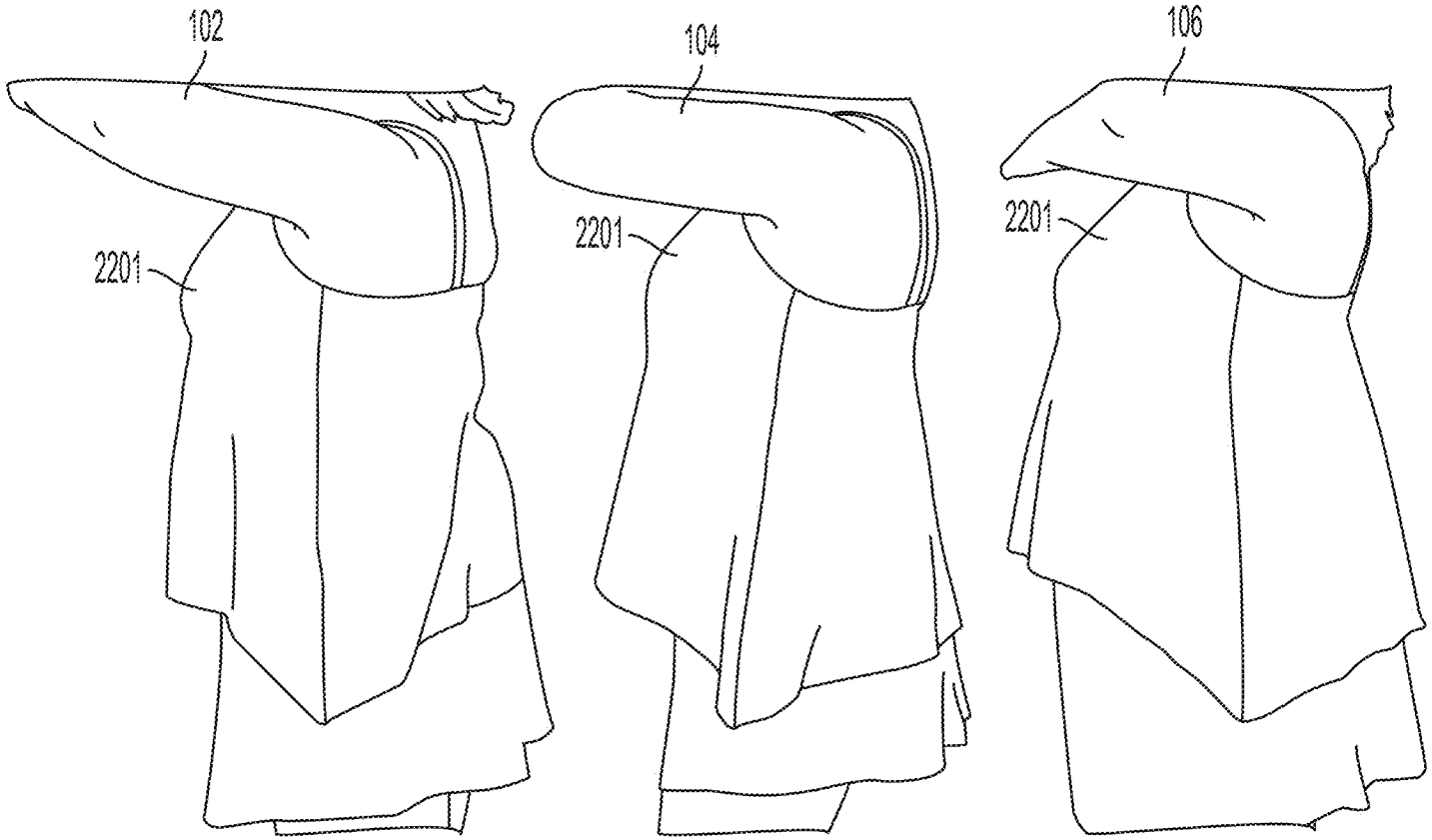
FIGS. 25A-25C are front views of the first wearer, the second wearer and the third wearer that have turned to the side wearing the swim top having the second embodiment of the bra assembly of FIG. 22.

Referring to FIGS. 22 and 23, a second embodiment of a bra of the present disclosure is generally referred to by 2200. Bra 2200 is incorporated into a swim top 2201 sometimes referred to as a tankini. Bra 2200 has an inner ply of fabric 2202 overlapping an outer ply of fabric 2204. Inner ply of fabric 2202 is connected to outer ply of fabric 2204 at a top edge 2206, a bottom edge 2208, a first side edge 2210 and second side 2212 edge, by stitching or by being a folded layer of fabric and secured together to form an interior volume 2214. Inner ply of fabric 2202 and outer ply of fabric 2204, for example, have fiber content of: nylon/spandex, polyester/spandex, or 100% stretch polyester. Inner ply of fabric 2202 and outer ply of fabric 2204, for example has a spandex content of 5-40% and a Nylon or polyester content: 60-95%. Fabric constructions of inner ply of fabric 2202 and outer ply of fabric 2204 can be: warp knit or circular knit. Inner ply of fabric 2202 and outer ply of fabric 2204, for example, has a fabric weight of 2.4-8 oz/yd$^2$. Inner ply of fabric 2202 and outer ply of fabric 2204 may or may not have equal stretch in the vertical and horizontal directions, and, for example, have a Fabric Length Elongation range: 60-220% and Fabric Width Elongation range: 70-240%. First side edge 2210 and second side 2212 are connected by back panel 2213.

Bra 2200 has a first cup assembly 2216 and a second cup assembly 2218. First cup assembly 2216 has a first cup insert 2217 in interior volume 2214. A portion of inner ply of fabric 2202 and a portion of outer ply of fabric 2204 cover first cup insert 2217. Second cup assembly 2218 has a second cup insert 2219 in interior volume 2214. A portion of inner ply of fabric 2202 and a portion of outer ply of fabric 2204 cover second cup insert 2219. The portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 are molded. The portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 are bubble molded to form a convex shape. For example, the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 are molded similar to fabric 2900 of FIGS. 29 and 30. The convex shape when in a relaxed non-stretch state facilitates the horizontal and vertical movement of first cup insert 2217 and second cup insert 2219 on the breast of the wearer during stretch of inner ply of fabric 2202 and outer ply of fabric 2204, respectively, to accommodate different sized breasts.

Referring to FIG. 28, the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are bubble molded to form a convex shape. The convex shape has a circumference from 7.5 cm to 23 cm and a depth of 0.5 cm to 17 cm having tolerance of +/−17 percent. Inner ply of fabric 2202 and outer ply of fabric 2204 are each stretchable so that first cup insert 2217 and second cup insert 2219 are each movable in the horizontal direction, which is about the width of the wearer, as shown by arrows 2277, 2279, the vertical direction, which is in the direction of the height of the wearer, as shown by arrows 2285, 2287, and the diagonal direction, as shown by arrows 2291 and 2293, upon stretch of inner ply of fabric 2202 and outer ply of fabric 2204.

First cup insert 2217 and second cup insert 2219 have a shape, for example, a convex shape, and, are made of materials, for example, the material of inner ply of fabric 2202 and outer ply of fabric 2204 or fabric top covers, such as fabrics using fibers of nylon, polyester, cotton, spandex and the previous in combinations, that can handle the high heat of lamination. As note above with respect to the embodiment of FIG. 10, the fabrics can be laminated with many different types of foam recipes, such as open cell or closed cell, including memory foam. First cup insert 2217 and second cup insert 2219 are made of materials that, for example, can also be spacer fabrics. First cup insert 2217 and second cup insert 2219 can be molded or cut and sewn. First cup insert 2217 and second cup insert 2219 can be with enhancement.

The portion of inner ply of fabric 2202 and the portion of outer ply of fabric 2204 covering first cup insert 2217 of first cup assembly 2216, the portion of inner ply of fabric 2202 and the portion of outer ply of fabric 2204 covering second cup insert 2219 of second cup assembly 2218, first cup insert 2217 and second cup insert 2219, provide support to the breast of the wearer. First cup insert 2217 and second cup insert 2219 also cover each nipple of the wearer to reduce or eliminate the visibility of the shape of the nipples through bra 2000 to provide modesty to the wearer, such as discussed above with respect to the embodiment of FIG. 10.

Bra 2200 has a band 2220 connected to inner ply of fabric 2202 and outer ply of fabric 2204. Band 2220 is a continuous loop that is stretchable from a first size to a second size that is larger than the first size. The continuous loop of band 2220 does not have a closure 1028 that is adjustable, for example, the fabric of band 2220 is continuous or the fabric of band 2220 forms two ends that are connected by a closure that is not adjustable. A closure that is not adjustable so that the closure is fixed, for example, by a seam. Preferably, band 2220 has a first modulus of elasticity at the first size and a second modulus of elasticity at the second size that are approximately, but not exactly, the same. Fiber content of the band can be 50-95% of nylon, polyester, or any other synthetic or natural yarn. Spandex content can be 5-50%. Referring again to FIG. 28, band 2220 has a width 1023 from 12 millimeters ("mm") to 62 mm and a length from 16 inches ("in") to 60 in.

Figure 49:
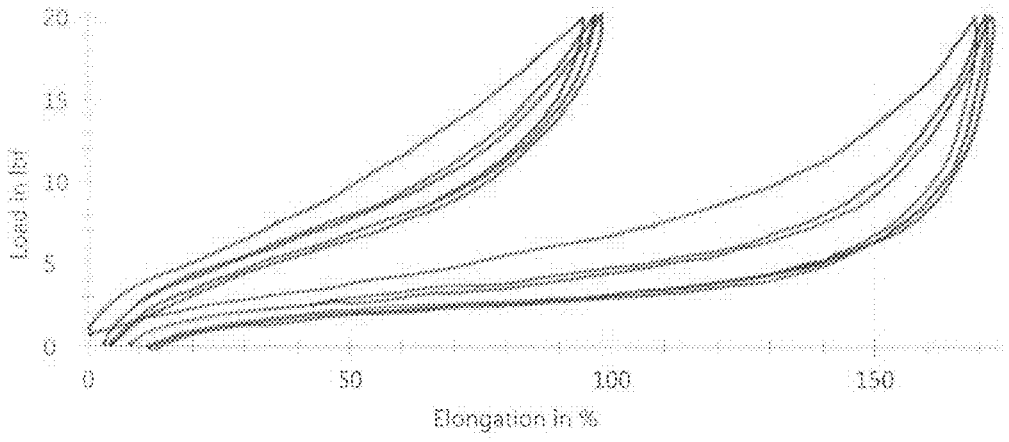
FIG. 49 is a graph of modulus curves for elastic materials of a band having a width of 32 mm.
Figure 50:
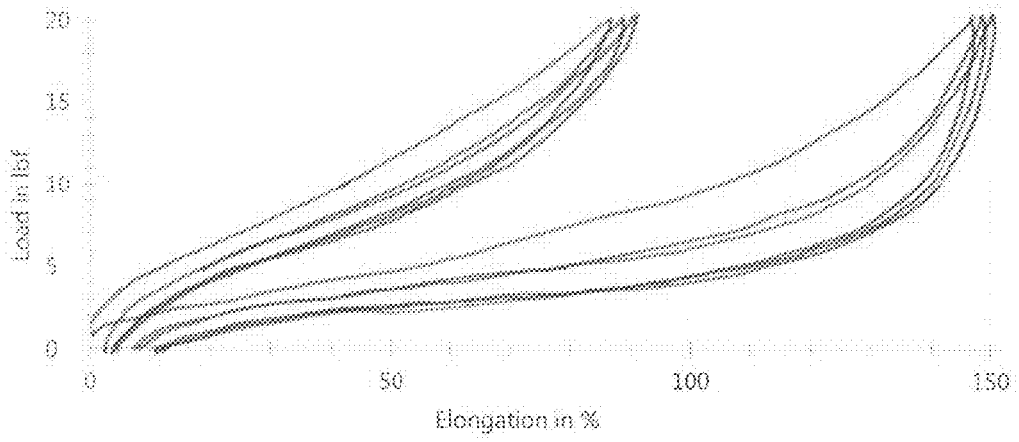
FIG. 50 is a graph of modulus curves for elastic materials of a band having a width of 38 mm.

Other alternatives for band 2220 are materials that each have a relatively flat modulus curve or a steeper modulus curve up as shown in FIGS. 49 and 50. Testing was conducted according to ASTM 4964 Loop Test—lbs on elastic materials to generate the graphs of FIGS. 49 and 50. The testing in FIG. 49 was conducted on samples having a width of 32 millimeters ("mm") and in the length direction and resulted in a stretch percent of 97.82, force at 30 percent elongation of 5.37 pound-force ("lbf"), force at 50 percent elongation of 7.72 lbf, and force at 70 percent elongation of 10.81 lbf and the sample had a 94.3 percent recovery, and, in a stretch percent of 171.93, force at 30 percent elongation of 1.97 lbf, force at 50 percent elongation of 2.76 lbf, and force at 70 percent elongation of 3.42 lbf and the sample had a 91.3 percent recovery.

Testing was conducted according to ASTM 4964 Loop Test-lbs on elastic materials to generate the graph of FIG. 50. The testing in FIG. 50 was conducted on samples having a width of 38 mm and in the length direction and resulted in a stretch percent of 90.00, force at 30 percent elongation of 6.43 lbf, force at 50 percent elongation of 9.30 lbf, and force at 70 percent elongation of 13.12 lbf and the sample had a 94.3 percent recovery and in a stretch percent of 149.96, force at 30 percent elongation of 2.58 lbf, force at 50 percent elongation of 3.58 lbf, and force at 70 percent elongation of 4.49 lbf and the sample had a 90.5 percent recovery. The testing of FIGS. 49 and 50 was conducted on a Zwick/Roell machine, had 2 conditioning cycles, a speed in the conditioning cycle of 30 inches per minute (in/min) and a test cycle speed of 20 in/min. Band 2220 can be of materials having an elongation at 20 pound ("lb") in a range of 90 percent to 171.93 percent, and, preferably in a range of 90 percent to 190 percent+/−20%.

Figure 39:
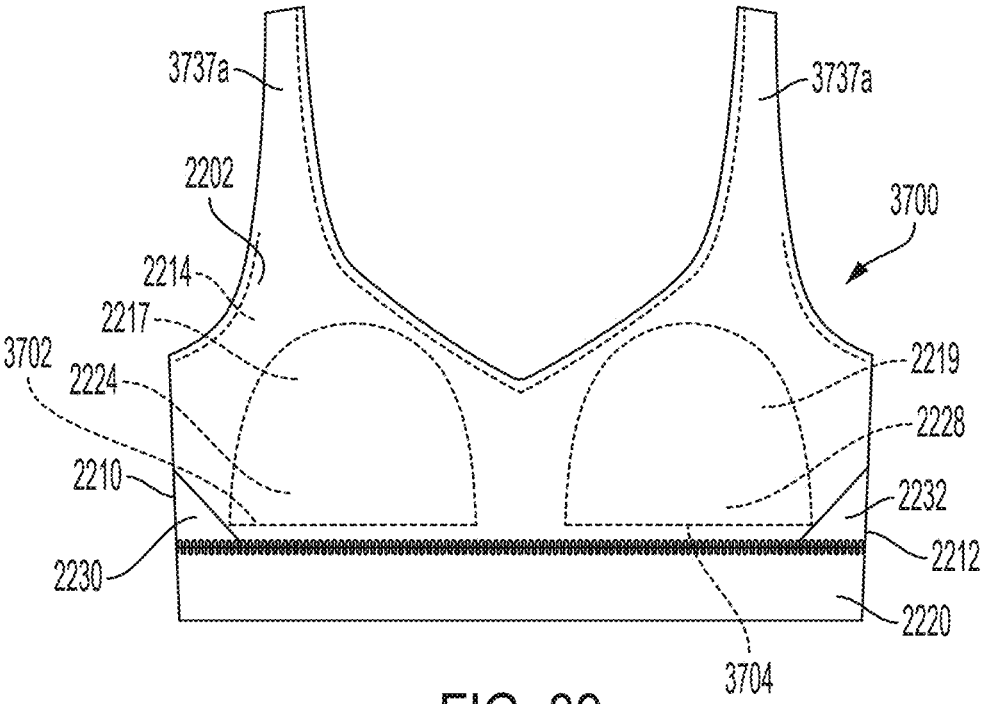
FIG. 39 is a front view of the bra assembly of FIG. 37 that is inside out.
Figure 40:
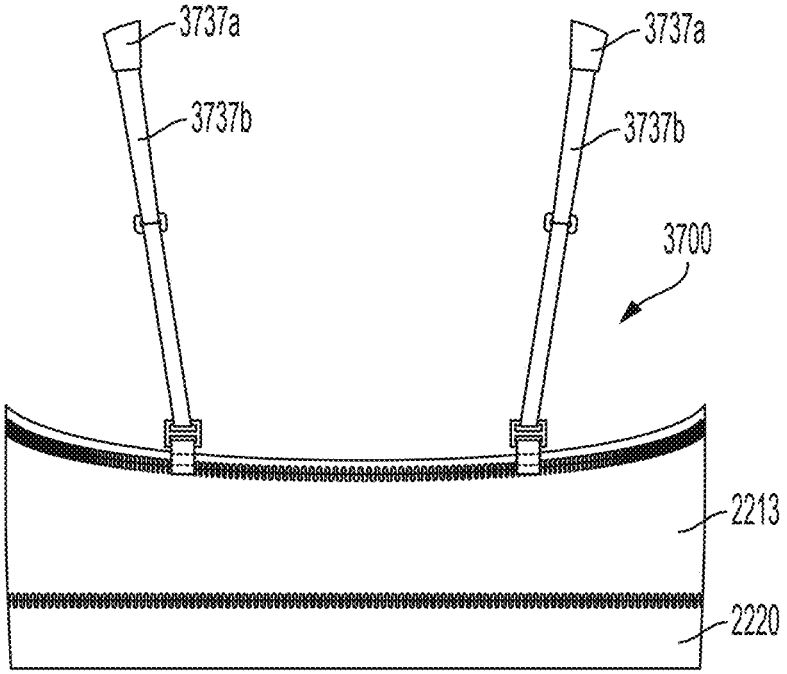
FIG. 40 is a rear view of FIG. 39.

First cup insert 2217 has a top portion 2222 and a bottom portion 2224. Bottom portion 2224 is adjacent band 2220. Second cup insert 2219 has a top portion 2226 and a bottom portion 2228. Bottom portion 2228 is adjacent band 2220. First cup insert 2217 only has bottom portion 2224 connected to inner ply of fabric 2202 and outer ply of fabric 2204. Second cup insert 2219 only has bottom portion 2228 connected to inner ply of fabric 2202 and outer ply of fabric 2204. Outer ply of fabric 2204 has an opening 2230 adjacent first cup insert 2217 to access interior volume 2214. Outer ply of fabric 2204 has an opening 2232 adjacent second cup insert 2219 to access second interior volume 2214. Openings 2230 and 2232 allow access to interior volume 2214 to adjust first cup insert 2217 and second cup insert 2219 positioned therein, for example, to unfold first cup insert 2217 and second cup insert 2219 if they become folded. Openings 2230 and 2232 of bra 2200 can have the shape of openings 2230 and 2232 of bra 3700 as shown in FIG. 39. Alternatively, first cup insert 2217 can have bottom portion 2224 connected to only inner ply of fabric 2202 or outer ply of fabric 2204, or inner ply of fabric 2202 and outer ply of fabric 2204 are instead a single layer of fabric having apertures that connect to the perimeters of first cup insert 2217 and second cup insert 2219, respectively. Similarly, second cup insert 2219 can have bottom portion 2228 connected to only inner ply of fabric 2202 or outer ply of fabric 2204 or both.

Bra 2200 has a distance 2250 between the closest points of first cup insert 2217 and second cup insert 2219. Distance 2250 is less than 30 percent of the size of the continuous loop of band 2220, and, can be less than 20 percent of the size of the continuous loop of band 2220.

First cup insert 2217 that only has bottom portion 2224 connected to inner ply of fabric 2202 and outer ply of fabric 2204, and second cup insert 2219 that only has bottom portion 2228 connected to inner ply of fabric 2202 and outer layer of fabric 2204, also facilitate the horizontal and vertical movement of first cup 2216 and second cup 2218 on the breasts of the wearer to allow stretch of inner ply of fabric 2202 and outer ply of fabric 2204 around top portion 2222 and top portion 2226, respectively, to accommodate different sized breasts. Moreover, preferably the material of band 2220, that has a first modulus of elasticity at the first size and a second modulus of elasticity at the second size that are approximately the same, facilitate the horizontal and vertical movement of first cup 2216 and second cup 2218 on the breast of the wearer.

Top edge 2206 of inner ply of fabric 2202 and outer ply of fabric 2204 is connected to an exterior top edge 2234 of an exterior layer of fabric 2236. Band 2220 and bottom edge 2208 are free from exterior layer 2236. Alternatively, top edge 2206 of inner ply of fabric 2202 and outer ply of fabric 2204 is connected to exterior top edge 2234 except for between shoulder straps 2237 where top edge 2206 is free and not connected to exterior top edge 2234 of exterior layer of fabric 2236 thereby forming a "floating neckline" between pair shoulder straps 2237 in the front of swim top 2201. The "floating neckline" allows fashionable necklines such as a halter top.

Referring to FIGS. 24A-25C, first wearer 102, second wearer 104 and third wearer 106 are shown wearing swim top 2201 having bra 2200. First wearer 102 is a size 12, 34GG cup and 34 underband. Second wearer 102 is a size 8, 36C cup and 36 underband. Third wearer 104 is a size 14, 38DD cup and 38 underband. The breast tissue of first wearer 102, second wearer 104 and third wearer 106 are tucked and covered by bra 2200 so that the swim top 2201 properly fits all three wearers, namely first wearer 102, second wearer 104 and third wearer 106. Accordingly, three different sized women or wearers, first wearer 102, second wearer 104 and third wearer 106, having three different cup sizes and three different underband sizes, can all comfortably wear the same size 8 swim top 2201.

Figure 26:
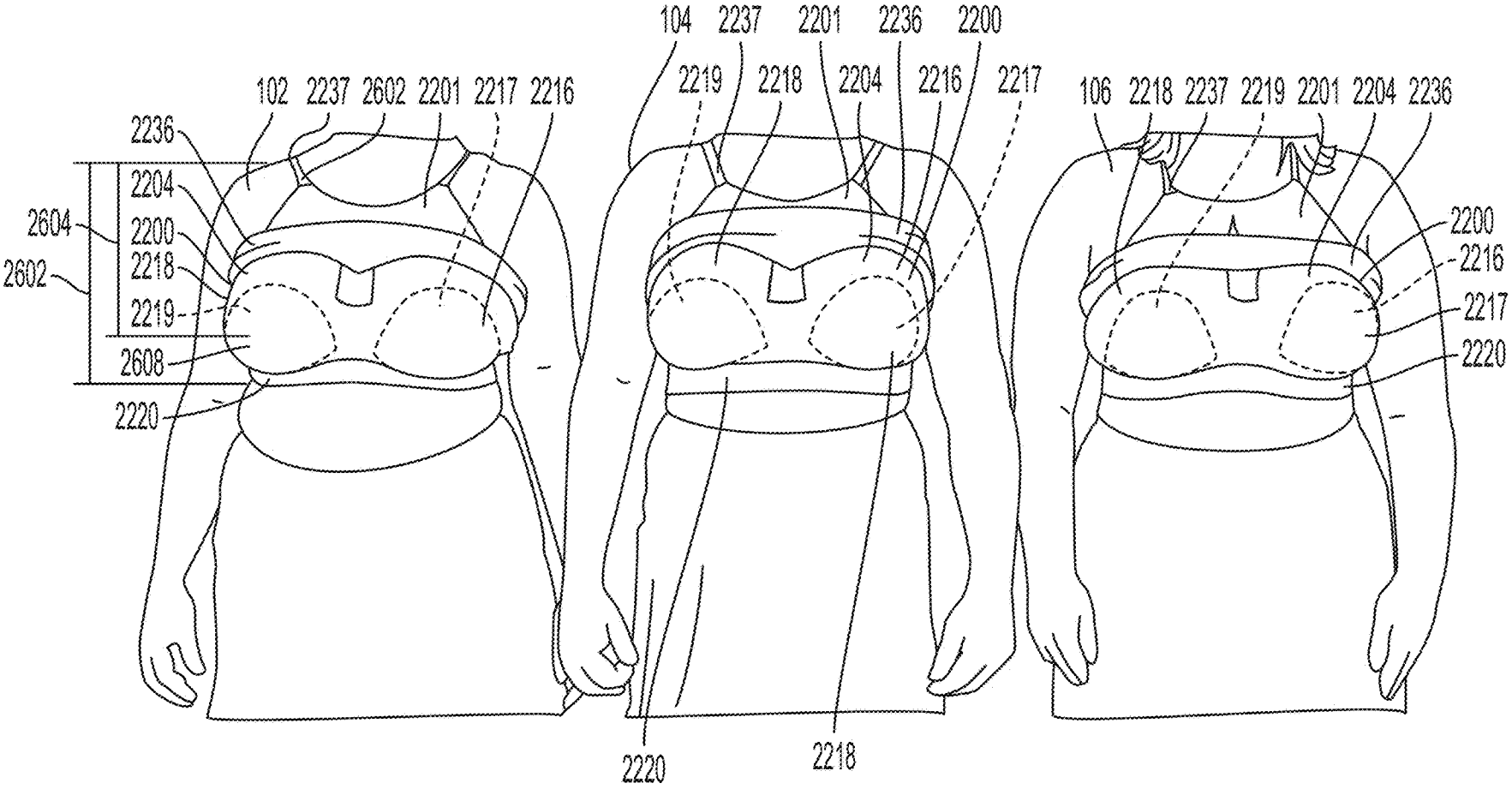
FIG. 26 is a front view of the first wearer, the second wearer and the third wearer each wearing the swim top shown with an exterior fabric layer lifted uncovering the second embodiment of the bra assembly of FIG. 22.

Referring to FIGS. 26-27C, exterior layer of fabric 2236 of swim top 2201 is lifted on first wearer 102, second wearer 104 and third wearer 106 to reveal bra 2200. The breast tissue of first wearer 102, second wearer 104 and third wearer 106 are tucked and covered by bra 2200 again for a proper fit of all three wearers, namely first wearer 102, second wearer 104 and third wearer 106.

The combination of band 2220 that has a first modulus of elasticity at the first size and a second modulus of elasticity at the second size that are approximately the same and the horizontal, vertical, and diagonal movement of first cup insert 2217 and second cup insert 2219 in the molded inner ply of fabric 2202 and outer ply of fabric 2204 allows each wearer with different cup sizes and different underband sizes to all comfortably wear the same size bra in the same size swim top without the need for manual adjustment, for example, a manual adjustable closure similar to closure 1028 for band 2220, and instead bra 2200 is self-adjusting.

The portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 are molded and allow for shaping and support of the breasts in a generally convex shape. The portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are molded also allow for expansion and retraction of surface area to cover different sized breasts and different shaped breasts, and further allow for expansion and retraction for movement of first cup insert 2217 and second cup insert 2219 in variable horizontal, vertical and diagonal distances for different positions of first cup insert 2217 and second cup insert 2219 on the breasts for different shaped breasts as well as different sized breasts. Band 2220 moves first cup insert 2217 and second cup insert 2219 closer and further apart for different body sizes, in particular, different underband sizes. Band 2220 moves the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are molded closer and further apart for different body sizes, in particular, different underband sizes. First cup insert 2217 that only has bottom portion 2224 connected to inner ply of fabric 2202 and outer ply of fabric 2204 and second cup insert 2219 only has bottom portion 2228 connected to inner ply of fabric 2202 and outer ply of fabric 2204, can allow for stretch of the fabric overlapping first cup insert 2217 and second cup insert 2219 in the relaxed state to stretch beyond first cup insert 2217 and second cup insert 2219 to maintain the cup insert in a desirable position, e.g., adjacent the band. For example, it is noted in FIG. 26 that first cup insert 2217 and second cup insert 2219 are closer together on first wearer 102 and second wearer 104 that have a smaller underband sizes than third wearer 106, and first cup insert 1005 and second cup insert 1007 appear lower on the breasts of first wearer 102 that has the largest cup size than on second wearer 104 and third wearer 106.

The breast tissue of first wearer 102, second wearer 104 and third wearer 106 is tucked and covered by bra 2000 so that the swim top 2001 properly fits first wearer 102, second wearer 104 and third wearer 106. This tucked and covered look is considered fashionable. Accordingly, three different sized women, first wearer 102, second wearer 104 and third wearer 106, having three different cup sizes and three different underband sizes, can all comfortably wear the same size eight swim top 2001.

Figure 27D:
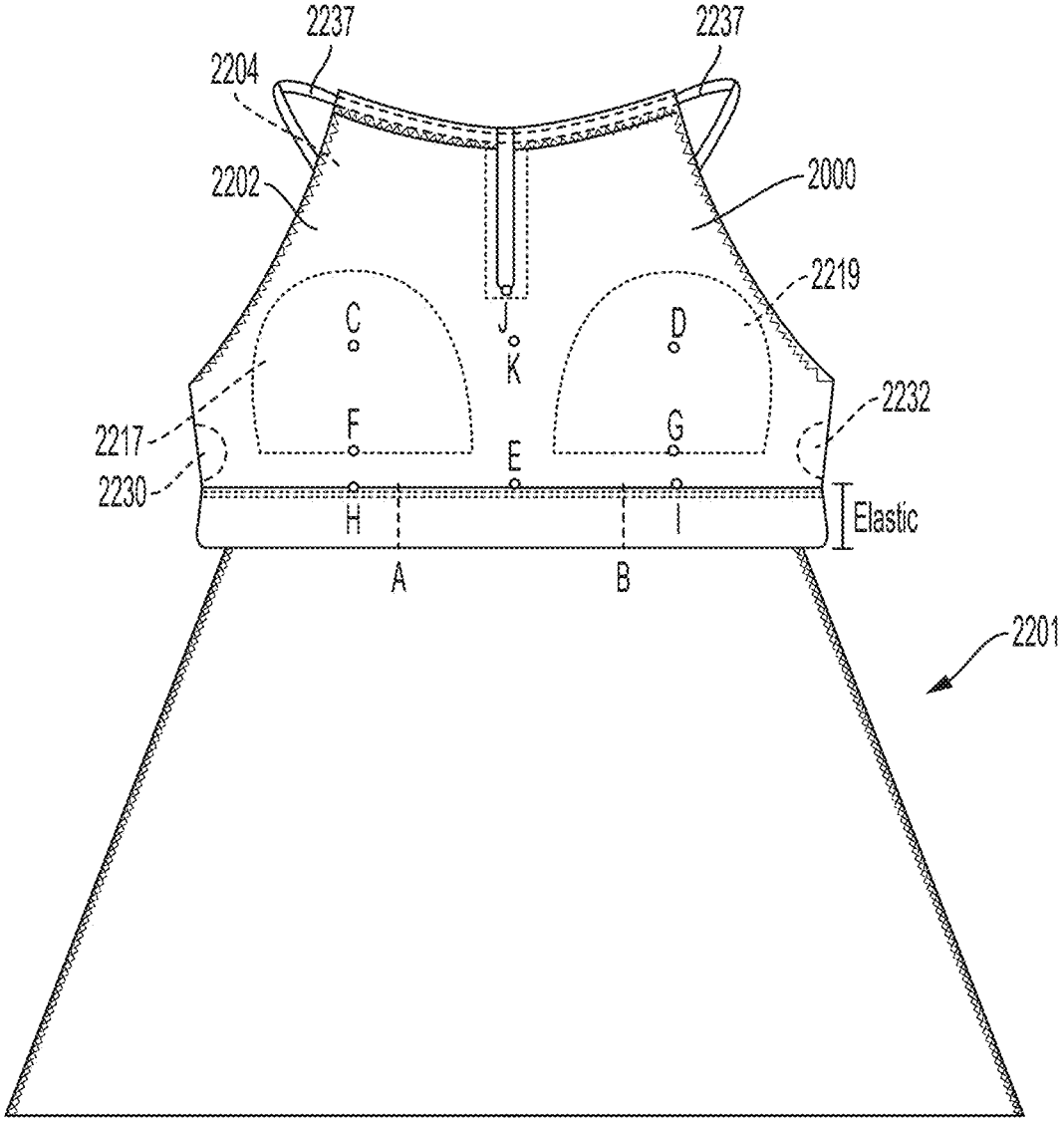
FIG. 27D is the front view of the second embodiment of the bra assembly of FIG. 22 including points of measurement.

Measurements were taken of swim top 2201 when swim top 2201 having band 2220 was off of a wearer and laid flat as shown in FIG. 27D. Measurements were taken of swim top 2201 having band 2220 of elastic material as shown in Table 2 and swim top 2201 having band 2220 that has a first modulus of elasticity at the first size and a second modulus of elasticity at the second size that are approximately, but not exactly, the same as shown in Table 3. The measurements were taken at from a point A to a point B, a measurement was taken from point C to a point D, a measurement was taken from point C to a point E, a measurement was taken from point D to point E, a measurement was taken from point C to a point F, a measurement was taken from point D to a point G, a measurement was taken from point C to a point H, a measurement was taken from point D to a point I, a measurement was taken from a point J to point E, a measurement was taken from point C to a point K and a measurement was taken from point D to point K. The same measurements were taken when swim top 2201 was on each of first wearer 102, second wearer 104 and third wearer 106. Swim top 2201 is a size 8. Referring to FIGS. 27E-27J, the results of these measurements are shown in Table 2 and Table 3. It is noted that all single letters, A, B, C, D, E, F, G, H, I, J and K, in Point of Measurements row in Table 2 are not referring to cup sizes.

Referring to FIG. 26, it is noted that third wearer 106 has a breast tissue size greater on her left breast that her right breast and second wearer 104 has breast implants and a breast tissue size is greater on her right breast. It is additionally noted that the measurements were taken over several non-consecutive days. It is also noted that measurements are/will be affected by production cutting and sewing, therefore the measurements (and therefore the percentages) may not by equal on the body, from one side to the other side and/or from the top to the bottom of swim top 2201. The adjustability of shoulder straps 2237 can effect a front interior bra height 2602 as shown in FIG. 26. The measurement 2604 from a shoulder 2606 to apex point 2608, such as point C and point D, can be different from person to person and therefore the movement of a cup height, for example, measurement was taken from point C to a point H, can be different from person to person.

Referring to Table 2 in FIGS. 27E-27G, the columns under the title "Measurement of the models" includes a first column 2702 that indicates an underband measurement and apex measurement for each of first wearer 102, second wearer 104 and third wearer 106. The apex measurement is a measurement from an apex of the breasts around the body, for example, as shown in FIG. 9 as measurement 902. The underband measurement is a measurement around the body, for example, as shown in FIG. 9 as measurement 904. First wearer 102 has an underband measurement of 32 inches and an apex measurement of 42 inches. Second wearer 104 has an underband measurement of 33.75 inches and an apex measurement of 42 inches. Third wearer 106 has an underband measurement of 34.5 inches and an apex measurement of 43.5 inches. A second column 2704 includes the cup size of each of first wearer 102, second wearer 104 and third wearer 106. As discussed above, first wearer 102 is a size 12, 34GG cup and 34 underband, second wearer 102 is a size 8, 36C cup and 36 underband, and third wearer 104 is a size 14, 38DD cup and 38 underband. A third column 2706 identifies each of first wearer 102, second wearer 104 and third wearer 106, and, thus, measurements for first wearer 102 are in row 2703, measurements for second wearer 104 are in row 2705 and measurements for third wearer 106 are in row 2707.

The columns under the title "UnderBand movement in width" are column 2710 that includes the measurement from point A to point B when swim top 2201 is off of the wearer and laid flat (5 inches), column 2712 that includes the measurement from point A to point B when swim top 2201 is on first wearer 102 in row 2703 (5.375 inches), second wearer 104 in row 2705 (5.5 inches) and third wearer 106 in row 2707 (5.75 inches), and column 2714 that indicates a percentage of change from a value in column 2710 compared with a value in column 2712 for first wearer 102 in row 2703 (7 percent), second wearer 104 in row 2705 (10 percent) and third wearer 106 in row 2707 (13 percent). Accordingly, point A and point B move away from one another on each of first wearer 102, second wearer 104 and third wearer 106. Further, point A and point B move away from one another a different distance on each of first wearer 102, second wearer 104 and third wearer 106 indicating different amounts of stretch of band 2220.

The columns under the title "Apex to Apex cup movement in width" are column 2716 that includes the measurement from point C to point D when swim top 2201 is off of the wearer and laid flat (9.125 inches), column 2718 that includes the measurement from point C to point D when swim top 2201 is on first wearer 102 in row 2703 (10.25 inches), second wearer 104 in row 2705 (9.75 inches) and third wearer 106 in row 2707 (10.5 inches), and column 2720 that indicates a percentage of change from a value in column 2716 compared with a value in column 2718 for first wearer 102 in row 2703 (11 percent), second wearer 104 in row 2705 (7 percent) and third wearer 106 in row 2707 (13 percent). Accordingly, point C and point D move away from one another on each of first wearer 102, second wearer 104 and third wearer 106. Further, point C and point D move away from one another a different distance on each of first wearer 102, second wearer 104 and third wearer 106 indicating first cup insert 2217 and second cup insert 2219 can move different distances away from one another to fit different sized wearers.

The columns under the title "Cup movement in diagonal" are column 2722 that includes the measurement from point C to point E when swim top 2201 is off of the wearer and laid flat (5.125 inches), column 2724 that includes the measurement from point C to point E when swim top 2201 is on first wearer 102 in row 2703 (5.625 inches), second wearer 104 in row 2705 (5.5 inches) and third wearer 106 in row 2707 (5.5 inches), and column 2726 that indicates a percentage of change from a value in column 2722 compared with a value in column 2724 for first wearer 102 in row 2703 (10 percent), second wearer 104 in row 2705 (7 percent) and third wearer 106 in row 2707 (7 percent). Accordingly, point C and point E move away from one another on each of first wearer 102, second wearer 104 and third wearer 106. Further, point C and point E move away from one another a different distance on each of first wearer 102, second wearer 104 and/or third wearer 106 indicating first cup insert 2217 can move different distances diagonally to fit different sized wearers.

The columns under the title "Cup movement in diagonal" are column 2728 that includes the measurement from point D to point E when swim top 2201 is off of the wearer and laid flat (5.125 inches), column 2730 that includes the measurement from point C to point E when swim top 2201 is on first wearer 102 in row 2703 (5.4375 inches), second wearer 104 in row 2705 (5.5625 inches) and third wearer 106 in row 2707 (5.4375 inches), and column 2732 that indicates a percentage of change from a value in column 2728 compared with a value in column 2730 for first wearer 102 in row 2703 (6 percent), second wearer 104 in row 2705 (8 percent) and third wearer 106 in row 2707 (6 percent). Accordingly, point D and point E move away from one another on each of first wearer 102, second wearer 104 and third wearer 106. Further, point D and point E move away from one another a different distance on each of first wearer 102, second wearer 104 and/or third wearer 106 indicating second cup insert 2219 can move different distances diagonally to fit different sized wearers.

The columns under the title "Cup movement in height" are column 2734 that includes the measurement from point C to point F when swim top 2201 is off of the wearer and laid flat (2.375 inches), column 2736 that includes the measurement from point C to point F when swim top 2201 is on first wearer 102 in row 2703 (2.5 inches), second wearer 104 in row 2705 (2.5 inches) and third wearer 106 in row 2707 (2.5 inches), and column 2738 that indicates a percentage of change from a value in column 2734 compared with a value in column 2736 for first wearer 102 in row 2703 (6 percent), second wearer 104 in row 2705 (6 percent) and third wearer 106 in row 2707 (6 percent). Accordingly, point C and point F move away from one another on each of first wearer 102, second wearer 104 and third wearer 106. Although the values in column 2738 are the same for all of first wearer 102, second wearer 104 and third wearer 106, the material of first cup insert 2217 can allow different stretch for first wearer 102, second wearer 104 and/or third wearer so that the values in column 2738 can be different. It is noted that the bodies of first wearer 102, second wearer 104 and third wearer 106 are not perfectly symmetrical. In addition, it is noted that there is additional fabric in an area from an apex at both point C and point D up to the neckline of top edge 2206 that provides additional stretch and increases measurements and percentages of movement.

The columns under the title "Cup movement in height" are column 2740 that includes the measurement from point D to point G when swim top 2201 is off of the wearer and laid flat (2.375 inches), column 2742 that includes the measurement from point D to point G when swim top 2201 is on first wearer 102 in row 2703 (2.625 inches), second wearer 104 in row 2705 (2.5 inches) and third wearer 106 in row 2707 (2.75 inches), and column 2744 that indicates a percentage of change from a value in column 2740 compared with a value in column 2742 for first wearer 102 in row 2703 (10 percent), second wearer 104 in row 2705 (6 percent) and third wearer 106 in row 2707 (16 percent). Accordingly, point D and point G move away from one another on each of first wearer 102, second wearer 104 and third wearer 106. Further, point D and point G move away from one another a different distance on each of first wearer 102, second wearer 104 and/or third wearer 106 indicating second cup insert 2219 has a material that can stretch to different lengths to fit different sized wearers.

The columns under the title "Cup movement in height" are column 2746 that includes the measurement from point C to point H when swim top 2201 is off of the wearer and laid flat (3.5 inches), column 2748 that includes the measurement from point C to point H when swim top 2201 is on first wearer 102 in row 2703 (3.625 inches), second wearer 104 in row 2705 (3.625 inches) and third wearer 106 in row 2707 (3.5 inches), and column 2750 that indicates a percentage of change from a value in column 2746 compared with a value in column 2748 for first wearer 102 in row 2703 (4 percent), second wearer 104 in row 2705 (4 percent) and third wearer 106 in row 2707 (0 percent). Accordingly, point C and point H move away from one another on each of first wearer 102, second wearer 104 and/or third wearer 106. Further, point C and point H move away from one another a different distance on each of first wearer 102, second wearer 104 and/or third wearer 106 indicating first cup insert 2217 can move different distances from point H to fit different sized wearers.

The columns under the title "Cup movement in height" are column 2752 that includes the measurement from point D to point I when swim top 2201 is off of the wearer and laid flat (3.5 inches), column 2754 that includes the measurement from point D to point I when swim top 2201 is on first wearer 102 in row 2703 (3.375 inches), second wearer 104 in row 2705 (3.625 inches) and third wearer 106 in row 2707 (3.625 inches), and column 2756 that indicates a percentage of change from a value in column 2752 compared with a value in column 2754 for first wearer 102 in row 2703 (−4 percent), second wearer 104 in row 2705 (4 percent) and third wearer 106 in row 2707 (4 percent). Accordingly, point D and point I move toward or away from one another on each of first wearer 102, second wearer 104 and third wearer 106. Further, point D and point I move toward or away from one another a different distance on each of first wearer 102, second wearer 104 and/or third wearer 106 indicating second cup insert 2219 can move different distances closer to or farther from point I to fit different sized wearers.

The columns under the title "Cup movement in height" are column 2758 that includes the measurement from point J to point E when swim top 2201 is off of the wearer and laid flat (4.75 inches), column 2760 that includes the measurement from point J to point E when swim top 2201 is on first wearer 102 in row 2703 (4.75 inches), second wearer 104 in row 2705 (4.875 inches) and third wearer 106 in row 2707 (4.75 inches), and column 2762 that indicates a percentage of change from a value in column 2758 compared with a value in column 2760 for first wearer 102 in row 2703 (0 percent), second wearer 104 in row 2705 (3 percent) and third wearer 106 in row 2707 (0 percent). Accordingly, point J and point E move away from one another on each of first wearer 102, second wearer 104 and/or third wearer 106. Further, point J and point E move away from one another a different distance on each of first wearer 102, second wearer 104 and/or third wearer 106 indicating inner ply of fabric 2202 and outer ply of fabric 2204 can stretch different distances to fit different sized wearers.

The columns under the title "Apex to Center movement in width" are column 2764 that includes the measurement from point C to point K when swim top 2201 is off of the wearer and laid flat (4.625 inches), column 2766 that includes the measurement from point C to point K when swim top 2201 is on first wearer 102 in row 2703 (5.375 inches), second wearer 104 in row 2705 (5.25 inches) and third wearer 106 in row 2707 (5.375 inches), and column 2768 that indicates a percentage of change from a value in column 2764 compared with a value in column 2766 for first wearer 102 in row 2703 (14 percent), second wearer 104 in row 2705 (12 percent) and third wearer 106 in row 2707 (14 percent). Accordingly, point C and point K move away from one another on each of first wearer 102, second wearer 104 and/or third wearer 106. Further, point C and point K move away from one another a different distance on each of first wearer 102, second wearer 104 and/or third wearer 106 indicating first cup insert 2217 can move different distances from point K to fit different sized wearers.

The columns under the title "Apex to Center movement in width" are column 2770 that includes the measurement from point D to point K when swim top 2201 is off of the wearer and laid flat (4.625 inches), column 2772 that includes the measurement from point D to point K when swim top 2201 is on first wearer 102 in row 2703 (5.3125 inches), second wearer 104 in row 2705 (5.25 inches) and third wearer 106 in row 2707 (5.375 inches), and column 2774 that indicates a percentage of change from a value in column 2770 compared with a value in column 2772 for first wearer 102 in row 2703 (13 percent), second wearer 104 in row 2705 (12 percent) and third wearer 106 in row 2707 (14 percent). Accordingly, point D and point K move away from one another on each of first wearer 102, second wearer 104 and/or third wearer 106. Further, point D and point K move away from one another a different distance on each of first wearer 102, second wearer 104 and/or third wearer 106 indicating second cup insert 2219 can move different distances from point K to fit different sized wearers.

According to Table 2, movement of first cup insert 2217 and second cup insert 2219 and stretch of band 2220 of elastic material on the same 3 models, namely, first wearer 102, second wearer 104 and third wearer 106, of differing underband and bust sizes, allow for wearing of the same bra 2000 of swim top 2201.

Referring FIGS. 27H-27J, swim top 2201 having band 2220 that has a first modulus of elasticity at the first size and a second modulus of elasticity at the second size that are approximately, but not exactly, the same is shown in Table 3. The columns under the title "Measurement of the models" includes a first column 3002 that indicates an underband measurement and apex measurement for each of first wearer 102, second wearer 104 and third wearer 106. The apex measurement is a measurement from an apex of the breasts around the body, for example, as shown in FIG. 9 as measurement 902. The underband measurement is a measurement around the body, for example, as shown in FIG. 9 as measurement 904. First wearer 102 has an underband measurement of 32 inches and an apex measurement of 42 inches. Second wearer 104 has an underband measurement of 33.75 inches and an apex measurement of 42 inches. Third wearer 106 has an underband measurement of 34.5 inches and an apex measurement of 43.5 inches. A second column 3004 includes the cup size of each of first wearer 102, second wearer 104 and third wearer 106. As discussed above, first wearer 102 is a size 12, 34GG cup and 34 underband, second wearer 102 is a size 8, 36C cup and 36 underband, and third wearer 104 is a size 14, 38DD cup and 38 underband. A third column 3006 identifies each of first wearer 102, second wearer 104 and third wearer 106, and, thus, measurements for first wearer 102 are in row 3003, measurements for second wearer 104 are in row 3005 and measurements for third wearer 106 are in row 3007.

The columns under the title "UnderBand movement in width" are column 3010 that includes the measurement from point A to point B when swim top 2201 is off of the wearer and laid flat (5 inches), column 3012 that includes the measurement from point A to point B when swim top 2201 is on first wearer 102 in row 3003 (5.7 inches), second wearer 104 in row 3005 (5.8 inches) and third wearer 106 in row 2707 (6.125 inches), and column 3014 that indicates a percentage of change from a value in column 3010 compared with a value in column 3012 for first wearer 102 in row 3003 (14 percent), second wearer 104 in row 3005 (16 percent) and third wearer 106 in row 3007 (19 percent). Accordingly, point A and point B move away from one another on each of first wearer 102, second wearer 104 and third wearer 106. Further, point A and point B move away from one another a different distance on each of first wearer 102, second wearer 104 and third wearer 106 indicating different amounts of stretch of band 2220.

The columns under the title "Apex to Apex cup movement in width" are column 3016 that includes the measurement from point C to point D when swim top 2201 is off of the wearer and laid flat (8 inches), column 3018 that includes the measurement from point C to point D when swim top 2201 is on first wearer 102 in row 3003 (8.5 inches), second wearer 104 in row 3005 (8.375 inches) and third wearer 106 in row 3007 (8.625 inches), and column 3020 that indicates a percentage of change from a value in column 3016 compared with a value in column 3018 for first wearer 102 in row 3003 (6 percent), second wearer 104 in row 3005 (5 percent) and third wearer 106 in row 3007 (7 percent). Accordingly, point C and point D move away from one another on each of first wearer 102, second wearer 104 and third wearer 106. Further, point C and point D move away from one another a different distance on each of first wearer 102, second wearer 104 and third wearer 106 indicating first cup insert 2217 and second cup insert 2219 can move different distances away from one another to fit different sized wearers.

The columns under the title "Cup movement in diagonal" are column 3022 that includes the measurement from point C to point E when swim top 2201 is off of the wearer and laid flat (4.5625 inches), column 3024 that includes the measurement from point C to point E when swim top 2201 is on first wearer 102 in row 3003 (4.6875 inches), second wearer 104 in row 3005 (4.5625 inches) and third wearer 106 in row 3007 (4.6875 inches), and column 3026 that indicates a percentage of change from a value in column 3022 compared with a value in column 3024 for first wearer 102 in row 3003 (3 percent), second wearer 104 in row 3005 (0 percent) and third wearer 106 in row 3007 (3 percent). Accordingly, point C and point E move away from one another on each of first wearer 102, second wearer 104 and/or third wearer 106. Further, point C and point E move away from one another a different distance on each of first wearer 102, second wearer 104 and/or third wearer 106 indicating first cup insert 2217 can move different distances diagonally to fit different sized wearers.

The columns under the title "Cup movement in diagonal" are column 3028 that includes the measurement from point D to point E when swim top 2201 is off of the wearer and laid flat (4.5625 inches), column 3030 that includes the measurement from point D to point E when swim top 2201 is on first wearer 102 in row 3003 (4.6875 inches), second wearer 104 in row 3005 (4.6875 inches) and third wearer 106 in row 3007 (4.8125 inches), and column 3032 that indicates a percentage of change from a value in column 3028 compared with a value in column 3030 for first wearer 102 in row 3003 (3 percent), second wearer 104 in row 3005 (3 percent) and third wearer 106 in row 3003 (5 percent). Accordingly, point D and point E move away from one another on each of first wearer 102, second wearer 104 and third wearer 106. Further, point D and point E move away from one another a different distance on each of first wearer 102, second wearer 104 and/or third wearer 106 indicating second cup insert 2219 can move different distances diagonally to fit different sized wearers.

The columns under the title "Cup movement in height" are column 3034 that includes the measurement from point C to point F when swim top 2201 is off of the wearer and laid flat (2.25 inches), column 3036 that includes the measurement from point C to point F when swim top 2201 is on first wearer 102 in row 3003 (2.5 inches), second wearer 104 in row 3005 (2.375 inches) and third wearer 106 in row 3007 (2.25 inches), and column 3038 that indicates a percentage of change from a value in column 3034 compared with a value in column 3036 for first wearer 102 in row 3003 (10 percent), second wearer 104 in row 3005 (6 percent) and third wearer 106 in row 3007 (0 percent). Accordingly, point C and point F move away from one another on each of first wearer 102, second wearer 104 and/or third wearer 106. The material of first cup insert 2217 can allow different stretch for first wearer 102, second wearer 104 and/or third wearer to fit different sized wearers.

The columns under the title "Cup movement in height" are column 3040 that includes the measurement from point D to point G when swim top 2201 is off of the wearer and laid flat (2.25 inches), column 3042 that includes the measurement from point D to point G when swim top 2201 is on first wearer 102 in row 3003 (2.5 inches), second wearer 104 in row 3005 (2.25 inches) and third wearer 106 in row 3007 (2.5 inches), and column 3044 that indicates a percentage of change from a value in column 3040 compared with a value in column 3042 for first wearer 102 in row 3003 (10 percent), second wearer 104 in row 3005 (0 percent) and third wearer 106 in row 3007 (10 percent). Accordingly, point D and point G move away from one another on each of first wearer 102, second wearer 104 and third wearer 106. Further, point D and point G move away from one another a different distance on each of first wearer 102, second wearer 104 and/or third wearer 106 indicating second cup insert 2219 has a material that can stretch to different lengths to fit different sized wearers.

The columns under the title "Cup movement in height" are column 3046 that includes the measurement from point C to point H when swim top 2201 is off of the wearer and laid flat (3.0625 inches), column 3048 that includes the measurement from point C to point H when swim top 2201 is on first wearer 102 in row 3003 (3.3125 inches), second wearer 104 in row 3005 (3.25 inches) and third wearer 106 in row 3007 (3.0625 inches), and column 3050 that indicates a percentage of change from a value in column 3046 compared with a value in column 3048 for first wearer 102 in row 3003 (8 percent), second wearer 104 in row 3005 (6 percent) and third wearer 106 in row 3007 (0 percent). Accordingly, point C and point H move away from one another on each of first wearer 102, second wearer 104 and/or third wearer 106. Further, point C and point H move away from one another a different distance on each of first wearer 102, second wearer 104 and/or third wearer 106 indicating first cup insert 2217 can move different distances from point H to fit different sized wearers.

The columns under the title "Cup movement in height" are column 3052 that includes the measurement from point D to point I when swim top 2201 is off of the wearer and laid flat (3.0625 inches), column 3054 that includes the measurement from point D to point I when swim top 2201 is on first wearer 102 in row 3003 (3.1875 inches), second wearer 104 in row 3005 (3.125 inches) and third wearer 106 in row 3007 (3.3125 inches), and column 3056 that indicates a percentage of change from a value in column 3052 compared with a value in column 3054 for first wearer 102 in row 3003 (4 percent), second wearer 104 in row 3005 (2 percent) and third wearer 106 in row 3007 (8 percent). Accordingly, point D and point I move away from one another on each of first wearer 102, second wearer 104 and third wearer 106. Further, point D and point I move away from one another a different distance on each of first wearer 102, second wearer 104 and/or third wearer 106 indicating second cup insert 2219 can move different distances closer to or farther from point I to fit different sized wearers.

The columns under the title "Center Front movement height" are column 3058 that includes the measurement from point J to point E when swim top 2201 is off of the wearer and laid flat (4.625 inches), column 3060 that includes the measurement from point J to point E when swim top 2201 is on first wearer 102 in row 3003 (4.75 inches), second wearer 104 in row 3005 (4.625 inches) and third wearer 106 in row 3007 (4.75 inches), and column 3062 that indicates a percentage of change from a value in column 3058 compared with a value in column 3060 for first wearer 102 in row 3003 (3 percent), second wearer 104 in row 3005 (0 percent) and third wearer 106 in row 3007 (3 percent). Accordingly, point J and point E move away from one another on each of first wearer 102, second wearer 104 and/or third wearer 106. Further, point J and point E move away from one another a different distance on each of first wearer 102, second wearer 104 and/or third wearer 106 indicating inner ply of fabric 2202 and outer ply of fabric 2204 can stretch different distances to fit different sized wearers.

The columns under the title "Apex to Center movement in width" are column 3064 that includes the measurement from point C to point K when swim top 2201 is off of the wearer and laid flat (4 inches), column 3066 that includes the measurement from point C to point K when swim top 2201 is on first wearer 102 in row 3003 (4.5 inches), second wearer 104 in row 3005 (4.375 inches) and third wearer 106 in row 3007 (4.5 inches), and column 3068 that indicates a percentage of change from a value in column 3064 compared with a value in column 3066 for first wearer 102 in row 3003 (12 percent), second wearer 104 in row 3005 (9 percent) and third wearer 106 in row 3007 (12 percent). Accordingly, point C and point K move away from one another on each of first wearer 102, second wearer 104 and/or third wearer 106. Further, point C and point K move away from one another a different distance on each of first wearer 102, second wearer 104 and/or third wearer 106 indicating first cup insert 2217 can move different distances from point K to fit different sized wearers.

The columns under the title "Apex to Center cup movement in width" are column 3070 that includes the measurement from point D to point K when swim top 2201 is off of the wearer and laid flat (4 inches), column 3072 that includes the measurement from point D to point K when swim top 2201 is on first wearer 102 in row 3003 (4.5 inches), second wearer 104 in row 3005 (4.375 inches) and third wearer 106 in row 3007 (4.5 inches), and column 3074 that indicates a percentage of change from a value in column 3070 compared with a value in column 3072 for first wearer 102 in row 3003 (12 percent), second wearer 104 in row 3005 (9 percent) and third wearer 106 in row 3007 (12 percent). Accordingly, point D and point K move away from one another on each of first wearer 102, second wearer 104 and/or third wearer 106. Further, point D and point K move away from one another a different distance on each of first wearer 102, second wearer 104 and/or third wearer 106 indicating second cup insert 2219 can move different distances from point K to fit different sized wearers.

According to Table 3, movement of first cup insert 2217 and second cup insert 2219 and stretch of band 2220 that has a first modulus of elasticity at the first size and a second modulus of elasticity at the second size that are approximately, but not exactly, the same on the same 3 models, namely, first wearer 102, second wearer 104 and third wearer 106, of differing underband and bust sizes, allow for wearing of the same bra 2000 of swim top 2201.

Figure 37:
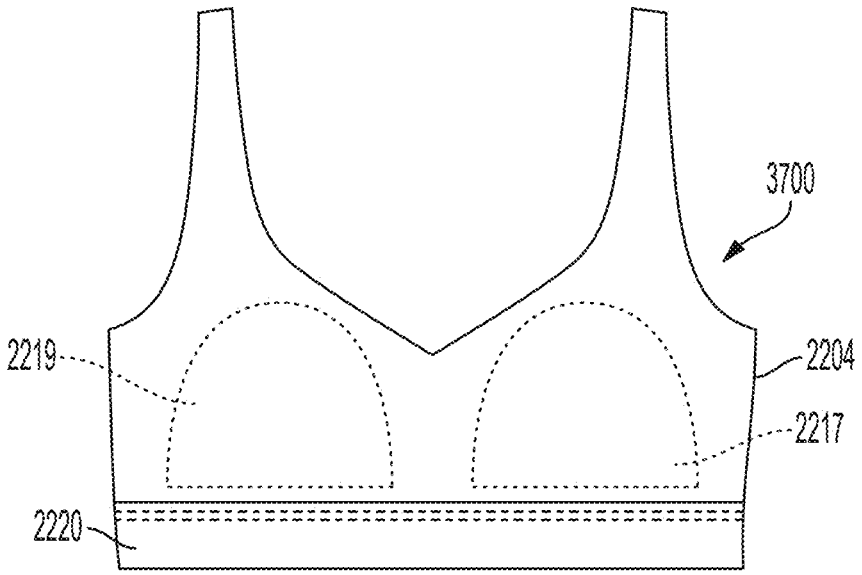
FIG. 37 is a front view of a bra assembly that is a modified bra assembly of FIG. 22 of the present disclosure.

Referring to FIG. 37, a bra assembly 3700 of the present disclosure ("bra 3700") is shown. Bra 3700 is a single bra and not incorporated into a swim top. However, bra 3700 can be incorporated into a garment, for example, a dress, a swim top, a one-piece swimsuit, a tank top, a t-shirt, an athletic-wear top, a long-sleeve shirt, a sleep top, lingerie, camisole, or any other garment that can incorporate a bra.

Referring to FIG. 37, bra 3700 is the same as bra 2200 except bra 3700 is incorporated into a single bra, first cup insert 2217 has bottom portion 2224 connected to only inner ply of fabric 2202 and second cup insert 2219 has bottom portion 2228 connected to only inner ply of fabric 2202, and openings 2230 and 2232 are a different shape and are through inner ply of fabric 2202 instead of outer ply of fabric 2204 shown in FIG. 39. Alternatively, openings 2230 and 2232 can be through outer ply of fabric 2204 instead of inner ply of fabric 2202. Openings 2230 and 2232 of bra 3700 can also have the shape of openings 2230 and 2232 of bra 2200 as shown in FIG. 22. Accordingly, the same reference numerals are used for bra 3700 as bra 2200 for like features.

Figure 38:
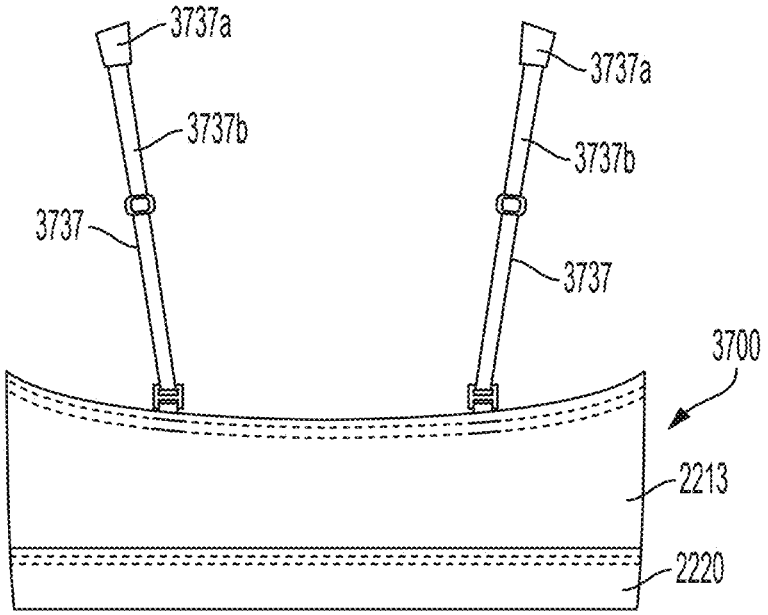
FIG. 38 is a rear view of FIG. 37.

Referring to FIG. 37, bra 3700 can be incorporated into a single bra having a neckline that is a tank top that is the same as swim top 1901 except bra 3700 is a V neckline and does not have an exterior layer of fabric 1036. Referring to FIG. 38, bra 3700 can have straps 3737 that each have a fixed portion 3737*a* and an adjustable portion 3737*b* that are adjustable.

Referring to FIG. 39, first cup insert 2217 has bottom portion 2224 connected to only inner ply of fabric 2202 by stitching 3702. Bottom portion 2224 of first cup insert 2217 is not connected to outer ply of fabric 2204 as shown in FIG. 37 so that outer ply of fabric 2204 can move relative to bottom portion 2224 of first cup insert 2217 as shown in FIG. 39. Second cup insert 2219 has bottom portion 2228 connected to only inner ply of fabric 2202 by stitching 3704. Bottom portion 2228 of second cup insert 2219 is not connected to outer ply of fabric 2204, as shown in FIG. 37, so that outer ply of fabric 2204 can move relative to bottom portion 2228, as shown in FIG. 39, of second cup insert 2219. Bottom portion 2224 of first cup insert 2217 is connected to only inner ply of fabric 2202 and bottom portion 2228 of second cup insert 2219 is connected to only inner ply of fabric 2202, as shown in FIG. 39, avoids wrinkling on outer ply of fabric 2204, as shown in FIG. 37, providing a desirable aesthetic effect. Alternatively, bottom portion 2224 of first cup insert 2217 is connected to outer ply of fabric 2204 by stitching so that inner ply of fabric 2202 can move relative to bottom portion 2224 of first cup insert 2217 and second cup insert 2219 has bottom portion 2228 connected to only outer ply of fabric 2204 by stitching so that portion 2228 of second cup insert 2219 is not connected to inner ply of fabric 2202 so that inner ply of fabric 2202 can move relative to bottom portion 2228 of second cup insert 2219.

As shown in FIG. 39, inner ply of fabric 2202 has opening 2230 adjacent first cup insert 2217 to access interior volume 2214. Inner ply of fabric 2202 has an opening 2232 adjacent second cup insert 2219 to access second interior volume 2214. Openings 2230 and 2232 allow access to interior volume 2214 to adjust first cup insert 2217 and second cup insert 2219 positioned therein, for example, to unfold first cup insert 2217 and second cup insert 2219 if they become folded for instance while putting on the body. Openings 2230 and 2232 are a different shape in bra 3700 than in bra 2200, in particular, opening 2230 is a diagonal access opening located from first side edge 2210 to above band 2220 for entrance and opening 2232 is a diagonal access opening located from second side 2212 to above band 2220 for entrance. Opening 2230 can alternatively be through outer ply of fabric 2204, as shown in FIG. 39, and opening 2232 can alternatively be through outer ply of fabric 2204, as shown in FIG. 39. Band 2220 is shown as 32 mm but alternatively could be 38 mm or other width that is desirable for aesthetics.

Bra 3700 could also be useful for maternity due to the ability for breast to grow during the 9 months and the wearer has ability to still wear the same bra prenatal and postnatal.

Referring to FIGS. 41-44, bra 3700 can be modified in bra 3700*a* so that band 2220 is modified to band 2220*a*, as shown in FIG. 41, that has a separation, as shown in FIG. 42, forming a first end 4202 and a second end 4204 and back panel 2213 is modified to back panels 2213*a* and 2213*b*. Back panels 2213*a* and 2213*b* are each connected to band 2220*a* so that an adjustable closure assembly 4200 selectively connects back panels 2213*a* and 2213*b* together by selectively connecting first end 4202 and second end 4204 together. First end 4202 has hooks 4206 extending from a first connection portion 4207 and second end 4204 has pairs of loops 4208*a*, 4208*b*, 4208*c* extending from a second connection portion 4209. Hooks 4206 selectively connect to one pairs of loops 4208*a*, 4208*b*, 4208*c* to selectively connect first end 4202 and second end 4204 together. Hooks 4206 selectively connect to one pairs of loops 4208*a*, 4208*b*, 4208*c* to adjust a distance between first end 4202 and second end 4204 as desired by the wearer.

Figure 45:
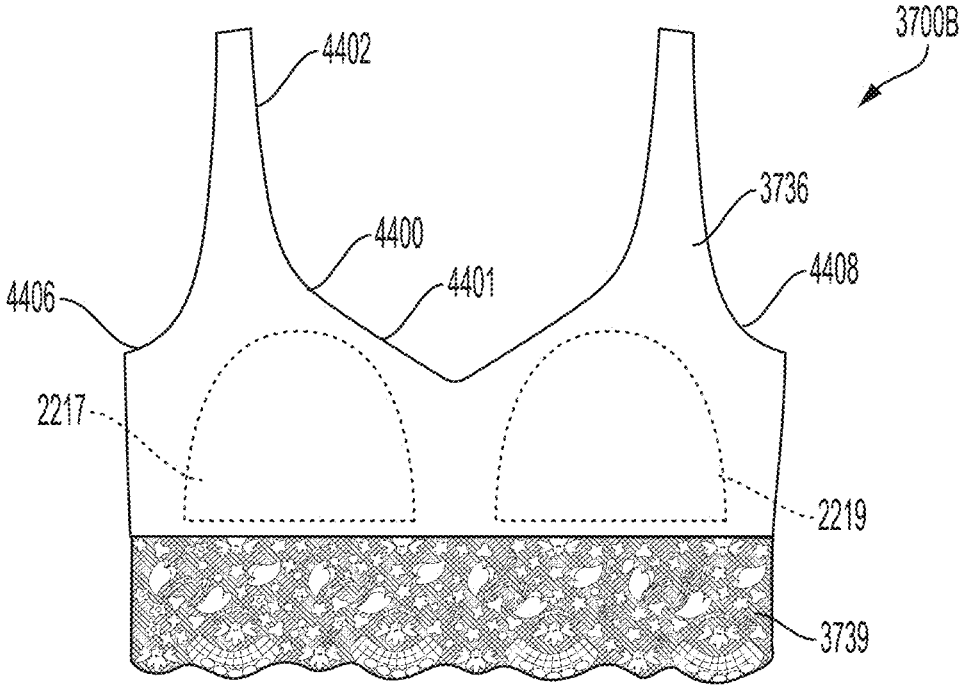
FIG. 45 is a front view of a bra assembly that is a modified bra assembly of FIG. 41 of the present disclosure.

Referring to FIGS. 45-48, bra 3700*a* can be modified in bra 3700*b* to add an exterior layer of fabric 3736, as shown in FIG. 45, band 2220*a* can be modified to band 2220*b*, and adjustable closure assembly 4200 can be modified to an adjustable back closure assembly 4200*a* as shown in FIG. 46*a*. Hooks 4206 can be modified to hooks 4206*a* on a first connection portion 4207*a* and pairs of loops 4208*a*, 4208*b*, 4208*c* can be modified to rows of loops 4209*a*, 4209*b*, 4209*c* on a second connection portion 4211*a* of adjustable back closure assembly 4200*a*. Hooks 4206*a*, as shown in FIG. 46*a*, are connected to first end 4202*a* of band 2220*b*, as shown in FIG. 48, to selectively connect to one of rows of loops 4209*a*, 4209*b*, 4209*c* on second end 4204*a* of band 2220*b* to selectively connect first end 4202*a* and second end 4204*a* of band 2220*b* together. Hooks 4206*a* selectively connect to one rows of loops 4209*a*, 4209*b*, 4209*c* to adjust a distance between first end 4202*a* and second end 4204*a* as desired by the wearer. In another alternative, first connection portion 4207*a* and second connection portion 4211*a* have a larger width so that portions of exterior layer of fabric 3736, back panels 2213*a* and 2213*b*, first connection portion 4207*a*, and second connection portion 4211*a* extend above band 2220*a*.

Exterior layer of fabric 3736, as shown in FIG. 45, is connected to cover outer ply of fabric 2204, back panels 2213*a* and 2213*b* and band 2220*a*, as shown in FIG. 48. Outer ply of fabric 2204 is shown in FIG. 46*a*. Exterior layer of fabric 3736, as shown in FIG. 45, can be a longer length to form a camisole, dress and/or top. Exterior layer of fabric 3736 can have a decorative border 3739 made of a lace material or can be embroidery, other types of trim, solids or printed fabrics. Exterior layer of fabric 3736 can be a different material than the rest of bra 3700*b*. Exterior layer of fabric 3736 has an outer perimeter 4400, as shown in FIG. 45, that has a neck edge portion 4401, strap portions 4402, 4404 and underarm portions 4406, 4408 that are connected to outer ply of fabric 2204. Outer perimeter 4400 of exterior layer of fabric 3736, as shown in FIG. 45, has rear portions 4410, 4412, as shown in FIG. 46*a*, connected to back panels 2213*a* and 2213*b*, as shown in FIG. 48. Outer perimeter 4400 of exterior layer of fabric 3736 has end strap portions 4414, 4416 that connect to adjustable portion 3737*b*, as shown in FIG. 46*a*, of straps 3737. Outer perimeter 4400 of exterior layer of fabric 3736 has a first edge connection portion 4418 connected to first connection portion 4207*a* and a second edge connection portion 4420 connected to second connection portion 4211*a*, as shown in FIG. 46*a*. Outer perimeter 4400 of exterior layer of fabric 3736, as shown in FIG. 45, is connected, for example, by stitching. Band 2220*a* is free from exterior layer 3736 except at first end 4202*a*, as shown in FIG. 48, and second end 4204*b*. Alternatively, exterior layer 3736 is not connected to first connection portion 4207*a* and second edge connection portion 4420, and, instead rear portions 4410, 4412 of exterior layer 3736 are connected to each other and not connected to adjustable back closure assembly 4200*a* so that exterior layer 3736 is continuous to cover adjustable back closure assembly 4200*a*.

Exterior layer of fabric 3736 is molded at the location of first cup insert 2217 and second cup insert 2219, respectively. Exterior layer of fabric 3736 is bubble molded to form a convex shape when in a relaxed non-stretch state. The convex shape facilitates the horizontal, vertical and diagonal movement of first cup insert 2217 and second cup insert 2219 on the breast of the wearer during stretch of inner ply of fabric 2202 and outer ply of fabric 2204, respectively, to accommodate different sized breasts. Exterior layer of fabric 3736 can be molded similarly to the portion of first ply of fabric 1021 of first cup assembly 1004 and the portion of second ply of fabric 1043 of second cup assembly 1014 that are bubble molded to form a convex shape have a circumference from 7.5 cm to 23 cm and a depth of 0.5 cm to 17 cm with a tolerance of +/−17 percent. Molding of exterior layer of fabric 3736 allows exterior layer of fabric 3736 to evenly lay over outer ply of fabric 2204. Exterior layer of fabric 3736 can alternatively include shirring or be darted that include seams to shape exterior layer of fabric 3736 as alternatives to molding.

FIG. 28 is a table that includes a wearer cup size, a wearer under bust size, a first cup insert and a second cup insert size, the first cup insert and the second cup insert depth, bubble molding and shaped bubble molding fabric, band measurement and width of band of the bra assembly of the first and second embodiments the present disclosure. In the table of FIG. 28, the term "from" includes the term "of". A bra assembly 1000, 2200 that fits a cup size of AA, A, B, C, D, DD, DDD, and E with an under bust size of 18 to 28 inches includes first cup insert 1005, 2217 and second cup insert 1007, 2219 that have a size range from size 00 to size 6 and a depth from 0.5 cm to 25 cm, the portion of first ply of fabric 1021 of first cup assembly 1004 and the portion of second ply of fabric 1043 of second cup assembly 1014 that are bubble molded and the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are bubble molded have a circumference from 7.5 cm to 13.5 cm and a depth from 0.5 cm to 17 cm, and band 1022, 2220 has a length from 16 inches to 28 inches and a width from 12 inches to 62 inches.

Still referring to FIG. 28, a bra assembly 1000, 2200 that fits a cup size of A, B, C, D, DD, DDD, E and F with an under bust size of 20 to 30 inches includes first cup insert 1005, 2217 and second cup insert 1007, 2219 that have a size range from size 2 to size 10 and a depth from 0.5 cm to 25 cm, the portion of first ply of fabric 1021 of first cup assembly 1004 and the portion of second ply of fabric 1043 of second cup assembly 1014 that are bubble molded and the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are bubble molded have a circumference from 8 cm to 14 cm and a depth from 0.5 cm to 17 cm, and band 1022, 2220 has a length from 18 inches to 30 inches and a width from 12 inches to 62 inches.

Still referring to FIG. 28, a bra assembly 1000, 2200 that fits a cup size of B, C, D, DD, DDD, E, F and G with an under bust size of or from 22 to 32 inches includes first cup insert 1005, 2217 and second cup insert 1007, 2219 that have a size range from size 4 to size 12 and a depth from 0.5 cm to 25 cm. Also, the portion of first ply of fabric 1021 of first cup assembly 1004 and the portion of second ply of fabric 1043 of second cup assembly 1014 that are bubble molded and the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are bubble molded have a circumference from 8.5 cm to 14.5 cm and a depth from 0.5 cm to 17 cm, and band 1022, 2220 has a length from 20 inches to 32 inches and a width of 12 inches to 62 inches.

Again, referring to FIG. 28, a bra assembly 1000, 2200 that fits a cup size of B, C, D, DD, DDD, E, F and G with an under bust size of 24 to 34 inches includes first cup insert 1005, 2217 and second cup insert 1007, 2219 that have a size range from size 6 to size 14 and a depth from 0.5 cm to 25 cm. Also, the portion of first ply of fabric 1021 of first cup assembly 1004 and the portion of second ply of fabric 1043 of second cup assembly 1014 that are bubble molded and the portion of inner ply of fabric 2202 and the portion of outer ply of fabric 2204 covering first cup insert 2217 of first cup assembly 2216 and the portion of inner ply of fabric 2202 and the portion of outer ply of fabric 2204 covering second cup insert 2219 of second cup assembly 2218 that are bubble molded have a circumference from 9 cm to 15 cm and a depth from 0.5 cm to 17 cm, and band 1022, 2220 has a length from 22 inches to 34 inches and a width from 12 inches to 62 inches.

Again, referring to FIG. 28, a bra assembly 1000, 2200 that fits a cup size of B, C, D, DD, DDD, E, F, G and H with an under bust size of 26 to 36 inches includes first cup insert 1005, 2217 and second cup insert 1007, 2219 that have a size range from or of size 8 to size 16 and a depth from 0.5 cm to 25 cm. Also, the portion of first ply of fabric 1021 of first cup assembly 1004 and the portion of second ply of fabric 1043 of second cup assembly 1014 that are bubble molded, and the portions of inner ply of fabric 2202 and the portion of outer ply of fabric 2204 covering first cup insert 2217 of first cup assembly 2216, and covering second cup insert 2219 of second cup assembly 2218 that are bubble molded have a circumference from 9.5 cm to 16.5 cm and a depth from 0.5 cm to 17 cm, and band 1022, 2220 has a length from 24 inches to 36 inches and a width of 12 inches to 62 inches.

Still referring to FIG. 28, a bra assembly 1000, 2200 that fits a cup size of B, C, D, DD, DDD, E, F, G and H with an under bust size of 28 to 38 inches includes first cup insert 1005, 2217 and second cup insert 1007, 2219 that have a size range from size 10 to size 18 and a depth from 0.5 cm to 25 cm. Also, the portion of first ply of fabric 1021 of first cup assembly 1004 and the portion of second ply of fabric 1043 of second cup assembly 1014 that are bubble molded, and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 10 cm to 17 cm and a depth from 0.5 cm to 17 cm, and band 1022, 2220 has a length from 26 inches to 38 inches and a width of 12 inches to 62 inches.

Still referring to FIG. 28, a bra assembly 1000, 2200 that fits a cup size of B, C, D, DD, DDD, E, F, G and H with an under bust size of 30 to 40 inches includes first cup insert 1005, 2217 and second cup insert 1007, 2219 that have a size range from size 12 to size 20 and a depth from 0.5 cm to 25 cm. Also, the portion of first ply of fabric 1021 of first cup assembly 1004 and the portion of second ply of fabric 1043 of second cup assembly 1014 that are bubble molded, and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 10.5 cm to 18.5 cm and a depth from 0.5 cm to 17 cm, and band 1022, 2220 has a length from 28 inches to 40 inches and a width from 12 inches to 62 inches.

Still referring to FIG. 28, a bra assembly 1000, 2200 that fits a cup size of C, D, DD, DDD, E, F, G and H with an under bust size of 32 to 42 inches includes first cup insert 1005, 2217 and second cup insert 1007, 2219 that have a size range from size 14 to size 22 and a depth from 0.5 cm to 25 cm. In this embodiment, the portion of first ply of fabric 1021 of first cup assembly 1004 and the portion of second ply of fabric 1043 of second cup assembly 1014 that are bubble molded, and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 11 cm to 19 cm and a depth from 0.5 cm to 17 cm, and band 1022, 2220 has a length of 30 inches to 42 inches and a width of 12 inches to 62 inches.

Again, referring to FIG. 28, a bra assembly 1000, 2200 that fits a cup size of C, D, DD, DDD, E, F, G and H with an under bust size of 34 to 44 inches includes first cup insert 1005, 2217 and second cup insert 1007, 2219 that have a size range from size 16 to size 24 and a depth from 0.5 m to 25 m, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 11.5 cm to 19.5 cm and a depth from 0.5 cm to 17 cm, and band 1022, 2220 has a length from 32 inches to 44 inches and a width from 12 inches to 62 inches.

Still referring to FIG. 28, a bra assembly 1000, 2200 that fits a cup size of C, D, DD, DDD, E, F, G and H with an under bust size of 36 to 46 inches includes first cup insert 1005, 2217 and second cup insert 1007, 2219 that have a size range from size 18 to size 26 and a depth from 0.5 cm to 25 cm, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 12 cm to 20 cm and a depth from 0.5 cm to 17 cm, and band 1022, 2220 has a length from 34 inches to 46 inches and a width from 12 inches to 62 inches.

Still referring to FIG. 28, a bra assembly 1000, 2200 that fits a plus size of a cup size of B, C, D, DD, DDD, E, F, G and H with an under bust size of 38 to 44 inches includes first cup insert 1005, 2217 and second cup insert 1007, 2219 that have a size range from size 14 to size 22 and a depth from 0.5 cm to 25 cm, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 11 cm to 19 cm and a depth from 0.5 cm to 17 cm, and band 1022, 2220 has a length from 32 inches to 44 inches and a width from 12 inches to 62 inches.

Again, referring to FIG. 28, a bra assembly 1000, 2200 that fits a plus size of a cup size of B, C, D, DD, DDD, E, F, G and H with an under bust size of 40 to 46 inches includes first cup insert 1005, 2217 and second cup insert 1007, 2219 that have a size range from size 16 to size 24 and a depth from 0.5 cm to 25 cm. Also, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 11.5 cm to 19.5 cm and a depth from 0.5 cm to 17 cm, and band 1022, 2220 has a length from 34 inches to 46 inches and a width from 12 inches to 62 inches.

Still referring to FIG. 28, a bra assembly 1000, 2200 that fits a plus size of a cup size of B, C, D, DD, DDD, E, F, G and H with an under bust size of 42 to 48 inches includes first cup insert 1005, 2217 and second cup insert 1007, 2219 that have a size range from size 18 to size 26 and a depth from 0.5 cm to 25 cm, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 12 cm to 20 cm and a depth from 0.5 cm to 17 cm, and band 1022, 2220 has a length from 36 inches to 48 inches and a width from 12 inches to 62 inches.

Still referring to FIG. 28, a bra assembly 1000, 2200 that fits a plus size of a cup size of B, C, D, DD, DDD, E, F, G and H with an under bust size of 44 to 50 inches includes first cup insert 1005, 2217 and second cup insert 1007, 2219 that have a size range from size 20 to size 28 and a depth from 0.5 cm to 25 cm. Also, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 12.5 cm to 20.5 cm and a depth from 0.5 cm to 17 cm, and band 1022, 2220 has a length from or of 38 inches to 50 inches and a width from 12 inches to 62 inches.

Again, referring to FIG. 28, a bra assembly 1000, 2200 that fits a plus size of a cup size of B, C, D, DD, DDD, E, F, G and H with an under bust size of 46 to 52 inches includes first cup insert 1005, 2217 and second cup insert 1007, 2219 that have a size range from size 22 to size 30 and a depth from 0.5 cm to 25 cm, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 13 cm to 21 cm and a depth from 0.5 cm to 17 cm, and band 1022, 2220 has a length from 40 inches to 52 inches and a width from 12 inches to 62 inches.

Still referring to FIG. 28, a bra assembly 1000, 2200 that fits a plus size of a cup size of B, C, D, DD, DDD, E, F, G and H with an under bust size of 48 to 54 inches includes first cup insert 1005, 2217 and second cup insert 1007, 2219 that have a size range from size 24 to size 32 and a depth from 0.5 cm to 25 cm, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 13.5 cm to 21.5 cm and a depth from 0.5 cm to 17 cm, and band 1022, 2220 has a length from 42 inches to 54 inches and a width from 12 inches to 62 inches.

Still referring to FIG. 28, a bra assembly 1000, 2200 that fits a plus size of a cup size of C, D, DD, DDD, E, F, G and H with an under bust size of 50 to 56 inches includes first cup insert 1005, 2217 and second cup insert 1007, 2219 that have a size range from size 26 to size 34 and a depth from 0.5 cm to 25 cm. Also, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 14 cm to 22 cm and a depth from 0.5 cm to 17 cm, and band 1022, 2220 has a length from 44 inches to 56 inches and a width from 12 inches to 62 inches.

Again, referring to FIG. 28, a bra assembly 1000, 2200 that fits a plus size of a cup size of D, DD, DDD, E, F, G and H with an under bust size of 52 to 58 inches includes first cup insert 1005, 2217 and second cup insert 1007, 2219 that have a size range from size 28 to size 36 and a depth from 0.5 cm to 25 cm, the portion of first ply of fabric 1021 of first cup assembly 1004 and the portion of second ply of fabric

1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 14.5 cm to 22.5 cm and a depth from 0.5 cm to 17 cm, and band 1022, 2220 has a length from 46 inches to 58 inches and a width from 12 inches to 62 inches.

Still referring to FIG. 28, a bra assembly 1000, 2200 that fits a plus size of a cup size of DD, DDD, E, F, G and H with an under bust size of 54 to 60 inches includes first cup insert 1005, 2217 and second cup insert 1007, 2219 that have a size range from size 30 to size 38 and a depth from 0.5 cm to 25 cm, the portion of first ply of fabric 1021 of first cup assembly 1004 and the portion of second ply of fabric 1043 of second cup assembly 1014 that are bubble molded and the portions of inner ply of fabric 2202 and the portion of outer ply of fabric 2204 covering first cup insert 2217 of first cup assembly 2216 and covering second cup insert 2219 of second cup assembly 2218 that are bubble molded have a circumference from 15 cm to 23 cm and a depth from 0.5 cm to 17 cm, and band 1022, 2220 has a length from 48 inches to 60 inches and a width from 12 inches to 62 inches.

The numerical values provided herein can have a range that is 15% plus/minus the value provided.

It should also be noted that the terms "first", "second", "third", "upper", "lower", and the like may be used herein to modify various elements. In addition, there term "from" includes the term "of". These modifiers do not imply a spatial, sequential, or hierarchical order to the modified elements unless specifically stated.

While the present disclosure has been described with reference to one or more exemplary embodiments, it will be understood by those skilled in the art that various changes can be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A garment for two or more different sized wearers having different cup sizes and/or different band sizes, the garment comprising:

an inner ply of fabric;

an outer ply of fabric connected to the inner ply of fabric forming an interior volume;

a first cup assembly formed by a first portion of the inner ply of fabric, a first portion of the outer ply of fabric and a first cup insert;

a second cup assembly formed by a second portion of the inner ply of fabric, a second portion of the outer ply of fabric and a second cup insert, the inner ply of fabric and the outer ply of fabric each being stretchable so that the first cup insert and the second cup insert are each movable in a horizontal direction, a vertical direction, and a diagonal direction upon stretch of the inner ply of fabric and the outer layer of fabric; and a band connected to the inner ply of fabric and the outer ply of fabric, wherein the first cup insert has a first top portion and a first bottom portion and the second cup insert has a second top portion and a second bottom portion, wherein the first bottom portion and the second bottom portion are adjacent the band, and wherein the first cup insert is stitched to the inner and/or outer ply of fabric only at the first bottom portion and the second cup insert is stitched to the inner and/or outer ply of fabric only at the second bottom portion.

2. The garment of claim 1, wherein the inner ply of fabric is connected to the outer ply of fabric at a top edge, a bottom edge, a first side edge and a second side edge to form the interior volume that is continuous and unified.

3. The garment of claim 2, wherein the inner ply of fabric and the outer ply of fabric are molded to form a convex shape that has a circumference from 7.5 cm to 23 cm and a depth of 0.5 cm to 17 cm having tolerance of +/−17 percent at a location where the inner ply of fabric and the outer ply of fabric overlap opposite sides of the first cup insert, and wherein the inner ply of fabric and the outer ply of fabric are molded to form a convex shape that has a circumference from 7.5 cm to 23 cm and a depth of 0.5 cm to 17 cm having tolerance of +/−17 percent at a location where the inner ply of fabric and the outer ply of fabric overlap opposite sides of the second cup insert.

4. The garment of claim 1, wherein the inner ply of fabric is connected to the outer ply of fabric at a top edge, a bottom edge, a first side edge and a second side edge by being a folded layer of fabric and secured together to form the interior volume.

5. The garment of claim 1, wherein the inner ply of fabric and the outer ply of fabric are molded at a location where the inner ply of fabric and the outer ply of fabric overlap opposite sides of the first cup insert, and wherein the inner ply of fabric and the outer ply of fabric are molded at a location where the inner ply of fabric and the outer ply of fabric overlap opposite sides of the second cup insert.

6. The garment of claim 1, wherein the inner ply of fabric, the outer ply of fabric, or both the inner ply of fabric and the outer ply of fabric has a first opening adjacent the first cup insert to access the interior volume and the inner ply of fabric, the outer ply of fabric, or both the inner ply of fabric and the outer ply of fabric has a second opening adjacent the second cup insert to access the interior volume.

7. The garment of claim 1, wherein the first ply of fabric and the second ply of fabric each has a fabric length elongation range of 60-220% and fabric width elongation range of 70-240%.

8. The garment of claim 1, wherein the first ply of fabric and the second ply of fabric each has a spandex content of 5-40% and a nylon or polyester content of 60-95%.

9. The garment of claim 1, wherein the first ply of fabric and the second ply of fabric each has a fabric weight of 2.4-8 $oz/yd^2$.

10. The garment of claim 1, wherein the band is a material having an elongation at 20 lbf in a range of 90 percent to 190 percent having a tolerance of +/−20 percent.

11. The garment of claim 1, wherein the band has a fiber content of 50-95% of nylon, polyester, or any other synthetic or natural yarn, and a spandex content of 5-50%.

12. The garment of claim 1, wherein the inner ply of fabric has an inner top edge and an inner bottom edge and the outer ply of fabric has an outer top edge and an outer bottom edge, wherein the outer top edge is connected to the inner top edge and the outer bottom edge is connected to the inner bottom edge forming the interior volume, and wherein the outer top edge and the inner top edge are each connected to an exterior layer that is molded at a location of the first cup insert and a location of the second cup insert.

13. The garment of claim 1, wherein the band is a continuous band.

14. The garment of claim 1, wherein the bra assembly has a distance between closest points of the first cup insert and the second cup insert that is less than 30 percent of a size of the band.

15. The garment of claim 1, wherein the band comprises a first end and a second end in a back portion that is opposite the first cup assembly and the second cup assembly, and further comprises an adjustable closure assembly that selectively connects the first end and the second end of the band together.

16. The garment of claim 1, wherein the band is an adjustable band having a first end and a second end with the first end and the second end having a closure to removably connect the first end to the second end at a front of the garment.

17. The garment of claim 1, wherein the garment is a dress, a swim top, a one-piece swimsuit, a tank top, a t-shirt, an athletic-wear top, a long-sleeve shirt, a sleep top, lingerie, a camisole, or any other garment that can incorporate a bra.

* * * * *